US009305486B2

(12) United States Patent
Tsuge

(10) Patent No.: US 9,305,486 B2
(45) Date of Patent: Apr. 5, 2016

(54) DISPLAY DEVICE AND METHOD FOR DRIVING SAME HAVING SELECTION CONTROL WIRE FOR SCANNING WIRES AND SECONDARY DATA WIRE

(75) Inventor: Hitoshi Tsuge, Osaka (JP)

(73) Assignee: JOLED INC., Tokyo (JP)

( * ) Notice: Subject to any disclaimer, the term of this patent is extended or adjusted under 35 U.S.C. 154(b) by 121 days.

(21) Appl. No.: 14/128,695

(22) PCT Filed: Jun. 29, 2011

(86) PCT No.: PCT/JP2011/003730
§ 371 (c)(1),
(2), (4) Date: Dec. 23, 2013

(87) PCT Pub. No.: WO2013/001575
PCT Pub. Date: Jan. 3, 2013

(65) Prior Publication Data

US 2014/0146027 A1 May 29, 2014

(51) Int. Cl.
*G09G 3/32* (2006.01)

(52) U.S. Cl.
CPC ..... *G09G 3/3208* (2013.01); *G09G 3/3233* (2013.01); *G09G 2300/0804* (2013.01); *G09G 2300/0814* (2013.01); *G09G 2300/0842* (2013.01); *G09G 2300/0861* (2013.01);
(Continued)

(58) Field of Classification Search
CPC ..... G09G 3/3208; G09G 3/3233; G09G 2300/0842; G09G 2300/0814; G09G 2300/0804; G09G 2300/0861; G09G 2310/0205; G09G 2310/0208; G09G 2310/021
See application file for complete search history.

(56) References Cited

U.S. PATENT DOCUMENTS

2003/0001828 A1* 1/2003 Asano ..... G09G 3/3241 345/204
2003/0107560 A1 6/2003 Yumoto et al.
2004/0222746 A1* 11/2004 Winters ..... G09G 3/3233 315/167

(Continued)

FOREIGN PATENT DOCUMENTS

EP 0717445 6/1996
JP 05-188395 7/1993

(Continued)

OTHER PUBLICATIONS

Search report from International Search Report in PCT/JP2011/003730, mail date is Jul. 26, 2011.

*Primary Examiner* — Dwayne Bost
*Assistant Examiner* — Darlene M Ritchie
(74) *Attorney, Agent, or Firm* — Greenblum & Bernstein, P.L.C.

(57) ABSTRACT

A display device includes: a plurality of pixel circuits; a first gate signal wire arranged for every two rows of the pixel circuits; a second gate signal wire arranged for every row of the pixel circuits, a source signal wire arranged for every column of the pixel circuits; a switch arranged at each intersection of the second gate signal wire and the source signal wire; and a secondary source signal wire arranged to correspond to each of the switches, each of the pixel circuits including a switch and a storage capacitance, the switch switching between conduction and non-conduction between the source signal wire and the secondary source signal wire in accordance with the voltage of the second gate signal wire, and the switch switching between conduction and non-conduction between the secondary source signal wire and the storage capacitance in accordance with the voltage of the first gate signal wire.

11 Claims, 34 Drawing Sheets

(52) U.S. Cl.
CPC ..... *G09G2310/0205* (2013.01); *G09G 2310/0208* (2013.01)

(56) References Cited

U.S. PATENT DOCUMENTS

| | | | | |
|---|---|---|---|---|
| 2005/0088103 | A1 | 4/2005 | Kageyama et al. | |
| 2005/0200788 | A1 | 9/2005 | Edwards | |
| 2006/0145964 | A1* | 7/2006 | Park et al. | 345/76 |
| 2006/0170624 | A1* | 8/2006 | Yumoto et al. | 345/76 |
| 2007/0001954 | A1* | 1/2007 | Shishido et al. | 345/89 |
| 2007/0210720 | A1* | 9/2007 | Kimura | H01L 27/1255 315/169.3 |
| 2008/0048957 | A1* | 2/2008 | Chiang | G09G 3/3607 345/87 |
| 2009/0244055 | A1* | 10/2009 | Asano et al. | 345/214 |
| 2009/0322730 | A1* | 12/2009 | Yamamoto et al. | 345/213 |
| 2010/0134388 | A1* | 6/2010 | Maekawa et al. | 345/76 |
| 2011/0109612 | A1* | 5/2011 | Chaji | G09G 3/3283 345/211 |
| 2012/0299978 | A1* | 11/2012 | Chaji | 345/690 |
| 2013/0099692 | A1* | 4/2013 | Chaji | H05B 37/02 315/224 |
| 2013/0155124 | A1 | 6/2013 | Tsuge | |
| 2014/0333513 | A1* | 11/2014 | Park et al. | 345/76 |
| 2015/0295016 | A1* | 10/2015 | Liu | G09G 3/20 345/5 |

FOREIGN PATENT DOCUMENTS

| | | |
|---|---|---|
| JP | 05-303114 | 11/1993 |
| JP | 08-241048 | 9/1996 |
| JP | 2002-215093 | 7/2002 |
| JP | 2005-134435 | 5/2005 |
| JP | 2006-500617 | 1/2006 |

* cited by examiner

PRIOR ART

PRIOR ART

DISPLAY DEVICE AND METHOD FOR DRIVING SAME HAVING SELECTION CONTROL WIRE FOR SCANNING WIRES AND SECONDARY DATA WIRE

TECHNICAL FIELD

The present invention relates to a display device that displays an image using an organic electro-luminescence element, a liquid crystal element, or the like and a method for driving the same, and particularly relates to an active matrix display device that displays an image using an active element and a method for driving the same.

BACKGROUND ART

In an active matrix display device, many display pixels are arranged in a matrix, and an image is displayed by the light intensity being controlled for every pixel in accordance with a picture signal. In recent years, demands for a liquid crystal display device that is an active matrix display device using a liquid crystal element are increasing due to advantages such as light weight, thinness, and low power consumption. In order to achieve light weight, thinness, low power consumption, and the like further, an active matrix display device using an organic electro-luminescence element (hereinafter, abbreviated as "organic EL element") in which a backlight required in a liquid crystal display device is unnecessary has been developed (for example, see Patent Document 1).

FIG. 33 is a circuit diagram showing the configuration of a pixel circuit of a conventional active matrix display device. As shown in FIG. 33, the conventional active matrix display device includes a plurality of pixel circuits 112*a* and 112*b*, a plurality of gate signal wires 116*a* and 116*b*, and a plurality of source signal wires 118. The gate signal wires 116*a* and 116*b* are driven by a gate driver (omitted in the drawing), and the source signal wires 118 are driven by a source driver (omitted in the drawing).

The pixel circuit 112*a* includes a drive transistor 111*a*, an organic EL element 114*a*, a switch 117*a*, and a storage capacitance 119*a* to form a display pixel. The pixel circuit 112*b* is configured in a similar manner and behaves in a similar manner to the pixel circuit 112*a*. Other pixel circuits (omitted in the drawing) are similar.

Writing of a picture signal in each pixel is performed by switches 117*a* and 117*b*. That is, the switches 117*a* and 117*b* are caused to be in a conducted state in order, and a voltage corresponding to the picture signal applied to the source signal wire 118 is stored in storage capacitances 119*a* and 119*b*. Even if the switches 117*a* and 117*b* come to a non-conducted state, drive transistors 111*a* and 111*b* supply current in accordance with the voltage stored in the storage capacitances 119*a* and 119*b* to organic EL elements 114*a* and 114*b* for one frame period, and each pixel emits light with predetermined luminance.

FIG. 34 is a timing diagram showing the voltage waveforms of the gate signal wire and the source signal wire shown in FIG. 33. For example, in the case of capturing a picture signal into the pixel circuit 112*a* from the source signal wire 118, it is necessary that a voltage SV of the source signal wire 118 be a predetermined voltage when a voltage GV of the gate signal wire 116*a* changes and the switch 117*a* is in a conducted state, as shown in FIG. 34.

At time t1 in an example shown in FIG. 34, the voltage SV of the source signal wire 118 has dropped from a predetermined first voltage Vdw to a predetermined second voltage Vdk, the predetermined second voltage Vdk is written in the pixel circuit 112*a*, and the pixel emits light with a predetermined luminance. Thus, change in the voltage SV of the source signal wire 118 has to be completed by time t2 that is one horizontal scanning period minus a falling period of the voltage GV of the gate signal wire 116*a*.

However, when the load capacitance of the source signal wire 118 is large, the rate of change in the voltage SV of the source signal wire 118 is slow, and there are cases where the voltage SV of the source signal wire 118 does not become the predetermined second voltage Vdk even at the time t2. In this case, the voltage of the source signal wire 118 at the time t2 is written in the pixel circuit 112*a*, the pixel emits light with a luminance different from the predetermined luminance, and a favorable image cannot be displayed.

The rate of change in the voltage of the source signal wire 118 is determined by the load on the source signal wire 118, and changes in accordance with the time constant determined by the resistance value of the source signal wire 118 multiplied by the capacitance value of the source signal wire 118.

As shown with a broken line in FIG. 33, the source signal wire 118 is formed, as parasitic capacitance, with a wiring capacitance 115 generated between wiring of the source signal wire 118 and another layer and channel capacitances 113*a* and 113*h* generated between the gate and drain or between the gate and source of the switches 117*a* and 117*b* for capturing a picture signal into the pixel circuits 112 and 112*b* from the source signal wire 118. The wiring capacitance 115 is determined by the wiring length and the wiring width of the source signal wire 118, and the channel capacitances 113*a* and 113*b* are determined by the number of the switches 117*a* and 117*b* connected to the same source signal wire 118 and the shape of a transistor forming the switches 117*a* and 117*b*. With these capacitances, the capacitance of the source signal wire 118 increases, and the rate of change in the voltage of the source signal wire 118 decreases.

In an active matrix display device using a liquid crystal element, an organic EL element, or the like, there is an increase in the load capacitance of the source signal wire 118 due to an increase in screen size or an increase in the number of vertical lines, and it is becoming increasingly difficult to write the voltage of a desired picture signal in a pixel circuit in a predetermined period (one horizontal scanning period).

In the case where the number of pixel rows has increased due to the increase in resolution of a display screen, the rate of change in the voltage of the source signal wire decreases, and it becomes further difficult to write a picture signal accurately. In the case where the number of pixel columns has increased due to an increase in resolution of the display screen, the arrangement pitch of the source signal wire and the pixel circuit narrows, and therefore a leak current occurs. As a result, a vertical crosstalk occurs, an unnecessary image similar to a strip being drawn in the vertical direction is displayed, and the display quality decreases.

Patent Document 1: Japanese Patent Application Laid-open No. H8-241048

SUMMARY OF THE INVENTION

An object of the present invention is to provide a display device and a method for driving the same in which a picture signal can be written accurately and a vertical crosstalk can be reduced, even if the number of pixel rows and the number of the pixel columns increase due to an increase in resolution of a display screen and a write period is shortened.

A display device according to one aspect of the present invention includes: a plurality of display pixels arranged in a matrix; a scanning wire arranged for every N rows (N is an integer greater than or equal to 2) of the display pixels; a selection control wire arranged for every row of the display pixels; a main data wire arranged for every column of the display pixels; a first switching element arranged at each intersection of the scanning wire and the main data wire; and a secondary data wire arranged to correspond to each of first switching elements and connecting the display pixels belonging to the N rows in each column of the display pixels, each of the display pixels including an organic electro-luminescence element, a drive transistor, a second switching element and a capacitance element for maintaining a voltage corresponding to display data, the first switching element switching between conduction and non-conduction between the main data wire and the secondary data wire in accordance with a voltage of the scanning wire, the second switching element switching between conduction and non-conduction between the secondary data wire and the capacitance element in accordance with a voltage of the selection control wire, and the display pixels being driven with a voltage drive scheme.

A method for driving a display device according to another aspect of the present invention is a method for driving a display device including a plurality of display pixels arranged in a matrix, a scanning wire arranged for every N rows (N is an integer greater than or equal to 2) of the display pixels, a selection control wire arranged for every row of the display pixels, a main data wire arranged for every column of the display pixels, a first switching element arranged at each intersection of the scanning wire and the main data wire, and a secondary data wire arranged to correspond to each of first switching elements and connecting the display pixels belonging to the N rows in each column of the display pixels, each of the display pixels including an organic electro-luminescence element, a drive transistor, a second switching element and a capacitance element for maintaining a voltage corresponding to display data, the method including: operating the capacitance element to maintain a voltage corresponding to display data by causing the first switching element to electrically connect the main data wire and the secondary data wire to each other in accordance with a voltage of the scanning wire and causing the second switching element to electrically connect the secondary data wire and the capacitance element to each other in accordance with a voltage of the selection control wire; and driving the display pixels with a voltage drive scheme.

With the present invention, a picture signal can be written accurately and a vertical crosstalk can be reduced, even if the number of pixel rows and the number of pixel columns increase due to an increase in resolution of a display screen and the write period is shortened.

BEST MODE FOR CARRYING OUT THE INVENTION

An active matrix display device in each embodiment of the present invention will be described below with reference to the drawings.

Figure 1:
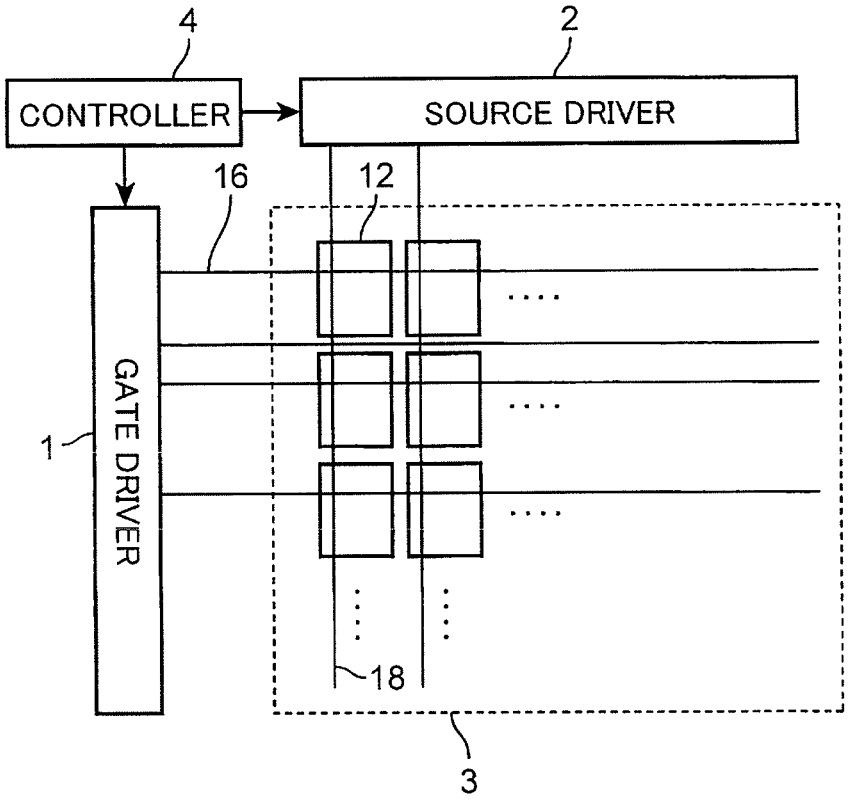
FIG. 1 is a block diagram showing the configuration of an active matrix display device in a first embodiment of the present invention.

FIG. 1 is a block diagram showing the configuration of an active matrix display device in a first embodiment of the present invention. In FIG. 1, a transistor 20 described later is omitted in the drawing in order to simplify the illustration.

The active matrix display device shown in FIG. 1 is an organic electro-luminescence (EL) display device and includes a gate driver 1, a source driver 2, an organic electro-luminescence (EL) panel 3, a controller 4, a plurality of gate signal wires 16, and a plurality of source signal wires 18. The organic EL panel 3 includes a plurality of pixel circuits 12 and a plurality of the transistors 20. A display pixel is configured from the pixel circuit 12, and a plurality of the display pixels are arranged in a matrix.

The controller 4 controls the gate driver 1 and the source driver 2. The gate driver 1 drives the gate signal wire 16 by row of the organic EL panel 3. The source driver 2 drives the source signal wire 18.

Figure 2:
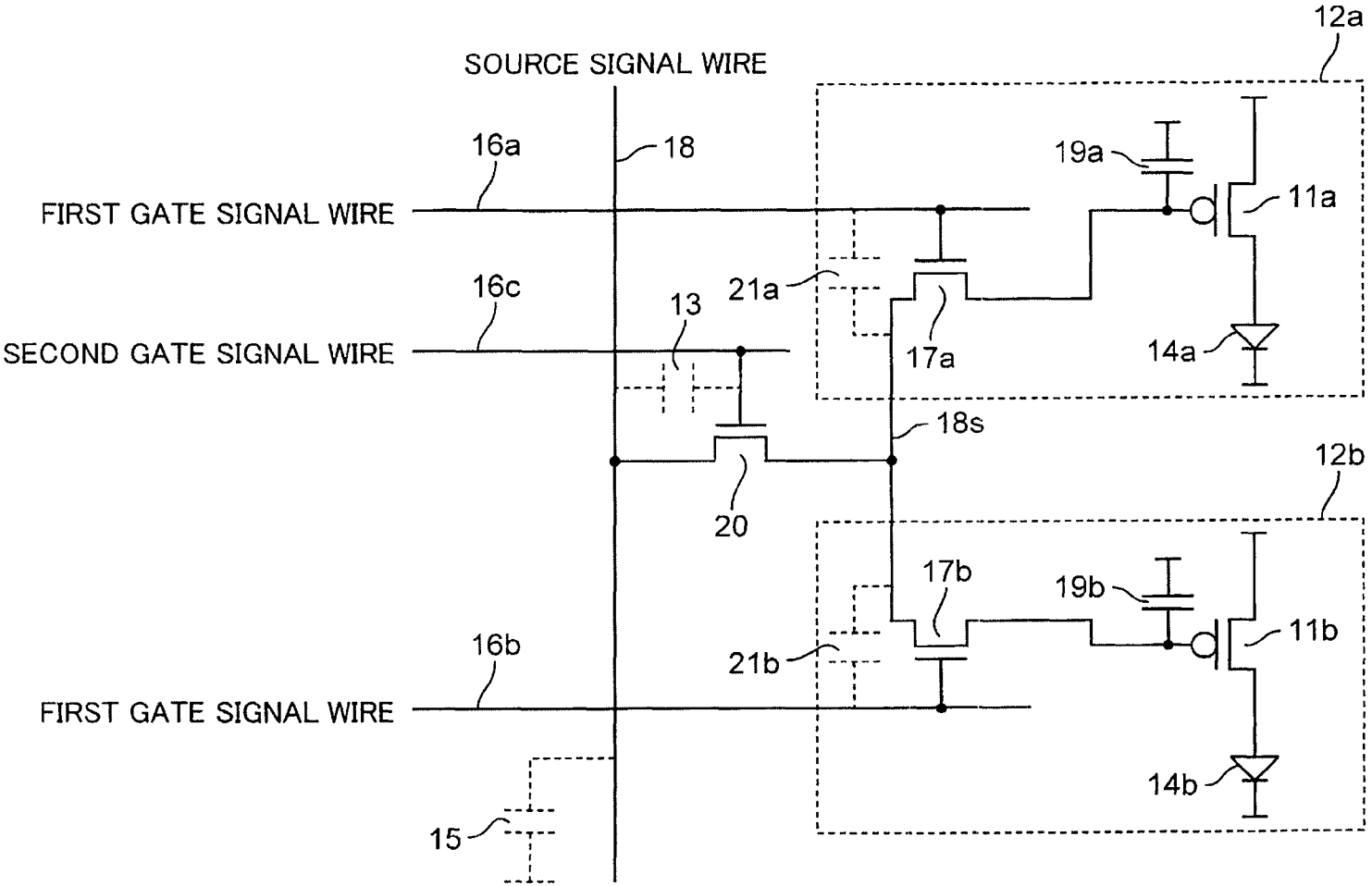
FIG. 2 is a circuit diagram showing the configuration of a pixel circuit of the active matrix display device shown in FIG. 1.

FIG. 2 is a circuit diagram showing the configuration of a pixel circuit of the active matrix display device shown in FIG. 1. In FIG. 2, in order to simplify the illustration, only two pixel circuits 12*a* and 12*b* corresponding to display pixels belonging to two consecutive rows in one certain column of the display pixels out of the plurality of pixel circuits 12 arranged in a matrix are shown, only the source signal wire 18, first gate signal wires 16*a* and 16*b*, and a second gate signal wire 16*c* provided with respect to the two pixel circuits 12*a* and 12*b* out of the plurality of source signal wires 18 and the plurality of gate signal wires 16 are shown, and only the transistor 20 provided with respect to the two pixel circuits 12*a* and 12*b* out of the plurality of transistors 20 is shown. In this regard, drawings for other pixel circuits are similar. In the embodiments below, a case of application for N consecutive rows (two consecutive rows in the first embodiment) in one certain column of display pixels will be described. However, the N rows in one certain column of the display pixels in the present invention do not necessarily need to be consecutive, and application may be for N arbitrary rows.

As shown in FIG. 2, the first gate signal wires 16*a* and 16*b* and the second gate signal wire 16*c* are arranged along the row direction of the organic EL panel 3. The first gate signal wires 16*a* and 16*b* are connected to the pixel circuits 12*a* and 12*b* and arranged for every row of the display pixels. The second gate signal wire 16*c* is provided with respect to the two pixel circuits 12*a* and 12*b* and arranged for every two rows of the display pixels.

The source signal wire 18 is arranged along the column direction of the organic EL panel 3. The transistor 20 is arranged at each intersection of the second gate signal wire 16*c* and the source signal wire 18. The source signal wire 18 is connected to a secondary source signal wire 18*s* via the transistor 20. The secondary source signal wire 18*s* is connected to the pixel circuits 12*a* and 12*b* and arranged to correspond to the transistor 20 and connecting display pixels belonging to two consecutive rows in each column of the display pixels. The second gate signal wire 16*c* is connected to the gate of the transistor 20. The transistor 20 switches between conduction and non-conduction between the source signal wire 18 and the secondary source signal wire 18*s* in accordance with the voltage of the second gate signal wire 16*c*.

The pixel circuit 12*a* includes a drive transistor 11*a*, an organic EL element 14*a*, a switch 17*a*, and a storage capacitance 19*a*. The storage capacitance 19*a* maintains the voltage corresponding to a picture signal, i.e., display data. The first gate signal wire 16*a* is connected to the gate of the switch 17*a* (transistor). The switch 17*a* switches between conduction and non-conduction between the secondary source signal wire 18*s* and the storage capacitance 19*a* in accordance with the voltage of the first gate signal wire 16*a*. One end of the storage capacitance 19*a* is connected to the gate of the drive transistor 11*a*. The drive transistor 11*a* and the organic EL element 14*a* are connected in series. The pixel circuit 12*b* is configured in a similar manner to the pixel circuit 12*a*. Other pixel circuits (omitted in the drawing) are similar.

The pixel circuits 12*a* and 12*b* correspond to one example of display pixels, the second gate signal wire 16*c* corresponds to one example of a scanning wire, the first gate signal wires 16*a* and 16*b* correspond to one example of selection control wires, the source signal wire 18 corresponds to one example of a main data wire, the transistor 20 corresponds to one example of a first switching element, the secondary source signal wire 18*s* corresponds to one example of a secondary data wire, switches 17*a* and 17*b* correspond to one example of second switching elements, storage capacitances 19*a* and 19*b* correspond to one example of capacitance elements, and organic EL elements 14*a* and 14*b* correspond to one example of organic EL elements.

Figure 3:
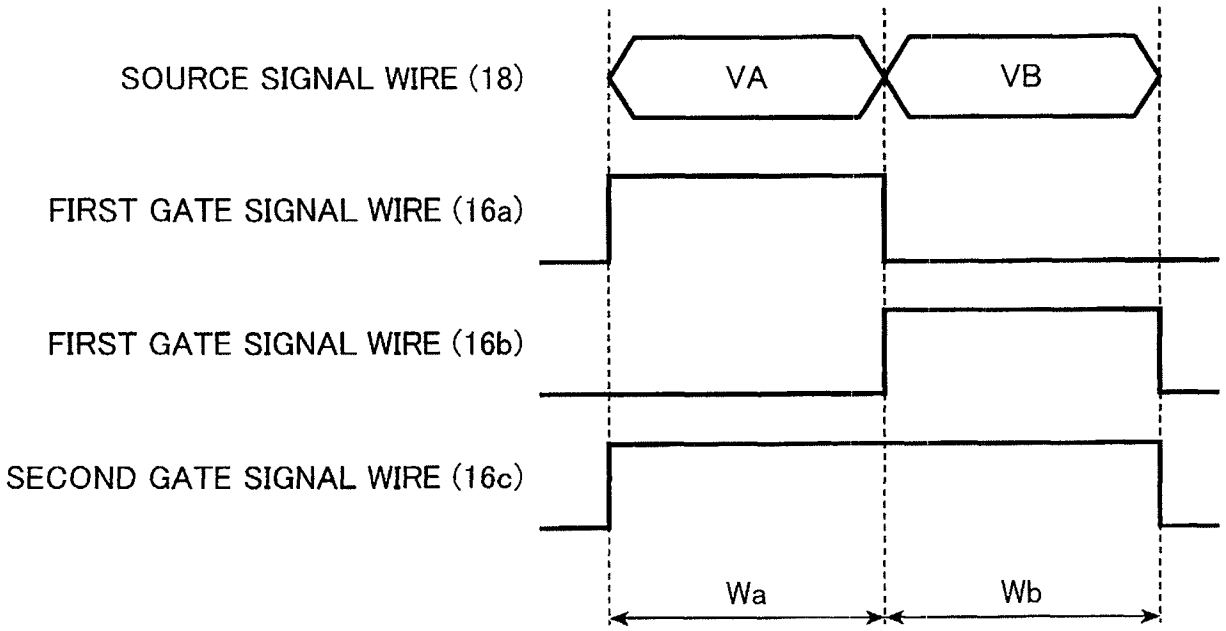
FIG. 3 is a timing diagram showing one example of the voltage waveforms of a source signal wire, first gate signal wires, and a second gate signal wire shown in FIG. 2.

FIG. 3 is a timing diagram showing one example of the voltage waveforms of the source signal wire 18, the first gate signal wires 16*a* and 16*b* , and the second gate signal wire 16*c* shown in FIG. 2.

As shown in FIG. 3, in the case where, for example, the transistor 20 performs writing in the pixel circuits 12*a* and 12*b* , picture signals VA and VB corresponding to the pixel circuits 12*a* and 12*b* are input to the source signal wire 18. During this input period, the gate driver 1 causes the transistor 20 that is a switch to be in a conducted state through the second gate signal wire 16*c* , and the pixel circuits 12*a* and 12*b* capture the picture signals VA and VB.

At this time, in order to write the picture signal VA in one of the pixel circuits to which the transistor 20 is connected in a first one horizontal scanning period Wa, the gate driver 1 causes the switch 17*a* to be in a conducted state through the first gate signal wire 16*a* and causes the switch 17*b* to be in a non-conducted state through the first gate signal wire 16*b* to write the picture signal VA in the pixel circuit 12*a*. In a next one horizontal scanning period Wb, the gate driver 1 causes the switch 17*b* to be in a conducted state through the first gate signal wire 16*b* and causes the switch 17*a* to be in a non-conducted state through the first gate signal wire 16*a* to write the picture signal VB in the pixel circuit 12*b*.

By implementing the behavior repeatedly for every set of the pixel circuits connected to one transistor 20, a picture signal is written in all pixels. Although the first gate signal wires 16*a* and 16*b* and the second gate signal wire 16*c* are driven by the gate driver 1 in this embodiment, various modifications are possible, such as driving the first gate signal wires 16*a* and 16*b* with another circuit. It is similar for other embodiments below.

With the configuration, an increase in the rate of voltage change of the source signal wire 18 is achieved through a reduction in the load capacitance of the source signal wire 18 in this embodiment. That is, by reducing the total sum of channel capacitances 13 parasitic in the source signal wire 18, high-speed writing of a picture signal is achieved. Specifically, as shown in FIG. 2, the transistor 20 as a switch with which a picture signal is captured from the source signal wire 18 is made common between two display pixels, i.e., pixel circuits 12*a* and 12*b*, and the switches 17*a* and 17*b* for capturing a picture signal separately into the respective pixel circuits 12*a* and 12*b* are further formed.

Thus, the transistor 20 connected to the source signal wire 18 is provided in a proportion of one with respect to the two pixel circuits 12*a* and 12*b*. Therefore, in the case of comparison with a conventional display device shown in FIG. 33, the number of the channel capacitances 13 is halved with respect to one source signal wire 18. Since the load capacitance of the source signal wire 18 is reduced and the rate of change in the voltage of the source signal wire 18 increase as a result, a picture signal can be written in a shorter period.

A channel capacitance 21*a* of the switch 17*a* influences the source signal wire 18 only when the transistor 20 is in a conducted state, and is cut off from the source signal wire 18 when the transistor 20 is in a non-conducted state. Therefore, the influence of the channel capacitance 21*a* of the switch 17*a* is of a proportion of one over the number of vertical scanning wires, and the load on the source signal wire 18 due to the switch 17*a* becomes extremely small. It is similar for the other switch 17*b*.

In this embodiment, as described above, the parasitic capacitance of the source signal wire 18 can be reduced to shorten the time necessary for writing by providing the transistor 20 connected to the source signal wire 18 not for every row but for every two rows and reducing the number of the transistors 20. Thus, a picture signal can be written accurately even if the number of pixel rows increases due to an increase in resolution of a display screen and a write period is shortened. Since the source signal wire 18 and the storage capacitances 19*a* and 19*b* within the respective pixel circuits 12*a* and 12*b* are connected via two of the transistor 20 and the switches 17*a* and 17*b* connected in series, a leak current can be reduced to reduce a vertical crosstalk. As a result, a picture signal can be written accurately and a vertical crosstalk can be reduced even if the number of pixel rows and the number of pixel columns increase due to an increase in resolution of a display screen and a write period is shortened.

Figure 4:
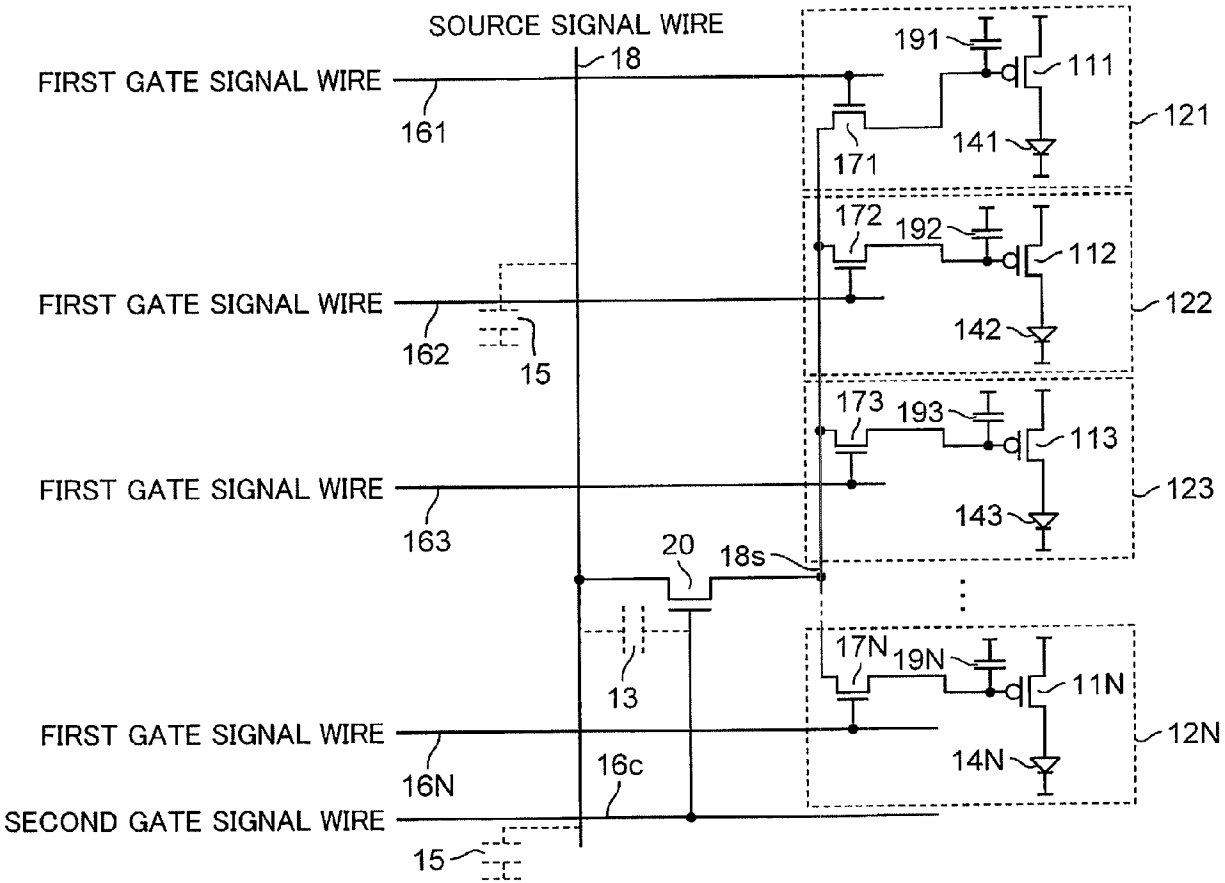
FIG. 4 is a circuit diagram showing the configuration of another pixel circuit applicable to the active matrix display device shown in FIG. 1.

Although one transistor 20 is arranged with respect to the two pixel circuits 12*a* and 12*b* in FIG. 2, one transistor 20 may be arranged with respect to an arbitrary number of pixel circuits. For example, an example in which the second gate signal wire 16*c* is arranged for every N (N is an integer greater than or equal to 2) rows of the display pixels will be described. FIG. 4 is a circuit diagram showing the configuration of another pixel circuit applicable to the active matrix display device in this embodiment.

As shown in FIG. 4, N first gate signal wires 161 to 16N and the second gate signal wire 16*c* are arranged along the row direction of the organic EL panel 3. The first gate signal wires 161 to 16N are connected to pixel circuits 121 to 12N and arranged for every row of the display pixels. The second gate signal wire 16*c* is provided with respect to the N pixel circuits 121 to 12N and arranged for every N rows of the display pixels.

The source signal wire 18 is arranged along the column direction of the organic EL panel 3. The transistor 20 is arranged at each intersection of the second gate signal wire 16*c* and the source signal wire 18. The source signal wire 18 is connected to the secondary source signal wire 18*s* via the transistor 20. The secondary source signal wire 18*s* is connected to the N pixel circuits 121 to 12N and arranged to correspond to the transistor 20 and connecting display pixels belonging to N consecutive rows in each column of the display pixels. The second gate signal wire 16*c* is connected to the gate of the transistor 20. The transistor 20 switches between conduction and non-conduction between the source signal wire 18 and the secondary source signal wire 18*s* in accordance with the voltage of the second gate signal wire 16*c*. The pixel circuits 121 to 12N are configured in a similar manner and behave in a similar manner to the pixel circuits 12*a* and 12*b* shown in FIG. 2.

In the active matrix display device using the pixel circuits shown in FIG. 4, the transistor 20 as a switch with which a picture signal is captured from the source signal wire 18 is made common among N display pixels, i.e., with respect to the N pixel circuits 121 to 12N, and switches 171 to 17N for capturing a picture signal separately into the respective pixel circuits 121 to 12N are further formed.

Figure 33:
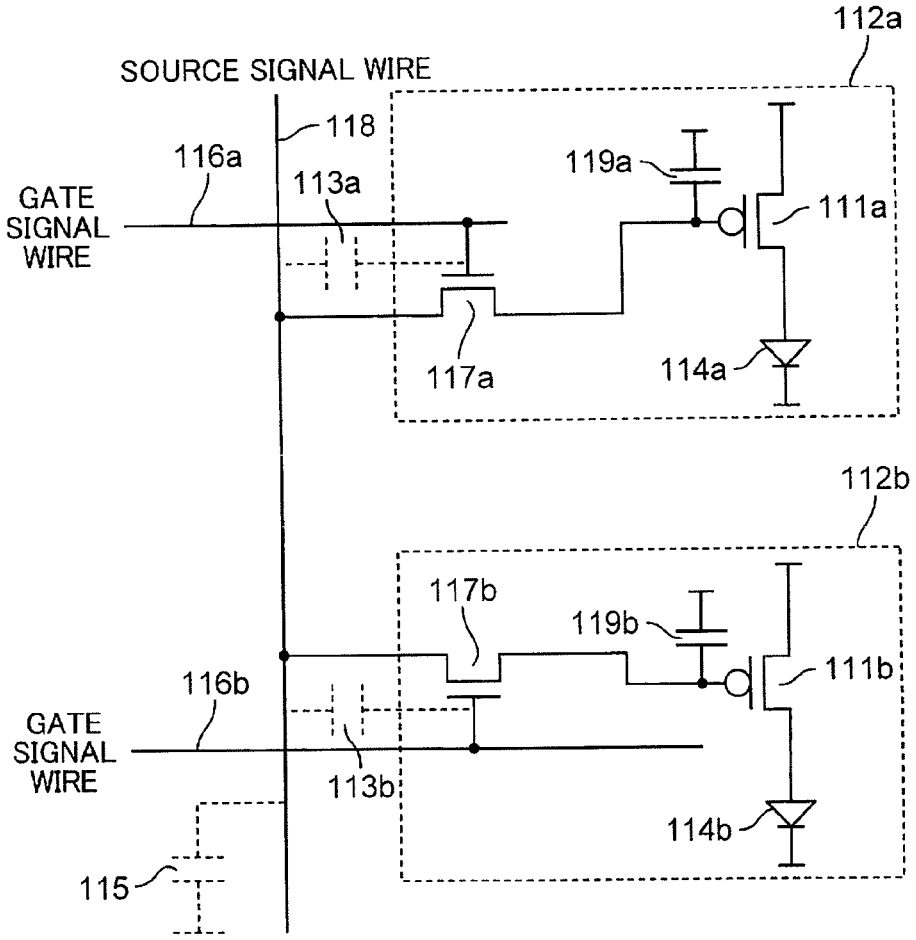
FIG. 33 is a circuit diagram showing the configuration of a pixel circuit of a conventional active matrix display device.
Figure 34:
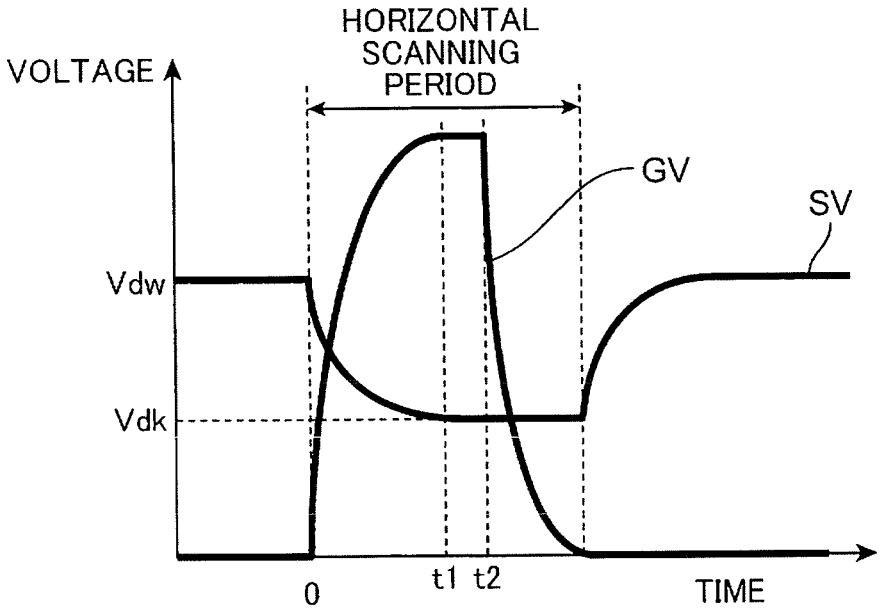
FIG. 34 is a timing diagram showing the voltage waveforms of a gate signal wire and a source signal wire shown in FIG. 33.

In addition to the effect of the active matrix display device using the pixel circuit shown in FIG. 2, the number of the channel capacitances 13 is 1/N with respect to one source signal wire 18 in the case of comparison with the conventional display device shown in FIG. 33, since the transistor 20 connected to the source signal wire 18 is arranged in a proportion of one with respect to the N pixel circuits 121 to 12N with the configuration in this example. Since the load capacitance of the source signal wire 18 is reduced significantly and the rate of change in the voltage of the source signal wire 18 increases significantly as a result, a picture signal can be written in an extremely shorter period.

Figure 5:
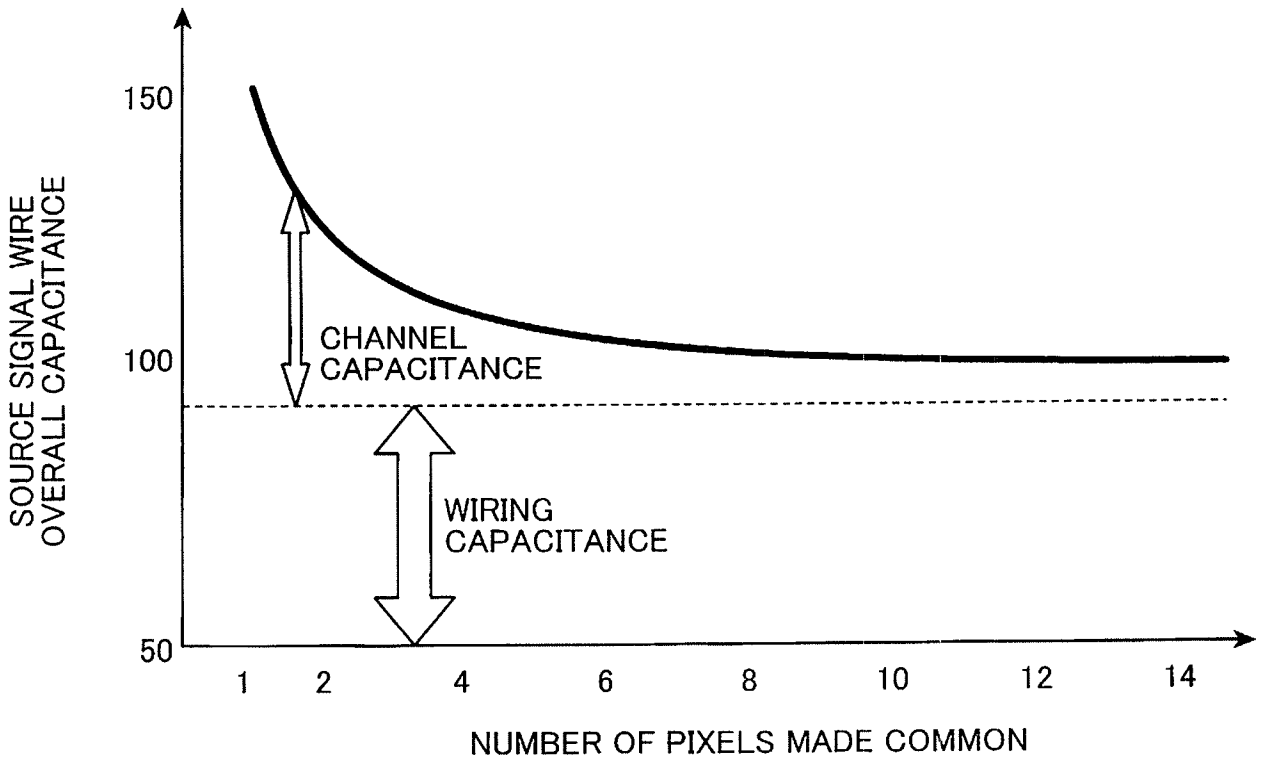
FIG. 5 is a diagram showing the relationship of the number of pixels made common through a switch and the overall capacitance of the source signal wire.

A study on the number N of the pixel circuits 12 made common is as follows. FIG. 5 is a diagram showing the relationship of the number of pixels (pixel circuits 12) made common through the transistor 20 and the overall capacitance of the source signal wire 18.

As shown in FIG. 5, the overall capacitance of the source signal wire 18 decreases as the number of pixels made common is increased, but the number of the channel capacitances 13 eliminated along with commonalization decreases as the number of pixels increases. Therefore, the reduction effect in the overall capacitance of the source signal wire 18 becomes small. Therefore, it is preferable that the design be with the number of connections of up to approximately 8 pixels, i.e., that the number N of the pixel circuits 12 made common satisfy $2 \leq N \leq 8$.

Figure 6:
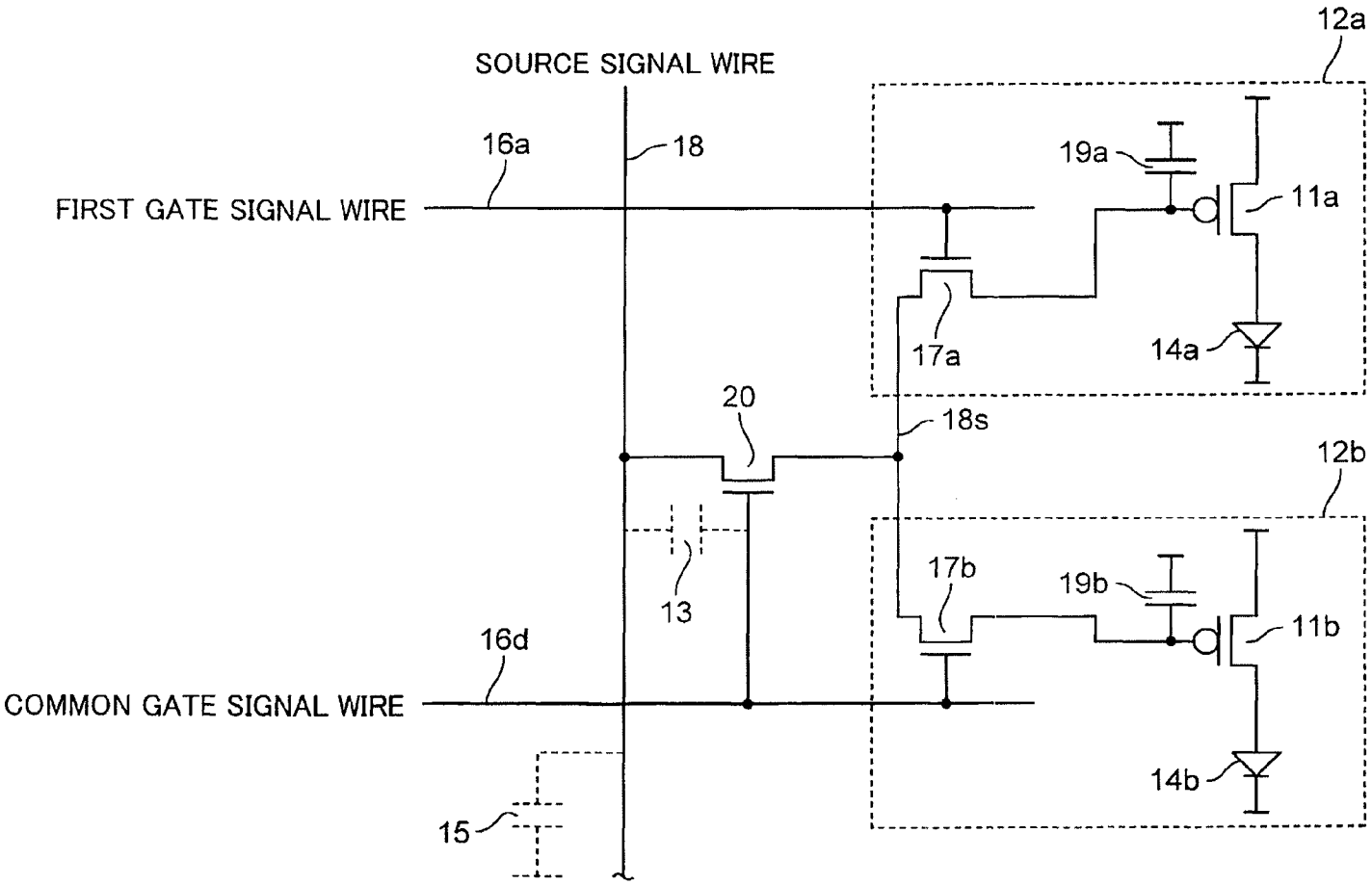
FIG. 6 is a circuit diagram showing the configuration of a pixel circuit of an active matrix display device in a second embodiment of the present invention.

Next, an active matrix display device in a second embodiment of the present invention will be described. FIG. 6 is a circuit diagram showing the configuration of a pixel circuit of the active matrix display device in the second embodiment of the present invention. Since the overall configuration of the active matrix display device in the second embodiment is similar to the active matrix display device shown in FIG. 1, illustration and detailed description are omitted, and the configuration shown in FIG. 1 is referenced appropriately according to necessity. It is similar for other embodiments below.

In the pixel circuit shown in FIG. 2, the necessary number of gate signal wires is three with respect to two pixels (two pixel circuits). However, in this embodiment, the first gate signal wire 16*b* and the second gate signal wire 16*c* shown in FIG. 2 are formed by one gate signal wire that is common, so that two gate signal wires, i.e., one first gate signal wire 16*a* and one common gate signal wire 16*d* are used with respect to the two pixel circuits 12*a* and 12*b* as shown in FIG. 6.

Specifically, as shown in FIG. 6, the first gate signal wire 16*a* and the common gate signal wire 16*d* are arranged along the row direction of the organic EL panel 3. The first gate signal wire 16*a* is connected to the pixel circuit 12*a*. The common gate signal wire 16*d* is connected to the pixel circuit 12*b*. The first gate signal wire 16*a* and the common gate signal wire 16*d* are arranged for every row of display pixels. The common gate signal wire 16*d* is provided with respect to the two pixel circuits 12*a* and 12*b*, and therefore arranged for every two rows of the display pixels.

The source signal wire 18 is arranged along the column direction of the organic EL panel 3. The transistor 20 is arranged at each intersection of the common gate signal wire 16*d* and the source signal wire 18. The source signal wire 18 is connected to the secondary source signal wire 18*s* via the transistor 20. The secondary source signal wire 18*s* is connected to the pixel circuits 12*a* and 12*b*. The common gate signal wire 16*d* is connected to the gate of the transistor 20. The transistor 20 switches between conduction and non-conduction between the source signal wire 18 and the secondary source signal wire 18*s* in accordance with the voltage of the common gate signal wire 16*d*.

The first gate signal wire 16*a* is connected to the gate of the switch 17*a*. The switch 17*a* switches between conduction and non-conduction between the secondary source signal wire 18*s* and the storage capacitance 19*a* in accordance with the voltage of the first gate signal wire 16*a*. The common gate signal wire 16*d* is connected to the gate of the switch 17*b*. The switch 17*b* switches between conduction and non-conduction between the secondary source signal wire 18*s* and the storage capacitance 19*b* in accordance with the voltage of the common gate signal wire 16*d*.

The common gate signal wire 16*d* corresponds to one example of a scanning wire, the first gate signal wire 16*a* and the common gate signal wire 16*d* correspond to one example of selection control wires, and other configurations are similar to the first embodiment.

Figure 7:
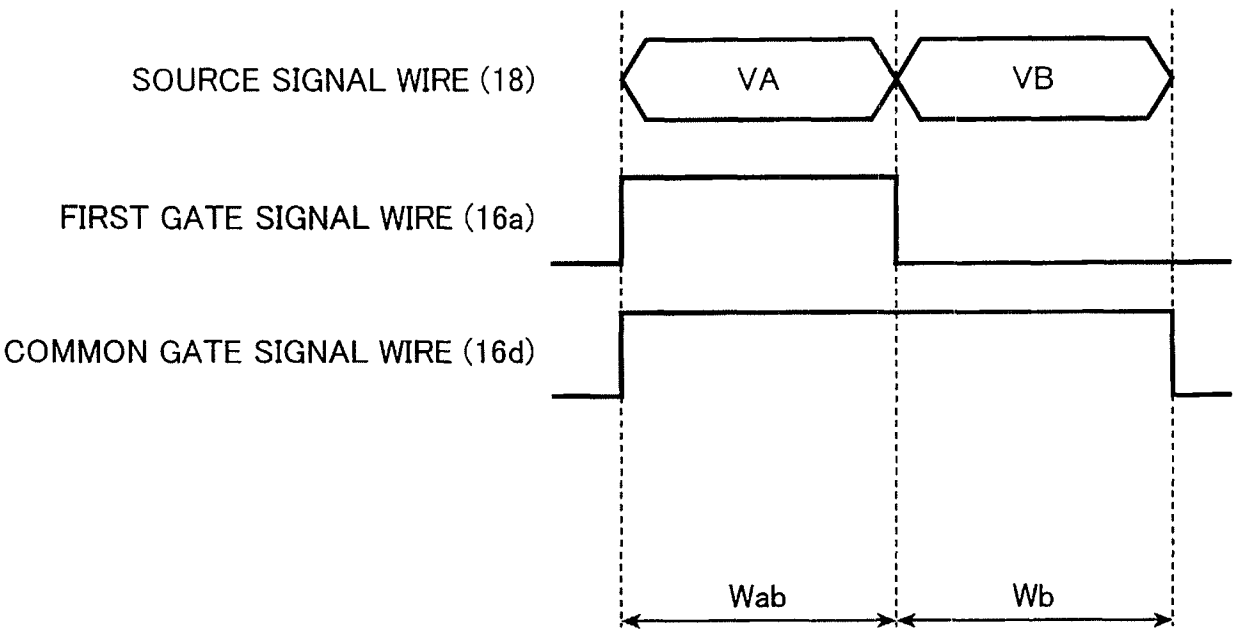
FIG. 7 is a timing diagram showing one example of the voltage waveforms of a source signal wire, a first gate signal wire, and a common gate signal wire shown in FIG. 6.

FIG. 7 is a timing diagram showing one example of the voltage waveforms of the source signal wire 18, the first gate signal wire 16*a*, and the common gate signal wire 16*d* shown in FIG. 6.

Due to this embodiment being the active matrix display device, the organic EL elements 14*a* and 14*b* emit light in accordance with the voltage after completion of writing. Therefore, as shown in FIG. 7, the gate driver 1 causes the transistor 20 and the switch 17*b* to be in a conducted state through the common gate signal wire 16*d* and causes the switch 17*a* to be in a conducted state through the first gate signal wire 16*a* in a first one horizontal scanning period Wab to perform writing of the picture signal VA in the pixel circuit 12*a* for which writing is intended and necessary and perform writing in the pixel circuit 12*b*.

In a subsequent one horizontal scanning period Wb, the gate driver 1 causes the transistor 20 and the switch 17*b* to be in a conducted state through the common gate signal wire 16*d* and causes the switch 17*a* to be in a non-conducted state through the first gate signal wire 16*a* to perform writing of the picture signal VB corresponding to the pixel circuit 12*b*. As a result, light is emitted with a luminance corresponding to the voltage of the picture signal VA in the pixel circuit 12*a* and light can be emitted with a luminance corresponding to the voltage of the picture signal VB in the pixel circuit 12*b* during one frame.

In this embodiment, as described above, it is possible to reduce the number of the channel capacitances 13 with respect to one source signal wire 18 without increasing the number of gate signal wires by inputting the signal waveform shown in FIG. 7, and a favorable display without color mixture can be achieved.

Figure 8:
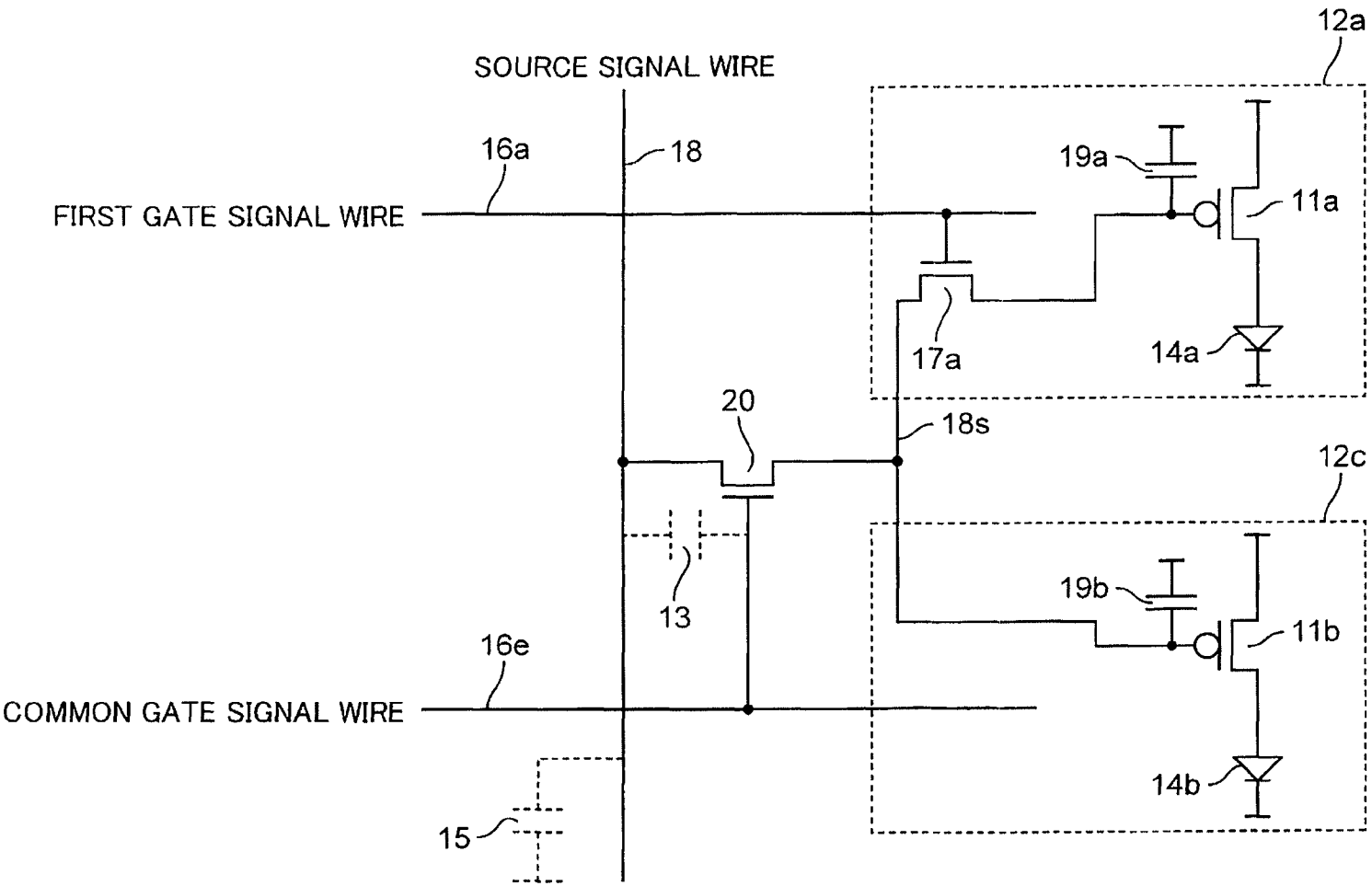
FIG. 8 is a circuit diagram showing the configuration of a pixel circuit of an active matrix display device in a third embodiment of the present invention.

Next, an active matrix display device in a third embodiment of the present invention will be described. FIG. 8 is a circuit diagram showing the configuration of a pixel circuit of the active matrix display device in the third embodiment of the present invention.

In the pixel circuit shown in FIG. 6, the transistor 20 and the switch 17*b* perform the same behavior. With the switch 17*a* being in the pixel circuit 12*a*, it is possible to isolate the voltages stored in the storage capacitances 19*a* and 19*b* between the pixel circuit 12*a* and the pixel circuit 12*b*. Therefore, in this embodiment, a behavior similar to the second embodiment is performed using a pixel circuit 12*c* in which the switch 17*b* is omitted, as shown in FIG. 8.

Specifically, as shown in FIG. 8, the first gate signal wire 16*a* and a common gate signal wire 16*e* are arranged along the row direction of the organic EL panel 3. The first gate signal wire 16*a* is connected to the pixel circuit 12*a*. The common gate signal wire 16*e* is arranged with respect to the pixel circuit 12*c*. The first gate signal wire 16*a* and the common gate signal wire 16*e* are arranged for every row of display pixels. The common gate signal wire 16*e* is provided with respect to the two pixel circuits 12*a* and 12*c*, and therefore arranged for every two rows of the display pixels.

The source signal wire 18 is arranged along the column direction of the organic EL panel 3. The transistor 20 is arranged at each intersection of the common gate signal wire 16*e* and the source signal wire 18. The source signal wire 18 is connected to the secondary source signal wire 18*s* via the transistor 20. The secondary source signal wire 18*s* is connected to the switch 17*a* of the pixel circuit 12*a* and one end of the storage capacitance 19*a* of the pixel circuit 12*c*. The common gate signal wire 16*e* is connected to the gate of the transistor 20. The transistor 20 switches between conduction and non-conduction between the source signal wire 18 and the secondary source signal wire 18*s* in accordance with the voltage of the common gate signal wire 16*e*. The first gate signal wire 16*a* is connected to the gate of the switch 17*a*. The switch 17*a* switches between conduction and non-conduction between the secondary source signal wire 18*s* and the storage capacitance 19*a* in accordance with the voltage of the first gate signal wire 16*a*.

The pixel circuits 12*a* and 12*c* correspond to one example of display pixels, the common gate signal wire 16*e* corresponds to one example of a scanning wire, the first gate signal wire 16*a* and the common gate signal wire 16*e* correspond to one example of selection control wires, and other configurations are similar to the first embodiment.

With the configuration, in this embodiment, it is possible to isolate the voltages stored in the storage capacitances 19*a* and 19*b* between the pixel circuit 12*a* and the pixel circuit 12*c* through use of the transistor 20 and the switch 17*a*. Therefore, it is possible to reduce the load capacitance of the source signal wire 18 without increasing the number of transistors, in addition to the effect of the second embodiment.

The circuit configuration shown in FIG. 8 is also applicable to those other than the circuit configuration with a two-pixel connection. For example, by forming a pixel circuit in which writing is performed last out of three or more pixel circuits connected to the transistor 20 to be similar to the pixel circuit 12*c*, a switch can be omitted from the pixel circuit.

Figure 9:
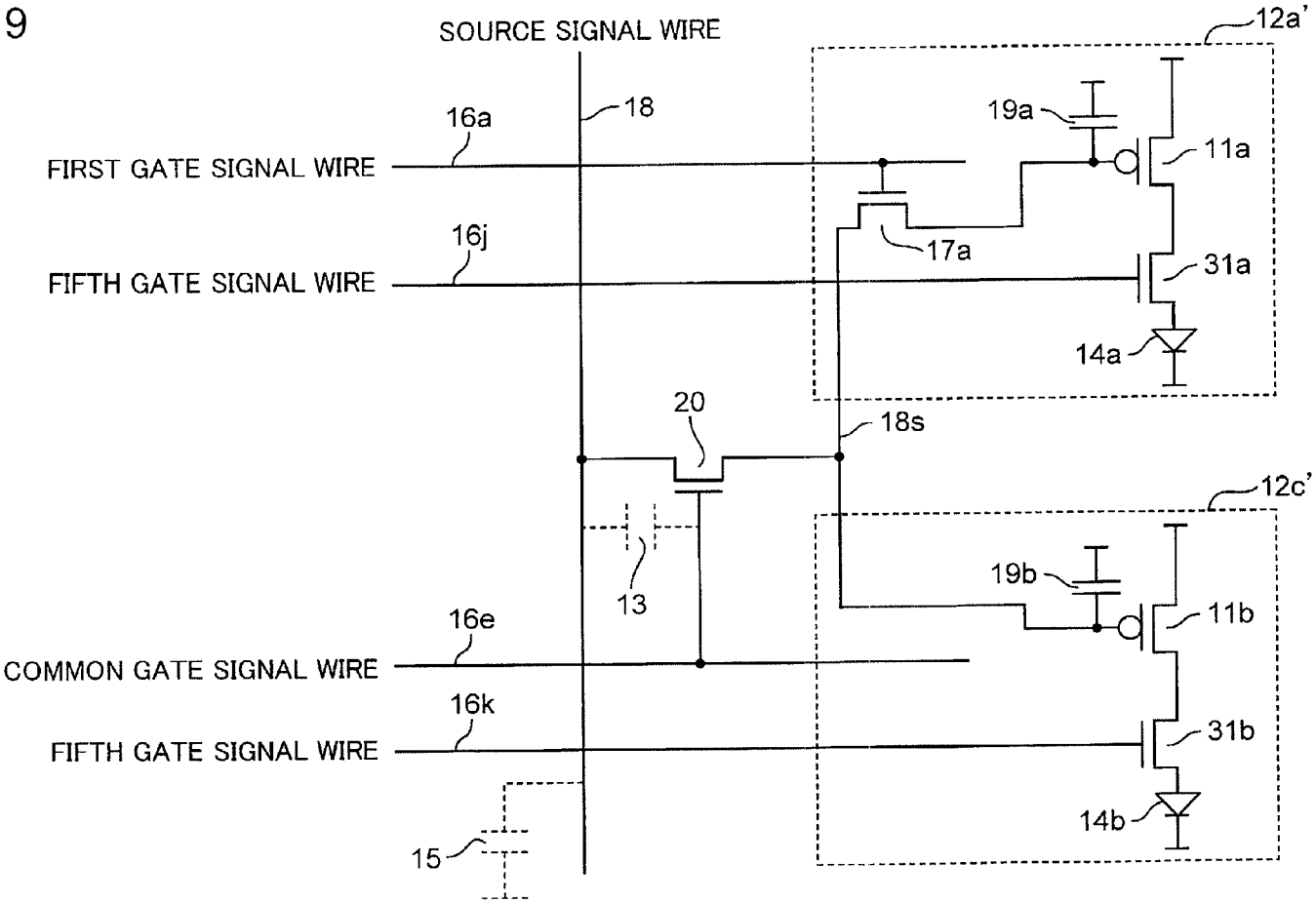
FIG. 9 is a circuit diagram showing the configuration of another pixel circuit applicable to the active matrix display device in the third embodiment of the present invention.

Instead of the circuit configuration shown in FIG. 8, a pixel circuit provided with a switch between drive transistors 11*a* and 11*b* and the organic EL elements 14*a* and 14*b* may be used. FIG. 9 is a circuit diagram showing the configuration of another pixel circuit applicable to the active matrix display device in the third embodiment of the present invention.

Pixel circuits 12*a*' and 12*c*' shown in FIG. 9 differ from the pixel circuits 12*a* and 12*c* shown in FIG. 8 in that switches 31*a* and 31*b* are connected between the drive transistors 11*a* and 11*b* and the organic EL elements 14*a* and 14*b*, and the gates of the switches 31*a* and 31*b* are connected to fifth gate signal wires 16*j* and 16*k*, in a similar manner to sixth to eight embodiments described later. Other points are basically similar to the pixel circuits 12*a* and 12*c* shown in FIG. 8, and therefore detailed description is omitted.

Figure 10:
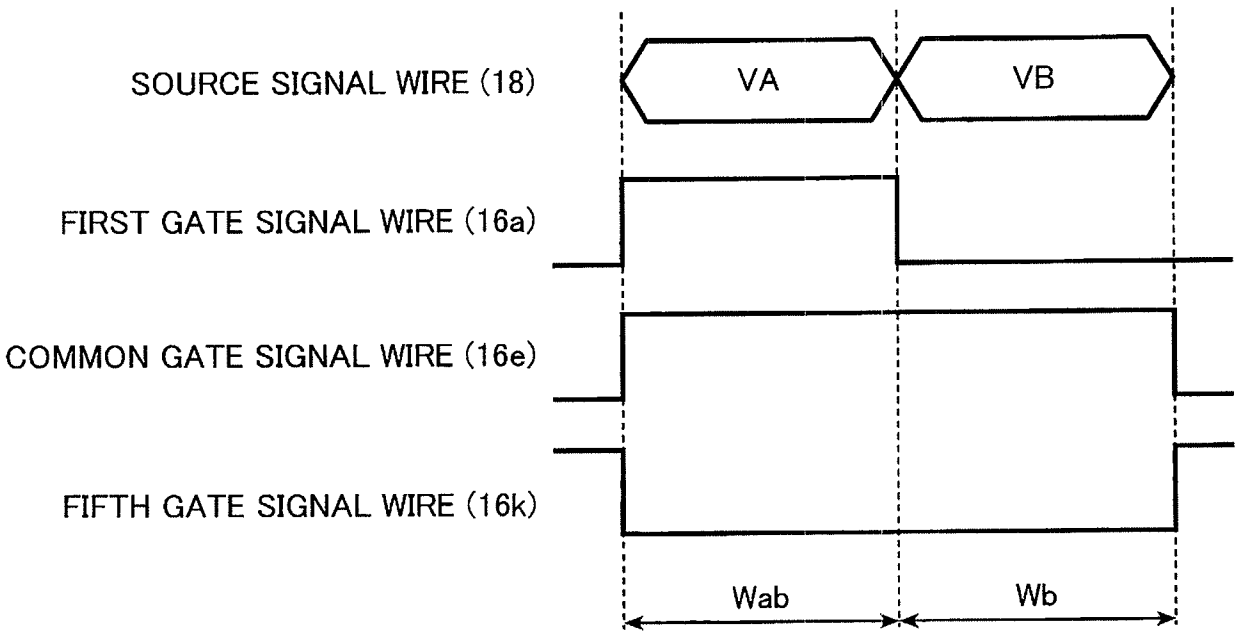
FIG. 10 is a timing diagram showing one example of the voltage waveforms of a source signal wire, a first gate signal wire, a common gate signal wire, and a fifth gate signal wire shown in FIG. 9.

FIG. 10 is a timing diagram showing one example of the voltage waveforms of the source signal wire 18, the first gate signal wire 16*a*, the common gate signal wire 16*e*, and the fifth gate signal wire 16*k* shown in FIG. 9. In this example, the fifth gate signal wire 16*j* is made common with the fifth gate signal wire 16*k*. As shown in FIG. 10, the source signal wire 18, the first gate signal wire 16*a*, and the common gate signal wire 16*e* are driven in waveforms similar to the voltage waveforms of the source signal wire 18, the first gate signal wire 16*a*, and the common gate signal wire 16*d* shown in FIG. 7, and the respective circuits behave in a similar manner.

In the pixel circuit 12*c* shown in FIG. 8, a voltage different from a predetermined voltage in accordance with a picture signal is applied in one horizontal scanning period, and a current different from a predetermined current in accordance with the picture signal flows in the organic EL element 14*b* as a result. The period in which such current flows is limited to only one horizontal scanning period within one frame, and therefore may be negligible at 0.5% or less of the entire period.

However, in order to obtain a more precise luminance in this example, the configuration is such that the gate driver 1 causes the switch 31*b* to be in a non-conducted state through the fifth gate signal wire 16*k* in the first one horizontal scanning period Wab and the subsequent one horizontal scanning period Wb as shown in FIG. 10, so that the switch 31*b* that is newly provided does not cause current to flow in the organic EL element 14*b* during a write period (at least a period of the first one horizontal scanning period Wab). As a result, a pixel can be caused not to emit light with a luminance different from a predetermined luminance in accordance with a picture signal in the entire period of one frame in this embodiment.

Figure 11:
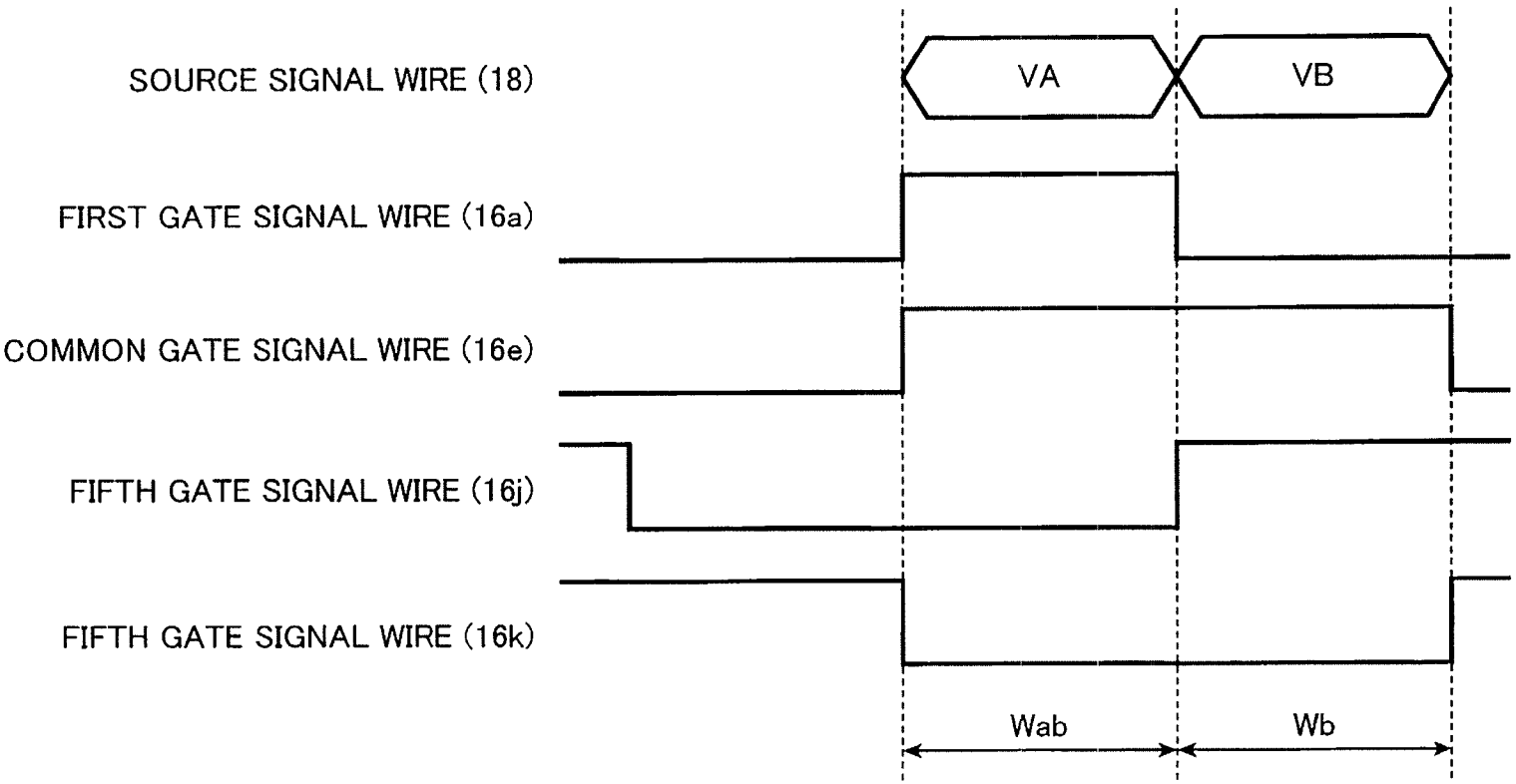
FIG. 11 is a timing diagram showing one example of the voltage waveforms of the source signal wire, the first gate signal wire, the common gate signal wire, and fifth gate signal wires shown in FIG. 9 when the length of a non-light-emitting period is made uniform.

In the case where the length of a non-light-emitting period of each row is made uniform, it is necessary to cause the pixel circuit 12*a*' connected to the first gate signal wire 16*a* to be in a non-light-emitting state for a period equivalent to a write period Wab. FIG. 11 is a timing diagram showing one example of the voltage waveforms of the source signal wire 18, the first gate signal wire 16*a*, the common gate signal wire 16*e*, and the fifth gate signal wires 16*j* and 16*k* shown in FIG. 9 when the length of a non-light-emitting period is made uniform.

As shown in FIG. 11, the gate driver 1 causes the switch 31*a* to be in a non-conducted state through the fifth gate signal wire 16*j* in one horizontal scanning period immediately before the first one horizontal scanning period Wab and the first one horizontal scanning period Wab, and causes the switch 31*b* to be in a non-conducted state through the fifth gate signal wire 16*k* in the first one horizontal scanning period Wab and the subsequent one horizontal scanning period Wb, making the length of non-light-emitting periods uniform. As a result, a pixel can be caused not to emit light with a luminance different from a predetermined luminance in accordance with a picture signal in the entire period of one frame while making the length of a non-light-emitting period uniform in this example.

Figure 12:
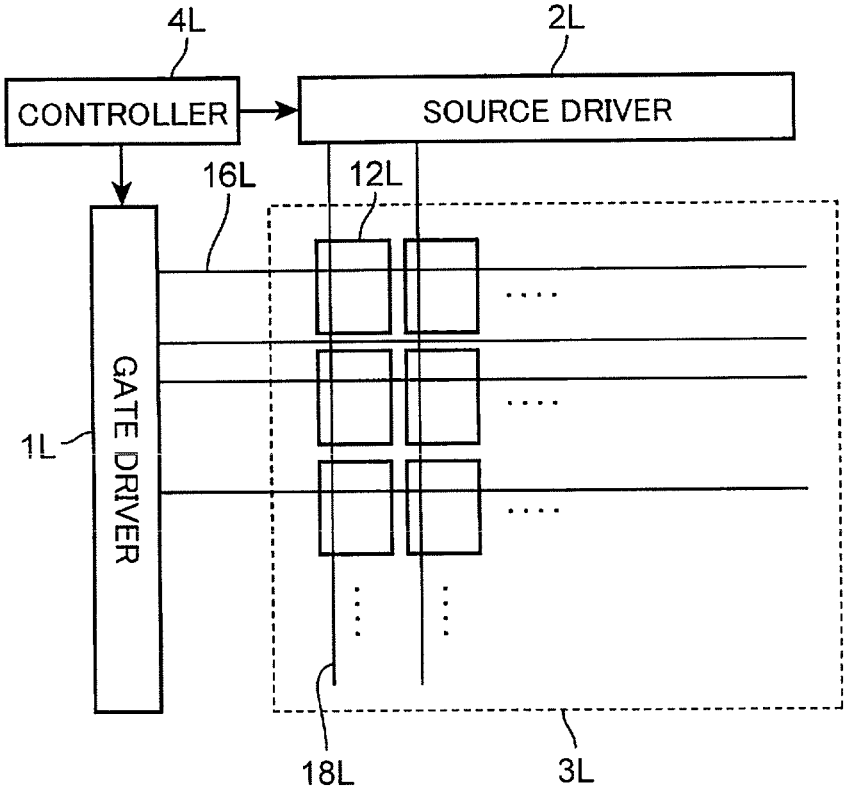
FIG. 12 is a block diagram showing the configuration of a liquid crystal display device in a fourth embodiment of the present invention.

Next, an active matrix display device in a fourth embodiment of the present invention will be described. In the respective embodiments, the active matrix display device using the organic EL element has been described. However, the present invention is not particularly limited to these examples and may be applied in a similar manner to a liquid crystal display device that is an active matrix display device using a liquid crystal element. FIG. 12 is a block diagram showing the configuration of a liquid crystal display device in the fourth embodiment of the present invention. In FIG. 12, a transistor 20L described later is omitted from the drawing in order to simplify the illustration.

The liquid crystal display device shown in FIG. 12 is an active matrix display device and includes a gate driver 1L, a source driver 2L, a liquid crystal panel 3L, a controller 4L, a plurality of gate signal wires 16L, and a plurality of source signal wires 18L. The liquid crystal panel 3L includes a plurality of pixel circuits 12L and a plurality of the transistors 20L. A display pixel is configured from the pixel circuit 12L, and a plurality of the display pixels are arranged in a matrix.

The controller 4L controls the gate driver 1L and the source driver 2L. The gate driver 1L drives the gate signal wire 16L by row of the liquid crystal panel 3L. The source driver 2L drives the source signal wire 18.

Figure 13:
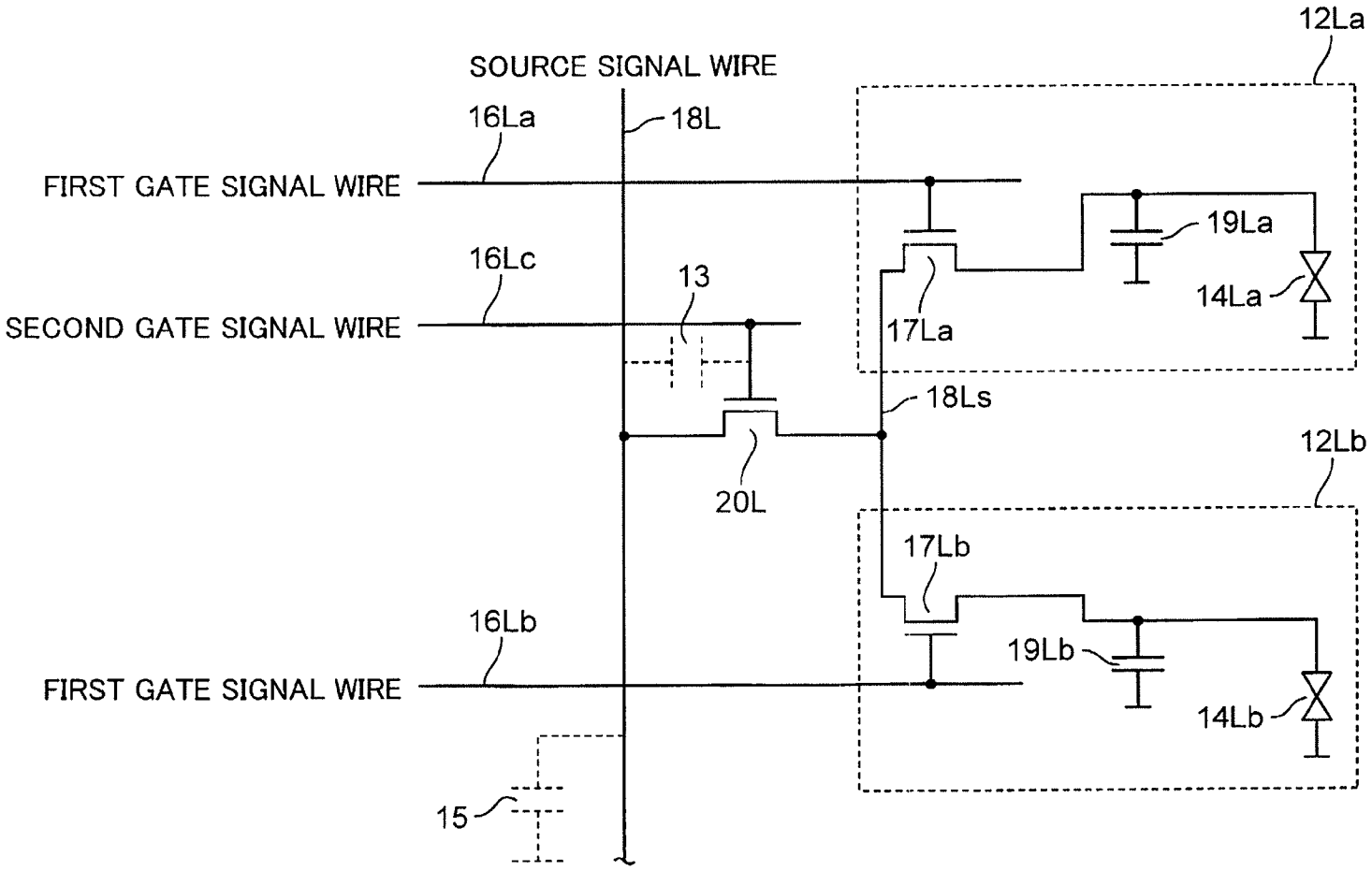
FIG. 13 is a circuit diagram showing the configuration of a pixel circuit of the liquid crystal display device shown in FIG. 12.

FIG. 13 is a circuit diagram showing the configuration of a pixel circuit of the liquid crystal display device shown in FIG. 12. In FIG. 13, in order to simplify the illustration, only two pixel circuits 12La and 12Lb corresponding to display pixels belonging to two consecutive rows in one certain column of the display pixels out of the plurality of pixel circuits 12L arranged in a matrix are shown, only the source signal wire 18L, first gate signal wires 16La and 16Lb, and a second gate signal wire 16Lc provided with respect to the two pixel circuits 12La and 12Lb out of the plurality of source signal wires 18L and the plurality of gate signal wires 16L are shown, and only the transistor 20L provided with respect to the two pixel circuits 12La and 12Lb out of the plurality of transistor 20L is shown.

In the liquid crystal display device of this embodiment, as shown in FIG. 13, one transistor 20L connected to the source signal wire 18L is provided with respect to the two pixel circuits 12La and 12Lb (two pixels) including liquid crystal elements 14La and 14Lb.

Specifically, as shown in FIG. 13, the first gate signal wires 16La and 16Lb and the second gate signal wire 16Lc are arranged along the row direction of the liquid crystal panel 3L. The first gate signal wires 16La and 16Lb are connected to the pixel circuits 12La and 12Lb and arranged for every row of the display pixels. The second gate signal wire 16Lc is provided with respect to the two pixel circuits 12La and 12Lb and arranged for every two rows of the display pixels.

The source signal wire 18L is arranged along the column direction of the liquid crystal panel 3L. The transistor 20L is arranged at each intersection of the second gate signal wire 16Lc and the source signal wire 18L. The source signal wire 18L is connected to a secondary source signal wire 18Ls via the transistor 20L. The secondary source signal wire 18Ls is connected to the pixel circuits 12La and 12Lb and arranged to correspond to the transistor 20L and connecting display pixels belonging to two consecutive rows in each column of the display pixels. The second gate signal wire 16Lc is connected to the gate of the transistor 20L. The transistor 20L switches between conduction and non-conduction between the source signal wire 18L and the secondary source signal wire 18Ls in accordance with the voltage of the second gate signal wire 16Lc.

The pixel circuit 12La includes the liquid crystal element 14La, a switch 17La, and a storage capacitance 19La. The storage capacitance 19La maintains the voltage corresponding to a picture signal, i.e., display data. The first gate signal wire 16La is connected to the gate of the switch 17La (transistor). The switch 17La switches between conduction and non-conduction between the secondary source signal wire 18Ls and the storage capacitance 19La in accordance with the voltage of the first gate signal wire 16La. One end of the storage capacitance 19La is connected with one end of the liquid crystal element 14La. The pixel circuit 12Lb is configured in a similar manner to the pixel circuit 12La. Other pixel circuits (omitted in the drawing) are similar.

The pixel circuits 12La and 12Lb correspond to one example of display pixels, the second gate signal wire 16Lc corresponds to one example of a scanning wire, the first gate signal wires 16La and 16Lb correspond to one example of selection control wires, the source signal wire 18L corresponds to one example of a main data wire, the transistor 20L corresponds to one example of a first switching element, the secondary source signal wire 18Ls corresponds to one example of a secondary data wire, switches 17La and 17Lb correspond to one example of second switching elements, storage capacitances I 9La and 19Lb correspond to one example of capacitance elements, and liquid crystal elements 14La and 14Lb correspond to one example of liquid crystal elements.

The liquid crystal display device in this embodiment is configured as described above. Writing in each pixel is performed using the voltage waveform of the gate signal wire shown in FIG. 3 described above, and a predetermined electric charge is written in storage capacitances 19La and 19Lb. The liquid crystal elements 14La and 14Lb control the transmittance in accordance with the voltage held in the storage capacitances 19La and 19Lb to perform gradation display. In the case where the liquid crystal elements 14La and 14Lb have sufficient capacitance, the storage capacitances 19La and 19Lb may be omitted.

Figure 14:
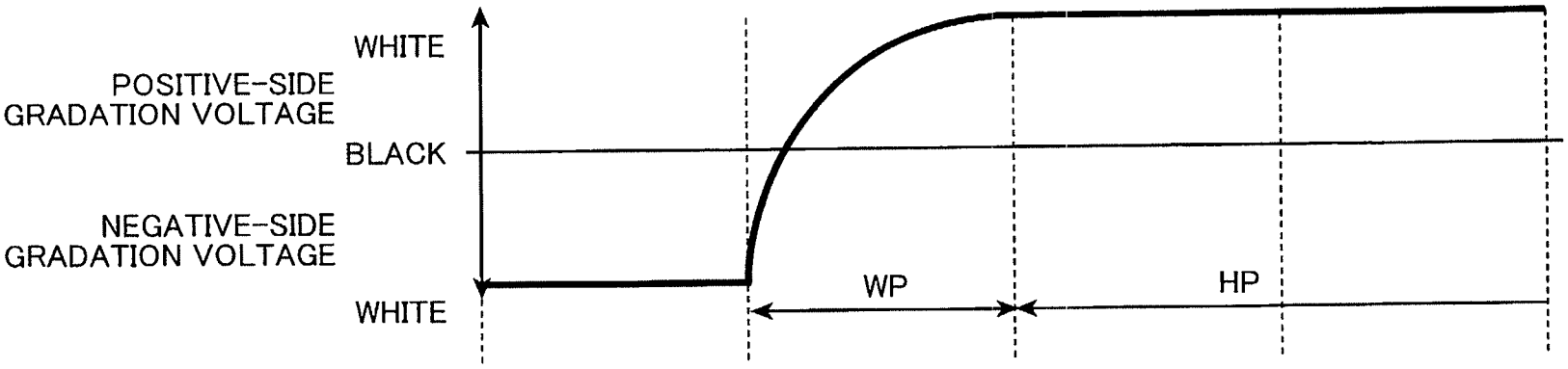
FIG. 14 is a diagram showing the voltage waveform when a white voltage (positive polarity) is applied to a pixel circuit of a conventional liquid crystal display device.

Generally, in order to reduce degradation of a liquid crystal element, a liquid crystal display device performs AC inversion driving, and the polarity of a voltage applied to the liquid crystal element is inverted depending on the time and the position on a panel. FIG. 14 is a diagram showing the voltage waveform when a white voltage (positive polarity) is applied to a pixel circuit of a conventional liquid crystal display device. In a write period WP, as shown in FIG. 14, a voltage that changes from a white voltage (negative polarity) that is display data in a previous frame to the white voltage (positive polarity) is applied to the pixel circuit from a source signal wire, the white voltage (positive polarity) is written in a pixel, and then the white voltage (positive polarity) is held in a hold period HP.

In the case where the polarity of voltage is inverted for every frame in the pixel circuit as described above, the amplitude of the voltage waveform applied to the pixel circuit is twice the voltage amplitude compared to a case where AC inversion driving is not performed, and writing takes time. Thus, in the liquid crystal display device of this embodiment, the voltage of the storage capacitances 19La and 19Lb is set near the center of amplitude of a picture signal before writing is performed. As a result, a voltage change within the same polarity suffices for the voltage amplitude, and the voltage amplitude written in one time becomes smaller than the voltage change from the negative polarity to the positive polarity (or change from the positive polarity to the negative polarity). Therefore, a write period can be shortened.

Figure 15:
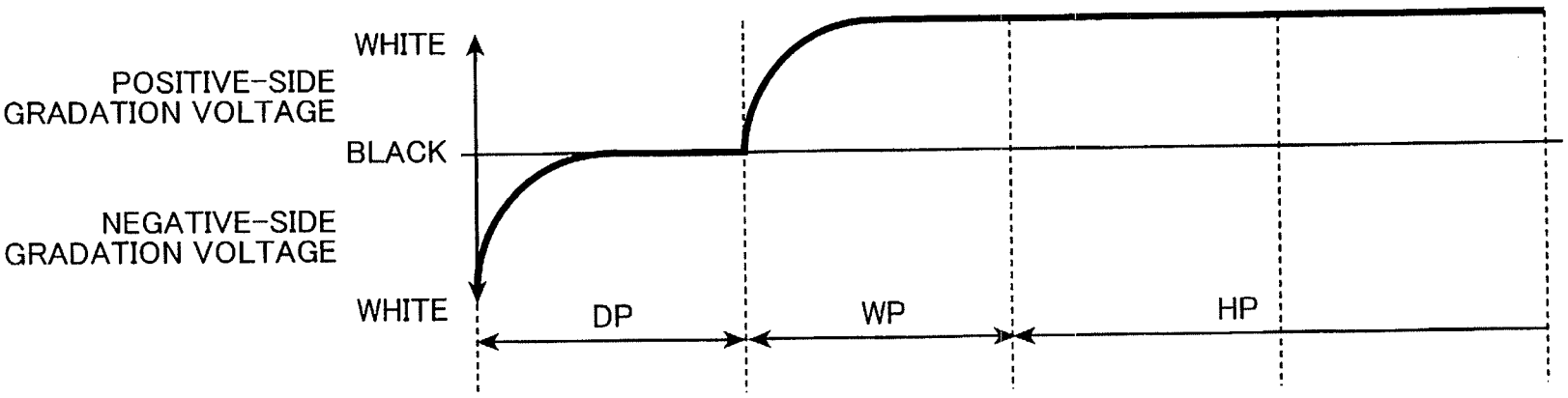
FIG. 15 is a diagram showing one example of the voltage waveform when a white voltage (positive polarity) is applied to the pixel circuit shown in FIG. 13.

FIG. 15 is a diagram showing one example of the voltage waveform when a white voltage (positive polarity) is applied to the pixel circuit shown in FIG. 13. Although a case where a liquid crystal in normally black mode is used is described as an example with this diagram, application is possible in a similar manner with a normally white mode. Although the gradation voltage is described distinctively for the positive side and the negative side with 0 V as a boundary for the sake of convenience, application is possible in a similar manner to a case where a black voltage is offset to one of polarities by a flicker adjustment.

In this embodiment, as shown in FIG. 15, a discharge period DP is first provided and the voltage of the pixel circuits 12La and 12Lb is changed in advance to 0 V in order to quicken the voltage change in the write period WP. Next, when the voltage of the white voltage (positive polarity) is applied in the write period WP, the voltage change in the write period WP becomes about half compared to FIG. 14, and a change to a predetermined voltage is possible in a shorter time.

In the configuration of the pixel circuit shown in FIG. 13 in this embodiment, electric charges stored in the storage capacitances 19La and 19Lb of the two pixel circuits 12La and 12Lb can be short-circuited, even when the source signal wire 18L is performing writing in another pixel circuit (pixel), by causing the switch 17La and the switch 17Lb to be in a conducted state and causing a switch 17Lc to be in a non-conducted state, as long as the numbers of the pixel circuits written on the positive-side polarity and the pixel circuits written on the negative-side polarity are the same. As a result, a behavior similar to the discharge period DP is performed, the voltages of the pixel circuits 12La and 12Lb are averaged, and a change to a voltage close to a black voltage is possible.

When a discharge period is to be provided using the configuration of a conventional pixel circuit, the voltage necessary for discharge needs to be supplied from a source signal wire, and writing in another pixel is influenced. However, in this embodiment, the voltage necessary for discharge does not need to be supplied from the source signal wire 18L. Therefore, a pixel in which another write is performed is not influenced, and it is possible to realize the liquid crystal display device that can perform writing of a picture signal in a corresponding pixel quickly.

The most ideal example is when the averaged voltage of the pixel circuits 12La and 12Lb is a voltage near the center voltage of a picture signal in the discharge period DP, but this example occurs only in the case where a positive-side application voltage and a negative-side application voltage are equivalent. In reality, there are cases where the averaged voltage differs depending on the display pattern.

Figure 16:
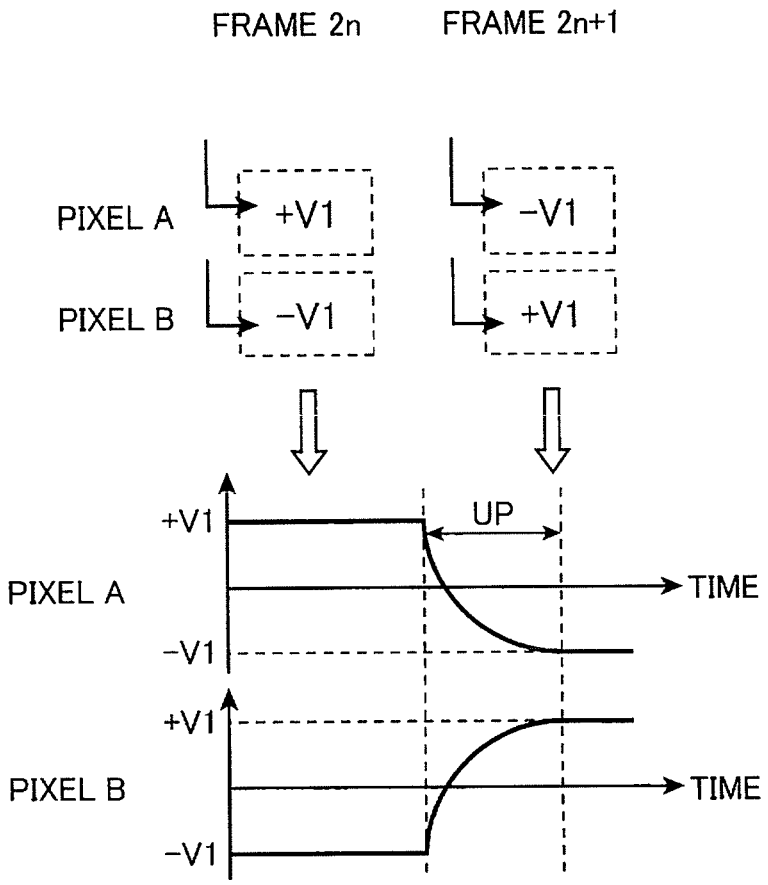
FIG. 16 is a diagram showing the voltage waveforms when a white voltage (negative polarity) and a white voltage (positive polarity) are applied to two pixels of a conventional liquid crystal display device.
Figure 17:
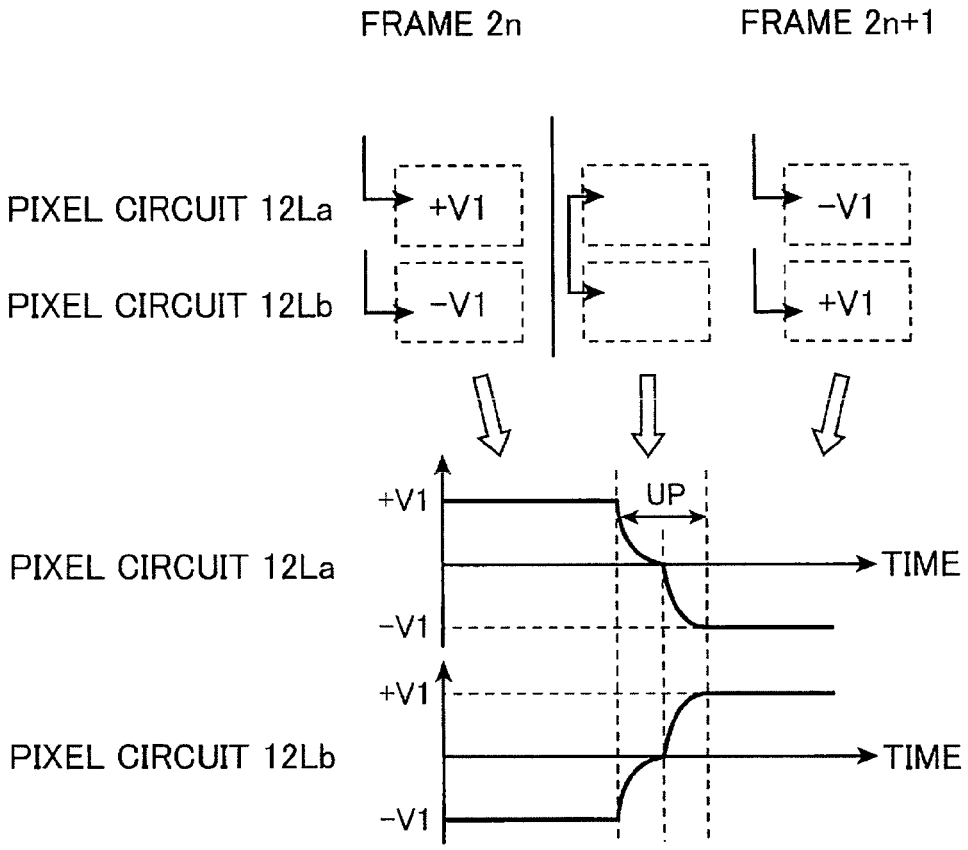
FIG. 17 is a diagram showing one example of the voltage waveforms when a white voltage (negative polarity) and a white voltage (positive polarity) are applied to the pixel circuit shown in FIG. 13.
Figure 18:
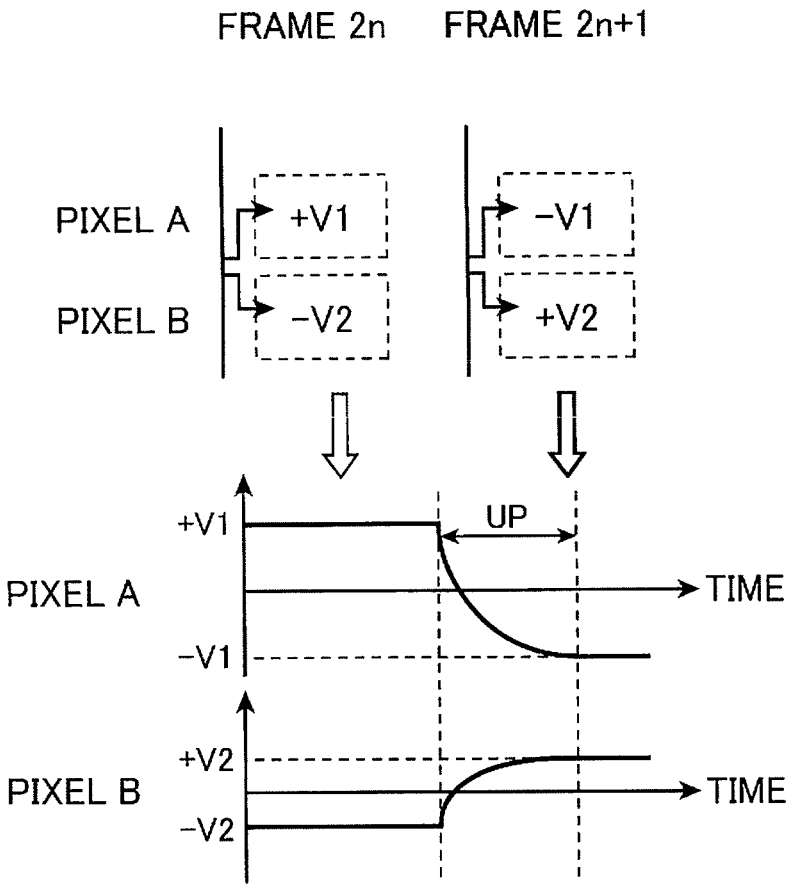
FIG. 18 is a diagram showing the voltage waveforms when a white voltage (negative polarity) and a gray voltage (positive polarity) are applied to two pixels of a conventional liquid crystal display device.
Figure 19:
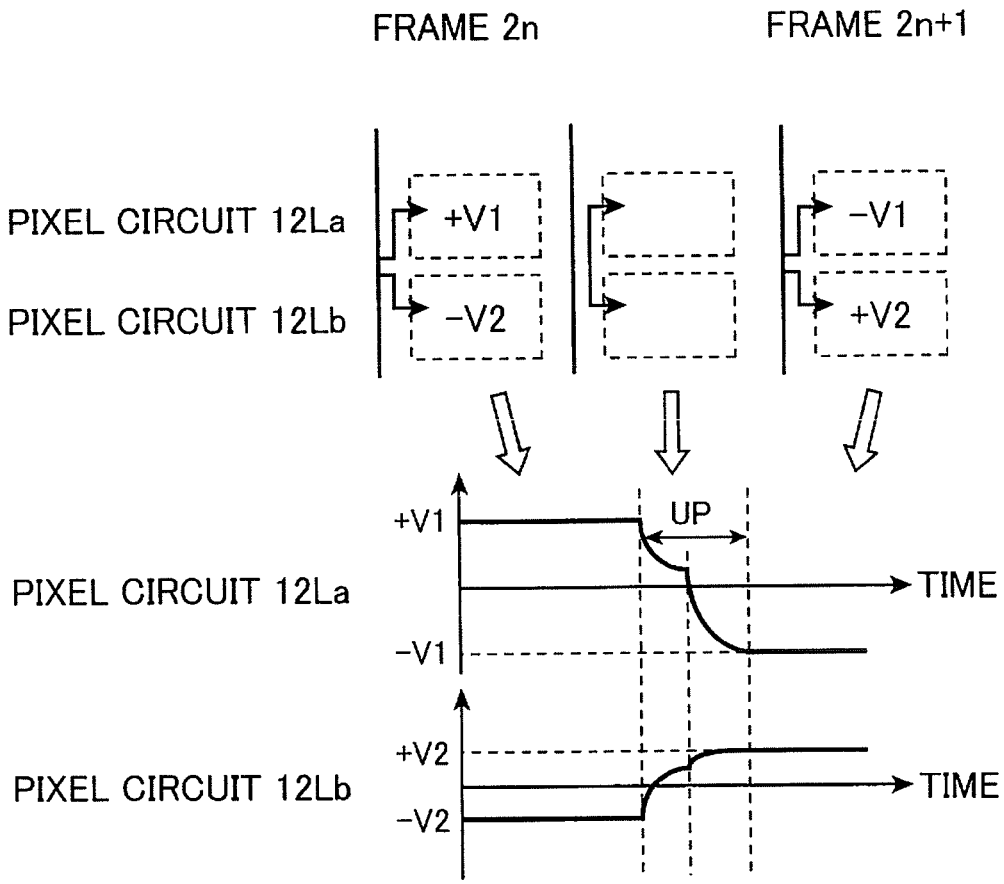
FIG. 19 is a diagram showing one example of the voltage waveforms when a white voltage (negative polarity) and a gray voltage (positive polarity) are applied to the pixel circuit shown in FIG. 13.

FIG. 16 is a diagram showing the voltage waveforms when a white voltage (negative polarity) and a white voltage (positive polarity) are applied to two pixels A and B of a conventional liquid crystal display device. FIG. 17 is a diagram showing one example of the voltage waveforms when a white voltage (negative polarity) and a white voltage (positive polarity) are applied to the pixel circuit shown in FIG. 13. FIG. 18 is a diagram showing the voltage waveforms when a white voltage (negative polarity) and a gray voltage (positive polarity) are applied to the two pixels A and B of a conventional liquid crystal display device. FIG. 19 is a diagram showing one example of the voltage waveforms when a white voltage (negative polarity) and a gray voltage (positive polarity) are applied to the pixel circuit shown in FIG. 13.

When the voltage of the pixel A is a white voltage (positive polarity) +V1 and the voltage of the pixel B is a white voltage (negative polarity) −V1 in frame 2*n* (n is an arbitrary integer), and the white voltage (negative polarity) −V1 is applied to the pixel A and the white voltage (positive polarity) +V1 is applied to the pixel B in frame 2*n*+1 in the conventional liquid crystal display device as shown in FIG. 16, a rising time UP is a long period as shown in the diagram.

When the voltage of the pixel circuit 12La is the white voltage (positive polarity) +V1 and the voltage of the pixel circuit 12Lb is the white voltage (negative polarity) −V1 in frame 2*n* in this embodiment as shown in FIG. 17, and electric charges stored in the storage capacitances 19La and 19Lb of the pixel circuits 12La and 12Lb are short-circuited in horizontal scanning period m (m is an arbitrary integer), the voltages of the pixel circuits 12La and 12Lb are averaged and become a voltage near the center voltage of a picture signal.

Next, when the white voltage (negative polarity) −V1 is applied to the pixel circuit 12La and the white voltage (positive polarity) +V1 is applied to the pixel circuit 12Lb in frame 2*n*+1, the rising time UP is shortened compared to the conventional example shown in FIG. 16, as shown in the diagram. In the case where the averaged voltage of the pixel circuits 12La and 12Lb is a voltage near the center voltage of a picture signal in this manner, a write period can be shortened.

There are cases where the averaged voltage differs depending on the display pattern. For example, when the voltage of the pixel A is the white voltage (positive polarity) +V1 and the voltage of the pixel B is a gray voltage (negative polarity) −V2 (where $|V2|^2=|V1|$) in frame 2*n*, and the white voltage (negative polarity) −V1 is applied to the pixel A and a gray voltage (positive polarity) +V2 is applied to the pixel B in frame 2*n*+1 in the conventional liquid crystal display device as shown in FIG. 18, the rising time UP is a long period in a similar manner to the example shown in FIG. 16.

When the voltage of the pixel circuit 12La is the white voltage (positive polarity) +V1 and the voltage of the pixel circuit 12Lb is the gray voltage (negative polarity) −V2 in frame 2*n* in this embodiment as shown in FIG. 19, and electric charges stored in the storage capacitances 19La and 19Lb of the pixel circuits 12La and 12Lb are short-circuited in horizontal scanning period m, the voltages of the pixel circuits 12La and 12Lb are averaged and become a voltage close to a voltage near the center voltage of a picture signal, although different from the voltage near the center voltage of the picture signal.

Next, when the white voltage (negative polarity) −V1 is applied to the pixel circuit 12La and the gray voltage (positive polarity) +V2 is applied to the pixel circuit 12Lb in frame 2*n*+1, the rising time UP is shortened compared to the conventional example shown in FIG. 18, as shown in the diagram.

Through inversion of the voltage polarity applied to the liquid crystal for every frame and driving such that the voltage polarities of the pixel circuits 12La and 12Lb connected to the transistor 20L differ in this manner in this embodiment, the averaged voltage of the pixel circuits 12La and 12Lb becomes closer to the voltage of a picture signal to be written next compared to a conventional drive scheme, even in the case where the averaged voltage of the pixel circuits 12La and 12Lb differs from a voltage near the center voltage of the picture signal. Therefore, an effect of shortening the write period can be obtained.

Although a case where two pixel circuits differing in polarity are short-circuited have been described as an example with FIG. 17 and FIG. 19. However, it can also be applied to a case where three or more pixel circuits differing in polarity are short-circuited.

Figure 20:
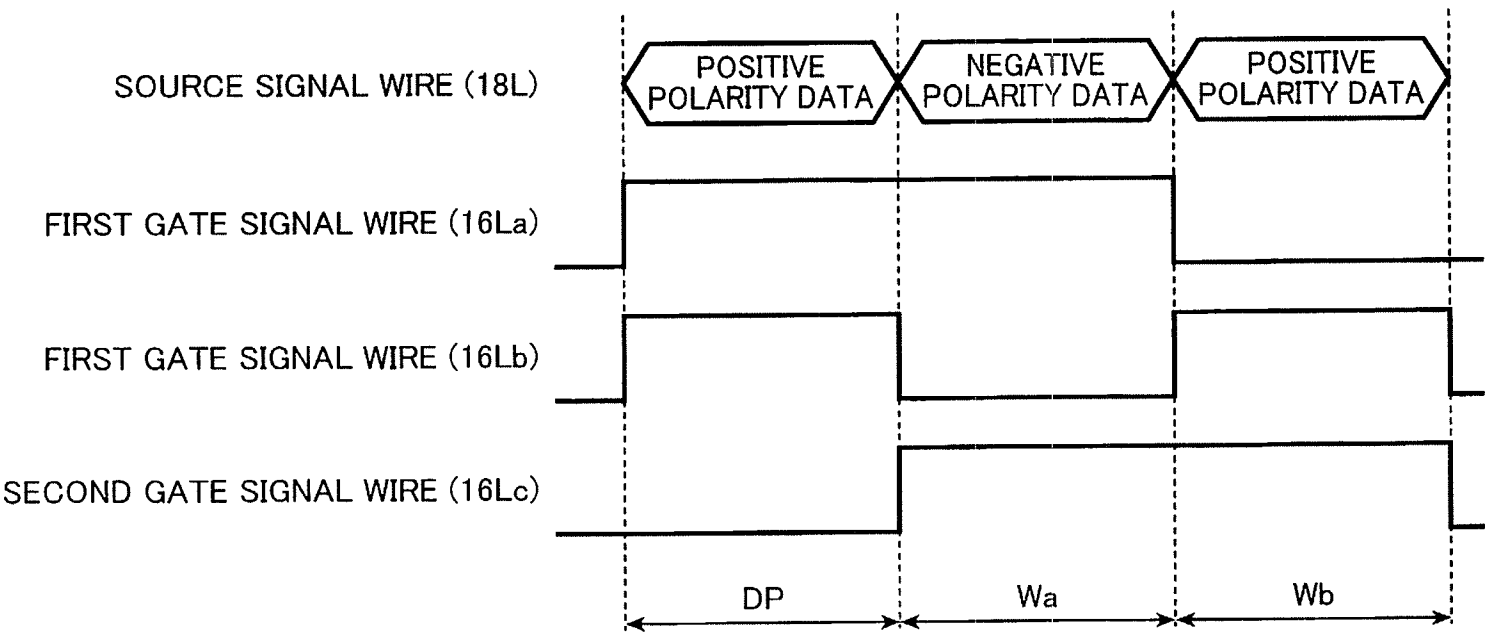
FIG. 20 is a timing diagram showing one example of the voltage waveforms of a source signal wire, first gate signal wires, and a second gate signal wire shown in FIG. 13.

FIG. 20 is a timing diagram showing one example of the voltage waveforms of the source signal wire 18L, the first gate signal wires 16La and 16Lb, and the second gate signal wire 16Lc shown in FIG. 13. This diagram shows drive waveforms of a case where the two pixel circuits 12La and 12Lb are connected to the source signal wire 18L via the transistor 20L, one of the two pixel circuits 12La and 12Lb is a pixel circuit of a positive polarity and the other is a pixel circuit of a negative polarity.

First, in the discharge period DP of the application voltage of the pixel circuits 12La and 12Lb, the gate driver 1L causes the switches 17La and 17Lb to be in a conducted state through the first gate signal wires 16La and 16Lb and causes the transistor 20L to be in a non-conducted state through the second gate signal wire 16Lc, so that redistribution of electric charges of the storage capacitances 19La and 19Lb is performed between the two pixel circuits 12La and 12Lb. As a result, the voltage of the pixel circuits 12La and 12Lb becomes a voltage close to the center voltage of a picture signal, and discharge is completed accordingly.

Next, in a write period Wa of the pixel circuit 12La, the gate driver 1L causes the switch 17La and the transistor 20L to be in a conducted state through the first gate signal wire 16La and the second gate signal wire 16Lc and causes the switch 17Lb to be in a non-conducted state through the first gate signal wire 16Lb, so that negative polarity data is applied to the pixel circuit 12La and a gradation voltage is written in the pixel circuit 12La.

Finally, in a write period Wb of the pixel circuit 12Lb, the gate driver 1L causes the switch 17Lb and the transistor 20L to be in a conducted state through the first gate signal wire 16Lb and the second gate signal wire 16Lc and causes the switch 17La to be in a non-conducted state through the first gate signal wire 16La, so that positive polarity data is applied to the pixel circuit 12Lb and a gradation voltage is written in the pixel circuit 12Lb.

By setting a voltage near the center voltage of a picture signal in advance in the pixel circuits 12La and 12Lb in the discharge period DP in this manner, it is possible to write the picture signal in a shorter time.

By using the configuration of the pixel circuit shown in FIG. 13 in this embodiment as described above, the load capacitance of the source signal wire 18L caused by the transistor 20L can be reduced in a similar manner to the first embodiment. By discharging the voltage in advance inside the pixel circuits 12La and 12Lb, the amplitude of a write voltage can be reduced. As a result, a desired gradation voltage can be written in a short time in the liquid crystal display device with a large screen and high resolution.

In this embodiment, a case where one of the two pixel circuits is a pixel circuit of a positive polarity and the other is a pixel circuit of a negative polarity has been described. However, there may be a plurality of pixel circuits of a positive polarity and pixel circuits of a negative polarity, respectively. For example, a case where two out of four pixel circuits are pixel circuits of a positive polarity and the remaining two are pixel circuits of a negative polarity or a case where four out of eight pixel circuits are pixel circuits of a positive polarity and the remaining four are pixel circuits of a negative polarity is acceptable.

Figure 21:
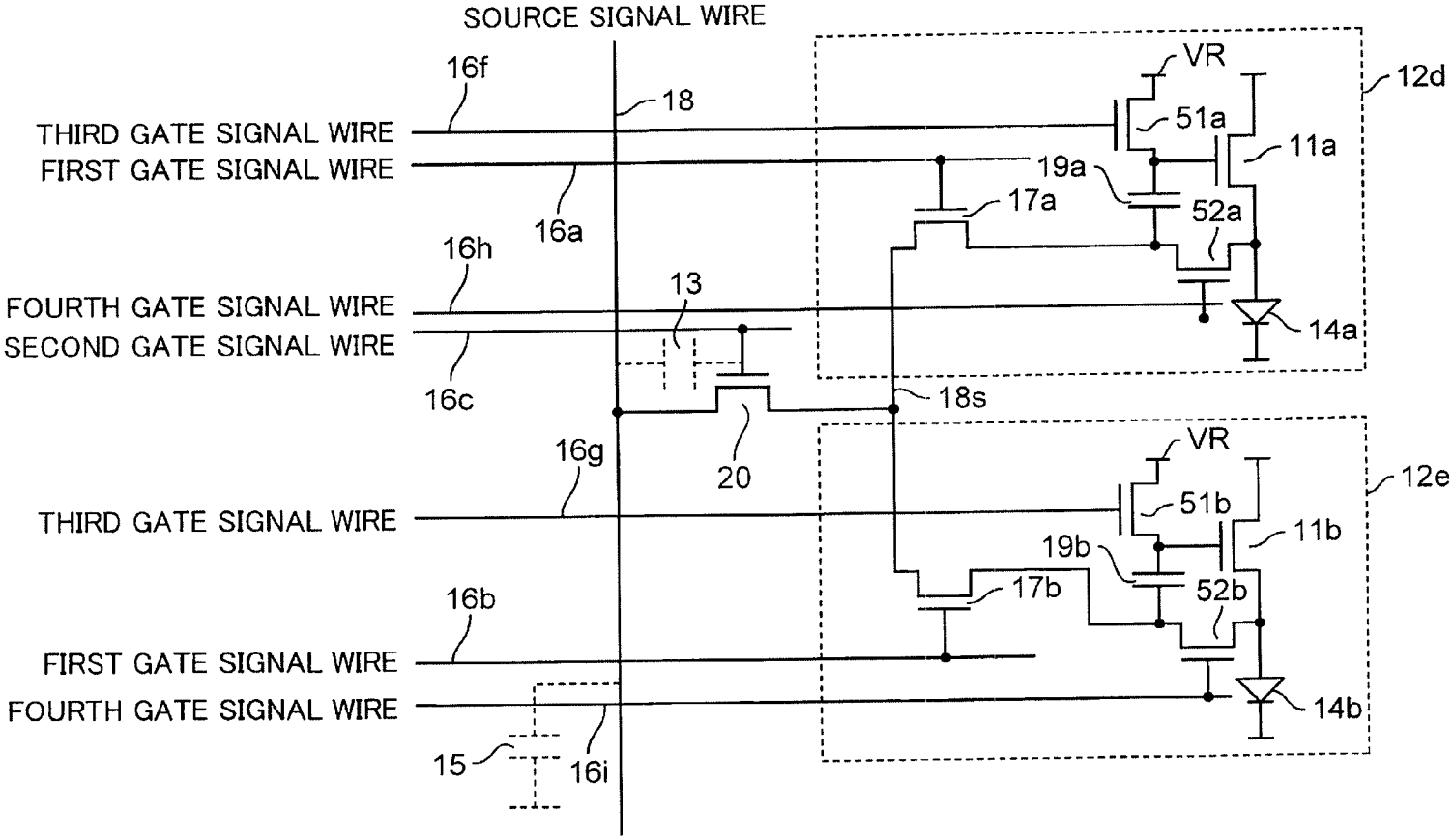
FIG. 21 is a circuit diagram showing the configuration of a pixel circuit of an active matrix display device in a fifth embodiment of the present invention.

Next, an active matrix display device in a fifth embodiment of the present invention will be described. In the respective embodiments, the active matrix display devices using various pixel circuits have been described. However, the present invention is not particularly limited to these examples and may be applied in a similar manner to an active matrix display device using another pixel circuit described below. FIG. 21 is a circuit diagram showing the configuration of a pixel circuit of the active matrix display device in the fifth embodiment of the present invention.

The configuration of the pixel circuit shown in FIG. 21 differs from the configuration of the pixel circuit shown in FIG. 2 in that, in addition to the second gate signal wire 16*c* for capturing a picture signal from the source signal wire 18, third gate signal wires 16*f* and 16*g* for controlling a switch 51*a* for applying a reference voltage VR to the gate of the drive transistors 11*a* and 11*b* and fourth gate signal wires 16*h* and 16*i* for controlling switches 52*a* and 52*b* for controlling a light-emitting period are further provided.

Specifically, as shown in FIG. 21, the first gate signal wires 16*a* and 16*b*, the second gate signal wire 16*c*, the third gate signal wires 16*f* and 16*g*, and the fourth gate signal wires 16*h* and 16*i* are arranged along the row direction of the organic EL panel 3. The first gate signal wires 16*a* and 16*b* are connected to pixel circuits 12*d* and 12*e* and arranged for every row of display pixels. The second gate signal wire 16*c* is provided with respect to the two pixel circuits 12*d* and 12*e* and arranged for every two rows of the display pixels. The third gate signal wires 16*f* and 16*g* and the fourth gate signal wires 16*h* and 16*i* are connected to the pixel circuits 12*d* and 12*e* and arranged for every row of the display pixels.

The source signal wire 18 is arranged along the column direction of the organic EL panel 3. The transistor 20 is arranged at each intersection of the second gate signal wire 16*c* and the source signal wire 18. The source signal wire 18 is connected to the secondary source signal wire 18*s* via the transistor 20. The secondary source signal wire 18*s* is connected to the pixel circuits 12*d* and 12*e* and arranged to correspond to the transistor 20 and connecting display pixels belonging to two consecutive rows in each column of the display pixels. The second gate signal wire 16*c* is connected to the gate of the transistor 20. The transistor 20 switches between conduction and non-conduction between the source signal wire 18 and the secondary source signal wire 18*s* in accordance with the voltage of the second gate signal wire 16*c*.

The pixel circuit 12*d* includes the drive transistor 11*a*, the organic EL element 14*a*, the switches 17*a*, 51*a*, and 52*a*, and the storage capacitance 19*a*. The first gate signal wire 16*a* is connected to the gate of the switch 17*a*. The switch 17*a* switches between conduction and non-conduction between the secondary source signal wire 18*s* and the storage capacitance 19*a* in accordance with the voltage of the first gate signal wire 16*a*. The third gate signal wire 16*f* is connected to the gate of the switch 51*a*. The switch 51*a* switches between conduction and non-conduction between the reference voltage VR and the storage capacitance 19*a* as well as the gate of the drive transistor 11*a* in accordance with the voltage of the third gate signal wire 16*f* to apply the reference voltage VR to the gate of the drive transistor 11*a*. The fourth gate signal wire 16*h* is connected to the gate of the switch 52*a*. The switch 52*a* switches between conduction and non-conduction between the storage capacitance 19*a* and the organic EL element 14*a* in accordance with the voltage of the fourth gate signal wire 16*h* to control a light-emitting period. The pixel circuit 12*e* is configured in a similar manner to the pixel circuit 12*d*. Other pixel circuits (omitted in the drawing) are similar.

Figure 22:
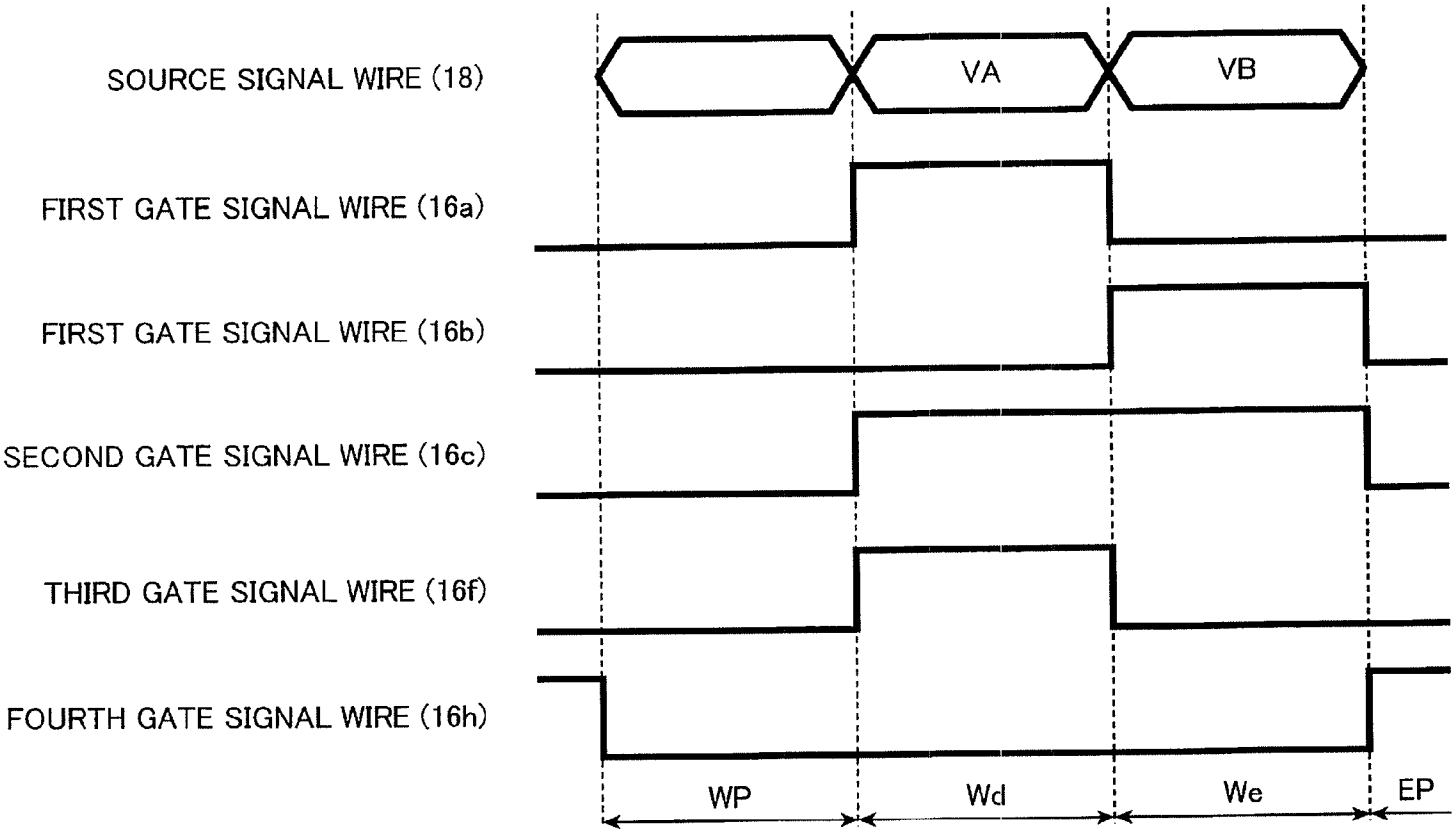
FIG. 22 is a timing diagram showing one example of the voltage waveforms of a source signal wire, first gate signal wires, a second gate signal wire, a third gate signal wire, and a fourth gate signal wire shown in FIG. 21.

FIG. 22 is a timing diagram showing one example of the voltage waveforms of the source signal wire 18, the first gate signal wires 16*a* and 16*b*, the second gate signal wire 16*c*, the third gate signal wire 16*f*, and the fourth gate signal wire 16*h* shown in FIG. 21.

First, in a write preparation period WP of the pixel circuit 12*d*, as shown in FIG. 22, the gate driver 1 causes the switch 52*a* to be in a non-conducted state through the fourth gate signal wire 16*h* in order to perform write preparation. The write preparation period WP is a period that is provided in order to prevent a voltage from the source signal wire 18 from being applied directly to the organic EL element 14*a* at the time of writing of the picture signal VA performed next, and is a period for causing the switch 17*a* and the switch 52*a* not to be in a conducted state simultaneously, as far as the pixel circuit 12*d* is concerned.

Next, in a write period Wd of the pixel circuit 12*d*, the gate driver 1 writes the picture signal VA in the pixel circuit 12*d*. At this time, the gate driver 1 causes the switch 51*a* to be in a conducted state through the third gate signal wire 16*f* to apply the reference voltage VR to the gate of the drive transistor 11*a*, and causes the switch 17*a* and the transistor 20 as a switch that are connected the first gate signal wire 16*a* and the second gate signal wire 16*c* to be in a conducted state to apply a difference voltage between the reference voltage VR and the voltage of the picture signal VA to the storage capacitance 19*a*.

Next, in a similar manner to the above, the gate driver 1 writes a difference voltage between the reference voltage VR and the voltage of the picture signal VB in the pixel circuit 12*e* in a write period We of the pixel circuit 12*e*.

Finally, in a light-emitting period EP, the gate driver 1 causes the switch 52*a* to be in a conducted state through the fourth gate signal wire 16*h* and causes the switch 17*a* and the switch 51*a* to be in a non-conducted state through the first gate signal wire 16*a* and the third gate signal wire 16*f*, so that a current in accordance with the voltage of the storage capacitance 19*a* determined in the write period Wd flows in the drive transistor 11*a* and the organic EL element 14*a* emits light. The pixel circuit 12*e* is similar to the pixel circuit 12*d*.

With the behavior, the voltage of a picture signal is written in the storage capacitance 19*a* of the pixel circuit 12*d* via the transistor 20 and the switch 17*a* from the source signal wire 18. Since the number of transistors 20 connected to the source signal wire 18 can be reduced in this embodiment as a result, the channel capacitances 13 as a parasitic capacitance of the source signal wire 18 can be reduced, and write voltage errors due to insufficient charge at the time of writing can be reduced. Therefore, the display quality can be improved.

Figure 23:
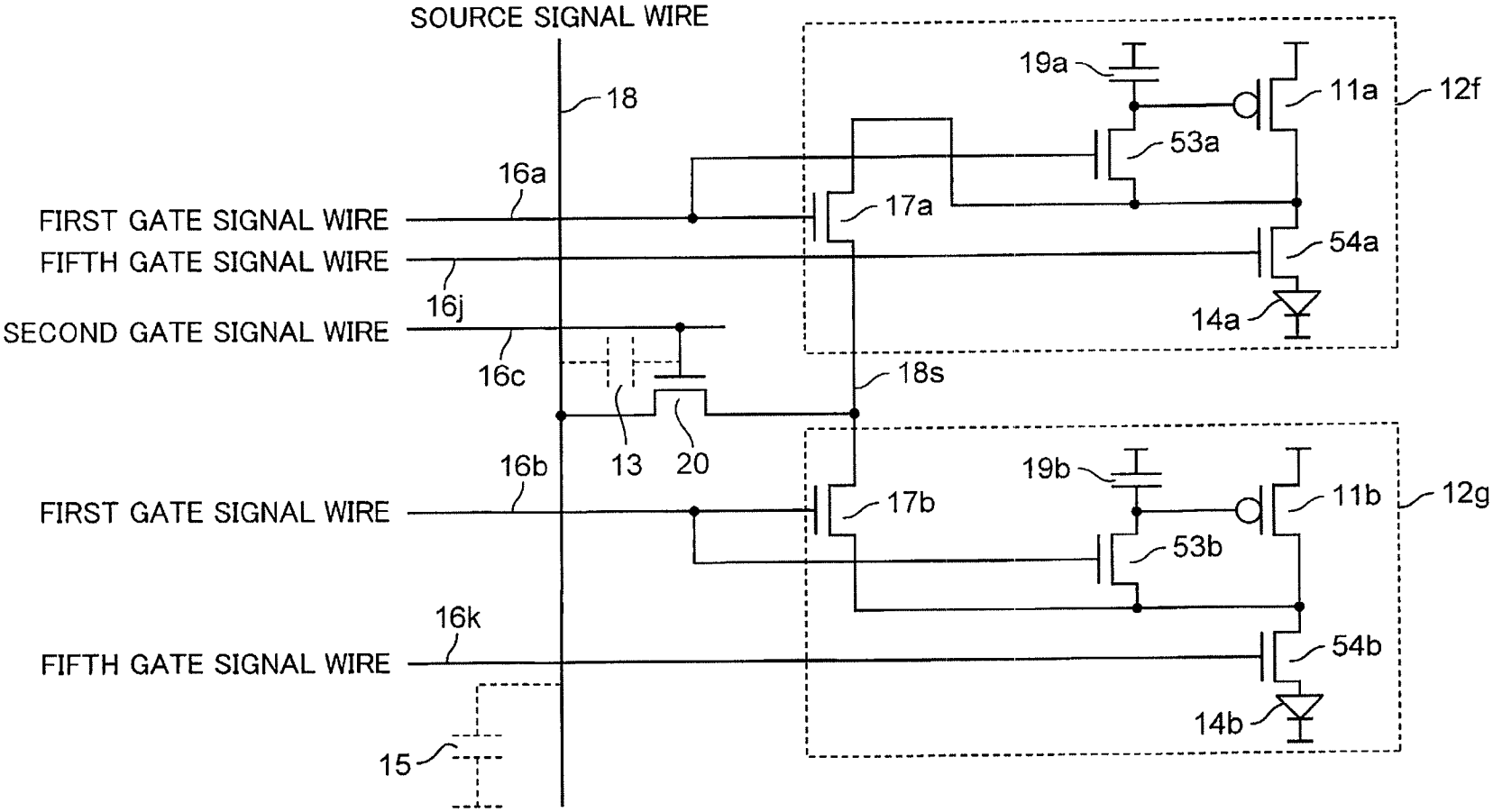
FIG. 23 is a circuit diagram showing the configuration of a pixel circuit of an active matrix display device in a sixth embodiment of the present invention.

Next, an active matrix display device in a sixth embodiment of the present invention will be described. In the respective embodiments, an example in which a pixel circuit is driven with a voltage drive scheme has been described. However, the present invention is not particularly limited to this example and may be applied in a similar manner to an active matrix display device described below in which a pixel circuit is driven with a current drive scheme. FIG. 23 is a circuit diagram showing the configuration of a pixel circuit of the active matrix display device in the sixth embodiment of the present invention.

Pixel circuits 12*f* and 12*g* shown in FIG. 23 are driven with a drive scheme called the current drive scheme. In the case of the current drive scheme, a current in accordance with the gradation flows in the source signal wire 18, and a voltage in accordance with this gradation current and the current-voltage characteristic of the drive transistors 11*a* and 11*b* is written in the storage capacitances 19*a* and 19*b*. At the time of lighting, the drive transistors 11*a* and 11*b* cause drain current to flow in the organic EL elements 14*a* and 14*b* in accordance with the voltage of the storage capacitances 19*a* and 19*b*, so that a pixel emits light with desired gradation.

Specifically, as shown in FIG. 23, the first gate signal wires 16*a* and 16*b*, the second gate signal wire 16*c*, and the fifth gate signal wires 16*j* and 16*k* (the gate signal wire 16 shown in FIG. 1) are arranged along the row direction of the organic EL panel 3. The first gate signal wires 16*a* and 16*b* are connected to the pixel circuits 12*f* and 12*g* and arranged for every row of display pixels. The second gate signal wire 16*c* is provided with respect to the two pixel circuits 12*f* and 12*g* and arranged for every two rows of the display pixels. The fifth gate signal wires 16*j* and 16*k* are connected to the pixel circuits 12*f* and 12*g* and arranged for every row of the display pixels.

The source signal wire 18 is arranged along the column direction of the organic EL panel 3. The transistor 20 is arranged at each intersection of the second gate signal wire 16*c* and the source signal wire 18. The source signal wire 18 is connected to the secondary source signal wire 18*s* via the transistor 20. The secondary source signal wire 18*s* is connected to the pixel circuits 12*f* and 12*g* and arranged to correspond to the transistor 20 and connecting display pixels belonging to two consecutive rows in each column of the display pixels. The second gate signal wire 16*c* is connected to the gate of the transistor 20. The transistor 20 switches between conduction and non-conduction between the source signal wire 18 and the secondary source signal wire 18*s* in accordance with the voltage of the second gate signal wire 16*c*.

The pixel circuit 12*f* includes the drive transistor 11*a*, the organic EL element 14*a*, switches 17*a*, 53*a*, and 54*a*, and the storage capacitance 19*a*. The first gate signal wire 16*a* is connected to the gate of the switch 17*a*. The switch 17*a* switches between conduction and non-conduction between the secondary source signal wire 18*s* and the storage capacitance 19*a* in accordance with the voltage of the first gate signal wire 16*a*. The first gate signal wire 16*a* is connected to the gate of the switch 53*a*. The switch 53*a* switches between conduction and non-conduction between the storage capacitance 19*a* and a connection point for the drive transistor 11*a* and the organic EL element 14*a* in accordance with the voltage of the first gate signal wire 16*a*. The fifth gate signal wire 16*j* is connected to the gate of the switch 54*a*. The switch 54*a* switches between conduction and non-conduction between the organic EL element 14*a* and the drive transistor 11*a* in accordance with the voltage of the fifth gate signal wire 16*j*. The pixel circuit 12*g* is configured in a similar manner and behaves in a similar manner to the pixel circuit 12*f*. Other pixel circuits (omitted in the drawing) are similar.

The current drive scheme has a characteristic that the display unevenness is small compared to the voltage drive scheme, since variation in the threshold and mobility characteristic of the drive transistor is compensated. However, in low gradation, the current supplied from the source signal wire is small, and a long time is required for charging and discharging of the load capacitance of the source signal wire. As a result, there are cases where a predetermined current cannot be written in a pixel circuit within one horizontal scanning period.

However, in this embodiment, the number of the channel capacitances 13 per one source signal wire 18 can be reduced, and therefore the load capacitance of the source signal wire 18 can be reduced. Even in the case of low gradation, a desired current can be written at high speed in the pixel circuits 12*f* and 12*g* within one horizontal scanning period.

Since the current drive scheme is used, this embodiment is not influenced by the wiring resistance from the source driver 2 to the pixel circuits 12*f* and 12*g*. Therefore, even if the transistor 20 is connected in series between the source driver 2 and the pixel circuits 12*f* and 12*g*, high-speed writing is possible without losing a writing improvement effect due to the reduction in the channel capacitances 13.

Implementation is possible in a similar manner with a pixel circuit of the current drive scheme such as a pixel circuit using a current mirror circuit other than the current copier pixel circuit in FIG. 23.

Figure 24:
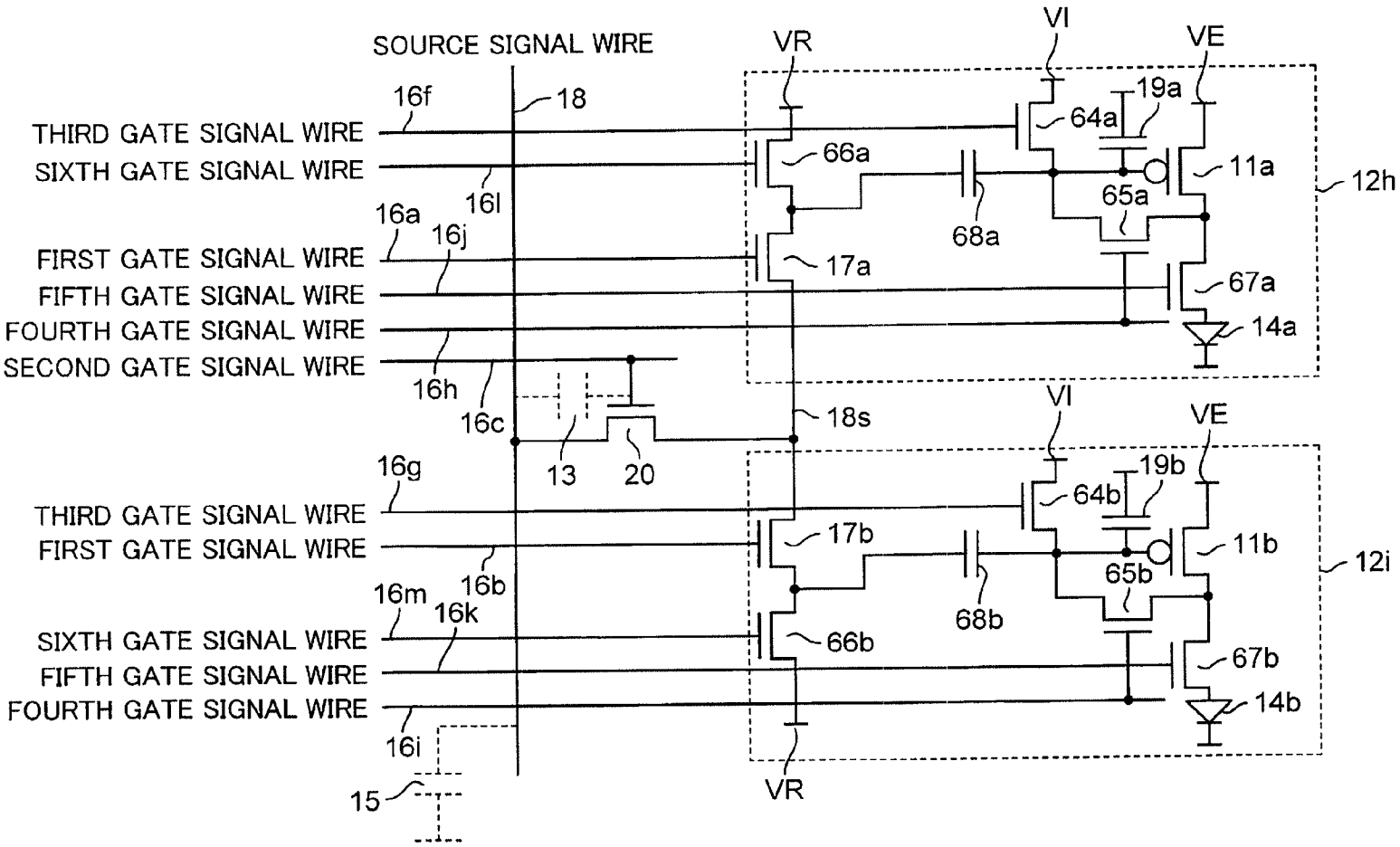
FIG. 24 is a circuit diagram showing the configuration of a pixel circuit of an active matrix display device in a seventh embodiment of the present invention.

Next, an active matrix display device in a seventh embodiment of the present invention will be described. FIG. 24 is a circuit diagram showing the configuration of a pixel circuit of the active matrix display device in the seventh embodiment of the present invention. The active matrix display device of this embodiment includes pixel circuits 12*h* and 12*i* having a function of correcting a threshold variation of the drive transistors 11*a* and 11*b*.

Specifically, as shown in FIG. 24, the first gate signal wires 16*a* and 16*b*, the second gate signal wire 16*c*, the third gate signal wires 16*f* and 16*g*, the fourth gate signal wires 16*h* and 16*i*, the fifth gate signal wires 16*j* and 16*k*, and sixth gate signal wires 16*l* and 16*m* are arranged along the row direction of the organic EL panel 3. The first gate signal wires 16*a* and 16*b* are connected to the pixel circuits 12*h* and 12*i* and arranged for every row of display pixels. The second gate signal wire 16*c* is provided with respect to the two pixel circuits 12*h* and 12*i* and arranged for every two rows of the display pixels. The third gate signal wires 16*f* and 16*g*, the fourth gate signal wires 16*h* and 16*i*, the fifth gate signal wires 16*j* and 16*k*, and the sixth gate signal wires 16*l* and 16*m* are connected to the pixel circuits 12*h* and 12*i* and arranged for every row of the display pixels.

The source signal wire 18 is arranged along the column direction of the organic EL panel 3. The transistor 20 is arranged at each intersection of the second gate signal wire 16*c* and the source signal wire 18. The source signal wire 18 is connected to the secondary source signal wire 18*s* via the transistor 20. The secondary source signal wire 18*s* is connected to the pixel circuits 12*h* and 12*i* and arranged to correspond to the transistor 20 and connecting display pixels belonging to two consecutive rows in each column of the display pixels. The second gate signal wire 16*c* is connected to the gate of the transistor 20. The transistor 20 switches between conduction and non-conduction between the source signal wire 18 and the secondary source signal wire 18*s* in accordance with the voltage of the second gate signal wire 16*c*.

The pixel circuit 12*h* includes the drive transistor 11*a*, the organic EL element 14*a*, switches 17*a* and 64*a* to 67*a*, a capacitance 68*a*, and the storage capacitance 19*a*. The first gate signal wire 16*a* is connected to the gate of the switch 17*a*. The switch 17*a* switches between conduction and non-conduction between the secondary source signal wire 18*s* and the storage capacitance 19*a* via the capacitance 68*a* in accordance with the voltage of the first gate signal wire 16*a*.

The third gate signal wire 16*f* is connected to the gate of the switch 64*a*. The switch 64*a* switches between conduction and non-conduction between an initialization voltage VI and a connection point for the capacitance 68*a*, the storage capacitance 19*a*, and the gate of the drive transistor 11*a* in accordance with the voltage of the third gate signal wire 16*f* to apply the initialization voltage VI to the gate of the drive transistor 11*a*.

The fourth gate signal wire 16*h* is connected to the gate of the switch 65*a*. The switch 65*a* switches between conduction and non-conduction between the connection point for the capacitance 68*a*, the storage capacitance 19*a*, and the gate of drive transistor 11*a* and a connection point for the drive transistor 11*a* and the organic EL element 14*a* in accordance with the voltage of the fourth gate signal wire 16*h*.

The fifth gate signal wire 16*j* is connected to the gate of the switch 67*a*. The switch 67*a* switches between conduction and non-conduction between the drive transistor 11*a* and the organic EL element 14*a* in accordance with the voltage of the fifth gate signal wire 16*j* to control a light-emitting period. The sixth gate signal wire 16*l* is connected to the gate of the switch 66*a*. The switch 66*a* switches between conduction and non-conduction between the reference voltage VR and the capacitance 68*a* in accordance with the voltage of the sixth gate signal wire 16*l* to apply the reference voltage VR to the capacitance 68*a*. The pixel circuit 12*i* is configured in a similar manner to the pixel circuit 12*h*. Other pixel circuits (omitted in the drawing) are similar.

The pixel circuits 12*h* and 12*i* correspond to one example of display pixels and pixel circuits, the drive transistors 11*a* and 11*b* correspond to one example of drive transistors, and other configurations are similar to the first embodiment.

Figure 25:
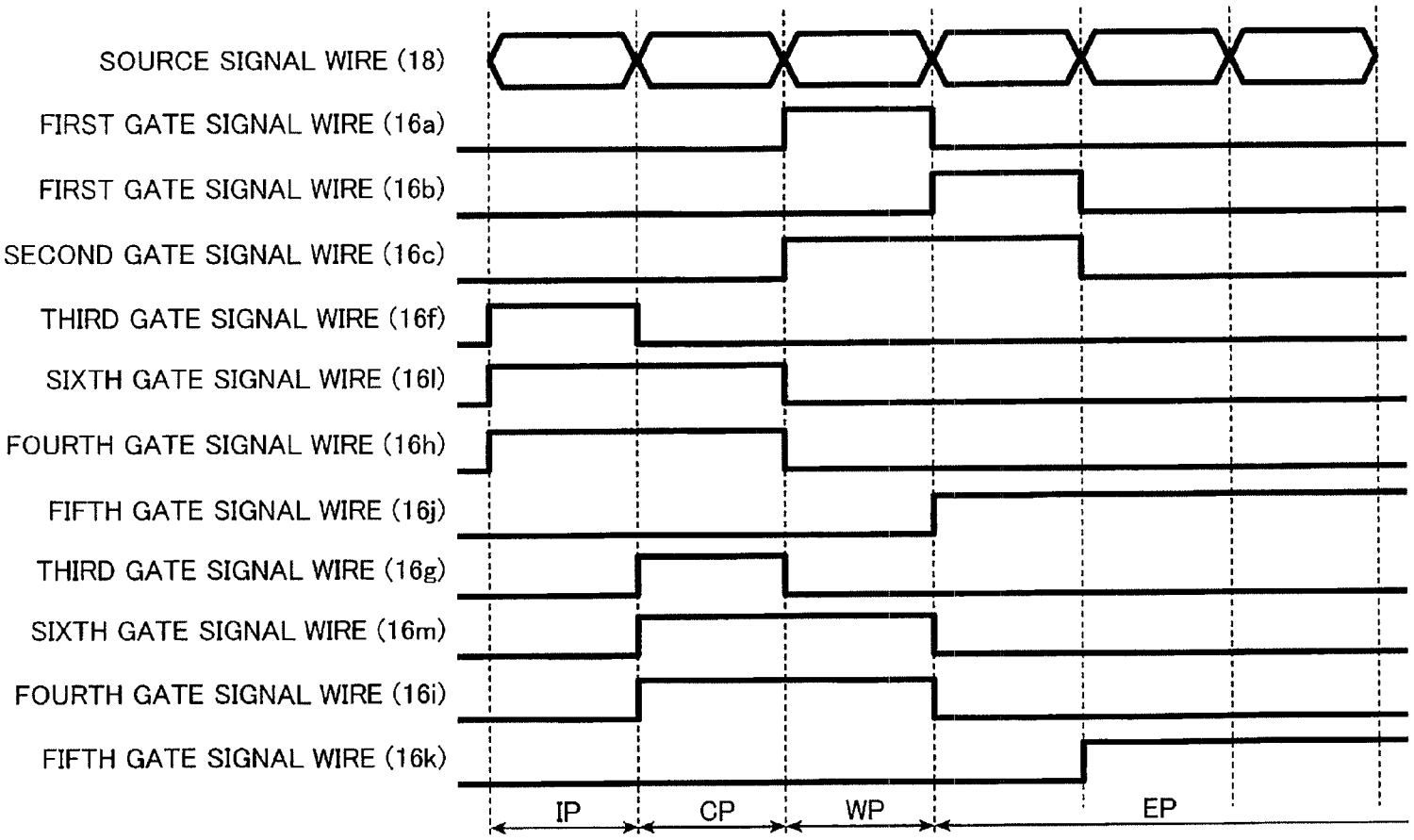
FIG. 25 is a timing diagram showing one example of the voltage waveforms of a source signal wire, first gate signal wires, a second gate signal wire, third gate signal wires, and fourth gate signal wires, fifth gate signal wires, and sixth gate signal wires shown in FIG. 24.

FIG. 25 is a timing diagram showing one example of the voltage waveforms of the source signal wire 18, the first gate signal wires 16*a* and 16*b*, the second gate signal wire 16*c*, the third gate signal wires 16*f* and 16*g*, the fourth gate signal wires 16*h* and 16*i*, the fifth gate signal wires 16*j* and 16*k*, and the sixth gate signal wires 16*l* and 16*m* shown in FIG. 24.

First, in an initialization period IP, as shown in FIG. 25, the gate driver 1 causes the switch 64*a* to be in a conducted state through the third gate signal wire 16*f* to apply the initialization voltage VI to the drive transistor 11*a*, in order to generate a large voltage between the gate and source of the drive transistor 11*a* . The gate driver 1 causes the switch 67*a* to be in a non-conducted state through the fifth gate signal wire 16*j*, so that current does not flow in the organic EL element 14*a*.

The state of the switch 65*a* is arbitrary, but is preferably in a conducted state in the initialization period IP, in order to cause the state of the switch 65*a* to be a conducted state reliably in a next threshold correction period CP. Since the voltage from the source signal wire 18 is not supplied at this time, the gate driver 1 causes the switch 66*a* to be in a conducted state through the sixth gate signal wire 16*l* to apply the reference voltage VR to the capacitance 68*a* , in order to stabilize the potential of the capacitance 68*a*.

Next, in the threshold correction period CP, a threshold correction behavior of the drive transistor 11*a* is performed. Specifically, when the gate driver 1 causes the switch 64*a* to be in a non-conducted state through the third gate signal wire 16*f* in the threshold correction period CP, the gate voltage of the drive transistor 11*a*changes. In the initial state, drain current flows in the drive transistor 11*a*. However, since the switch 64*a* and the switch 67*a*are in a non-conducted state and a current path is absent, the drive transistor 11*a* increases the gate voltage to bring the drain current to 0. Thus, the gate voltage changes such that the gate-source voltage of a drive transistor 11*a* becomes to a threshold voltage. As a result, a voltage in accordance with the threshold voltage of the drive transistor 11*a*is stored in the storage capacitance 19*a*.

Next, in the write period WP, a voltage in accordance with the gradation is stored in the pixel circuit 12*h*, and a picture signal is written in the pixel circuit 12*h*. Specifically, when the gate driver 1 causes the switches 64*a* , 65*a* , 66*a* , and 67*a* to be in a non-conducted state through the third gate signal wire 16*f*, the fourth gate signal wire 16*h*, the sixth gate signal wire 16*l*, and the fifth gate signal wire 16*j* and causes the transistor 20 as a switch and the switch 17*a* to be in a conducted state through the second gate signal wire 16*c* and the first gate signal wire 16*a* in the write period WP, the voltage of the picture signal supplied from the source signal wire 18 is applied to one end of the capacitance 68*a*.

The gate voltage of the drive transistor 11*a* changes by the amount of the voltage of the picture signal minus the reference voltage in parenthesis multiplied by the capacitance value of the capacitance 68*a* over, open parenthesis, the capacitance value of the capacitance 68*a* plus the capacitance value of the storage capacitance 19*a*, close parenthesis. In the storage capacitance 19*a*, a voltage in accordance with the threshold voltage of the drive transistor 11*a* and a voltage in accordance with the voltage of the picture signal are added and recorded.

Next, in the light-emitting period EP after termination of the write period WP, the gate driver 1 causes the switch 67*a*to be in a conducted state through operation of the fifth gate signal wire 16*j*, so that a current in accordance with the voltage of a storage capacitance 19*a*is supplied from the drive transistor 11*a*to the organic EL element 14*a*and a pixel emits light.

Although the behavior of the pixel circuit 12*h* has been described as an example in the description, the pixel circuit 12*i* basically behaves in a similar manner to the above. Note that, since the voltage of a picture signal supplied to the source signal wire 18 is delayed by one horizontal scanning period compared to the pixel circuit 12*h*, it is only necessary to cause the behavior of the pixel circuit 12*i* with a delay of one horizontal scanning period in the voltage waveforms of the third gate signal wire 16*g*, the sixth gate signal wire 16*m*, the fourth gate signal wire 16*i*, and the fifth gate signal wire 16*k* with respect to the voltage waveforms of the third gate signal wire 16*f*, the sixth gate signal wire 16*l*, the fourth gate signal wire 16*h*, and the fifth gate signal wire 16*j* at the time of driving the pixel circuit 12*a*, as shown in FIG. 25.

In this embodiment, as described above, the number of the transistors 20 is halved, and the channel capacitances 13 caused by the transistor 20 is halved. Therefore, writing of a picture signal can be performed with increased speed and accuracy while performing the threshold correction behavior. The configuration of a pixel circuit that performs the threshold correction behavior is not particularly limited to the example. Application may be in a similar manner for various other pixel circuits that perform the threshold correction behavior. The behavior of a plurality of pixel circuits sharing the transistor 20 may be made common in a similar manner to the above to reduce in the number of gate signal wires.

Figure 26:
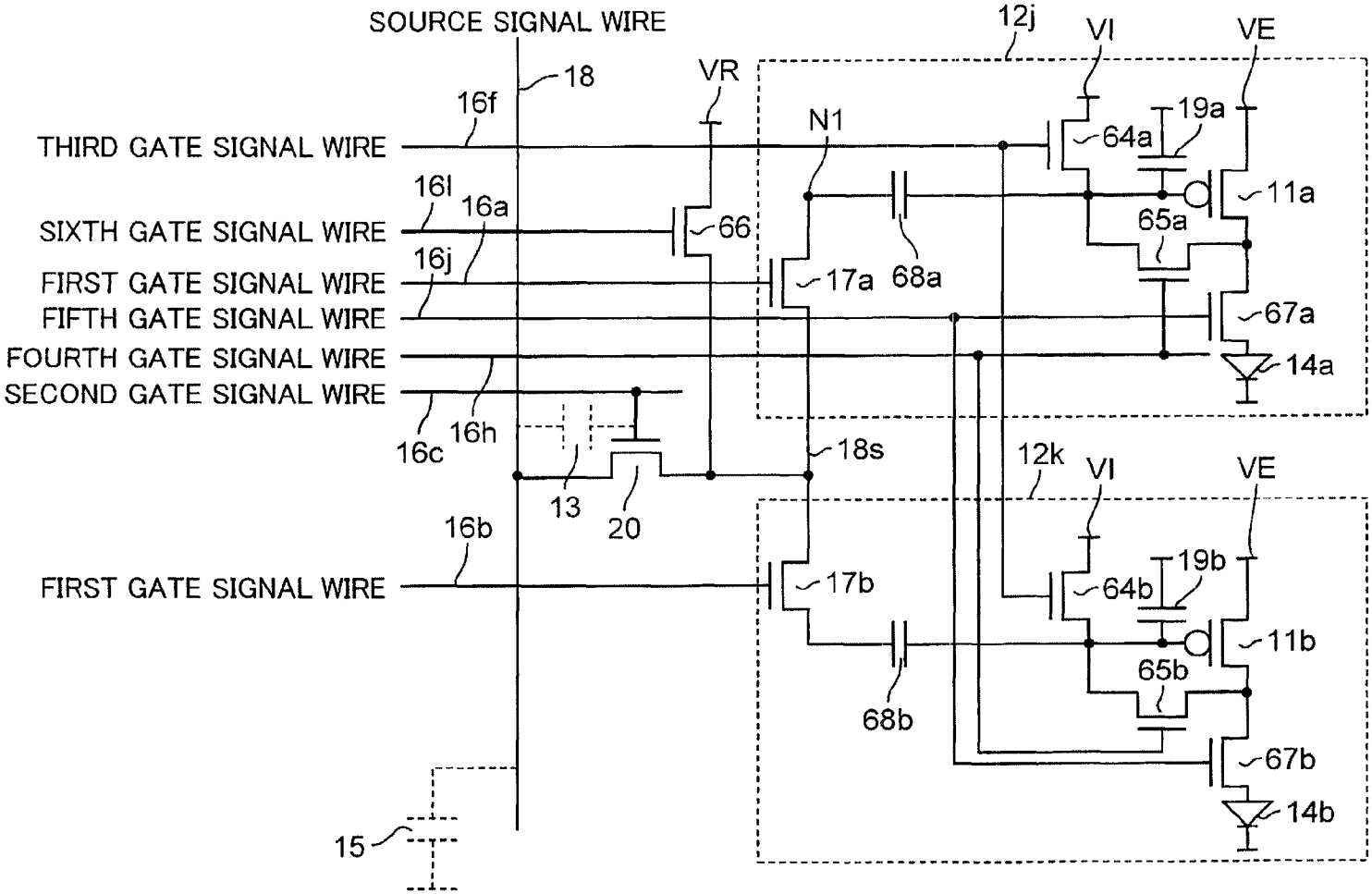
FIG. 26 is a circuit diagram showing the configuration of a pixel circuit of an active matrix display device in an eighth embodiment of the present invention.

Next, an active matrix display device in an eighth embodiment of the present invention will be described. FIG. 26 is a circuit diagram showing the configuration of a pixel circuit of the active matrix display device in the eighth embodiment of the present invention.

In the seventh embodiment, the pixel circuits 12*h* and 12*i* commonly use the switch 17*a*. Further, in this embodiment, periods other than a write period of a picture signal are made the same periods for pixel circuits 12*j* and 12*k*, so that a circuit for applying the reference voltage VR to the pixel circuits 12*j* and 12*k* is made common. As a result, as shown in FIG. 26, the plurality of pixel circuits 12*j* and 12*k* share a switch 66 and the reference voltage VR and share the third gate signal wire 16*f*, the fourth gate signal wire 16*h*, the fifth gate signal wire 16*j*, and the sixth gate signal wire 16*l*. Accordingly, the number of switches and gate signal wires is reduced.

Specifically, as shown in FIG. 26, the first gate signal wires 16*a* and 16*b*, the second gate signal wire 16*c*, the third gate signal wire 16*f*, the fourth gate signal wire 16*h*, the fifth gate signal wire 16*j*, and the sixth gate signal wire 16*l* are arranged along the row direction of the organic EL panel 3. The first gate signal wires 16*a* and 16*b* are connected to pixel circuits 12*j* and 12*k* and arranged for every row of display pixels. The second gate signal wire 16*c*, the third gate signal wire 16*f*, the fourth gate signal wire 16*h*, the fifth gate signal wire 16*j*, and the sixth gate signal wire 16*l* are provided with respect to the two pixel circuits 12*j* and 12*k* and arranged for every two rows of the display pixels.

The source signal wire 18 is arranged along the column direction of the organic EL panel 3. The transistor 20 is arranged at each intersection of the second gate signal wire 16*c* and the source signal wire 18. The source signal wire 18 is connected to the secondary source signal wire 18*s* via the transistor 20. The secondary source signal wire 18*s* is connected to the pixel circuits 12*j* and 12*k* and arranged to correspond to the transistor 20 and connecting display pixels belonging to two consecutive rows in each column of the display pixels. The second gate signal wire 16*c* is connected to the gate of the transistor 20. The transistor 20 switches between conduction and non-conduction between the source signal wire 18 and the secondary source signal wire 18*s* in accordance with the voltage of the second gate signal wire 16*c*.

The pixel circuit 12*j* includes the drive transistor 11*a*, the organic EL element 14*a*, the switches 17*a*, 64*a*, 65*a*, and 67*a*, the capacitance 68*a*, and the storage capacitance 19*a*. The first gate signal wire 16*a* is connected to the gate of the switch 17*a*. The switch 17*a* switches between conduction and non-conduction between the secondary source signal wire 18*s* and the storage capacitance 19*a* via the capacitance 68*a* in accordance with the voltage of the first gate signal wire 16*a*. The third gate signal wire 16*f* is connected to the gate of switches 64*a* and 64*b*. The switches 64*a* and 64*b* switch between conduction and non-conduction between the initialization voltage VI and a connection point for capacitances 68*a* and 68*b*, the storage capacitances 19*a* and 19*b*, and the gate of the drive transistors 11*a* and 11*b* in accordance with the voltage of the third gate signal wire 16*f* to apply the initialization voltage VI to the gate of the drive transistors 11*a* and 11*b*.

The fourth gate signal wire 16*h* is connected to the gate of switches 65*a* and 65*b*. The switches 65*a* and 65*b* switch between conduction and non-conduction between the capacitances 68*a* and 68*b* and a connection point for the storage capacitances 19*a* and 19*b* and the organic EL elements 14*a* and 14*b* in accordance with the voltage of the fourth gate signal wire 16*h*. The fifth gate signal wire 16*j* is connected to the gate of switches 67*a* and 67*b*. The switches 67*a* and 67*b* switch between conduction and non-conduction between the drive transistors 11*a* and 11*b* and the organic EL elements 14*a* and 14*b* in accordance with the voltage of the fifth gate signal wire 16*j* to control a light-emitting period. The pixel circuit 12*k* is configured in a similar manner to the pixel circuit 12*j*. Other pixel circuits (omitted in the drawing) are similar.

The switch 66 is connected between the transistor 20 and the secondary source signal wire 18*s*, and an application point for the reference voltage VR is provided between the transistor 20 and the switches 17*a* and 17*b*. The configuration is such that, by applying the reference voltage VR to the secondary source signal wire 18*s*, the switch 66 can apply the reference voltage VR to either one of the pixel circuit 12*j* and the pixel circuit 12*k*.

The pixel circuits 12*j* and 12*k* correspond to one example of display pixels and pixel circuits, the drive transistors 11*a* and 11*b* correspond to one example of drive transistors, the switch 66 corresponds to one example of a third switching element, and other configurations are similar to the first embodiment.

In this embodiment, as described above, the switches provided for every pixel circuit can be made one with respect to a plurality of pixel circuits (one switch with respect to two pixel circuits in FIG. 26) to reduce the number of switches. Therefore, the necessary area for a pixel circuit layout is reduced, and this configuration can be applied easily to a display device with high resolution. Since the number of gate signal wires is reduced, the number of gate signal wires that crosses the source signal wire is reduced, the cross capacitance is reduced, and the time constant of the source signal wire can be made shorter.

Figure 27:
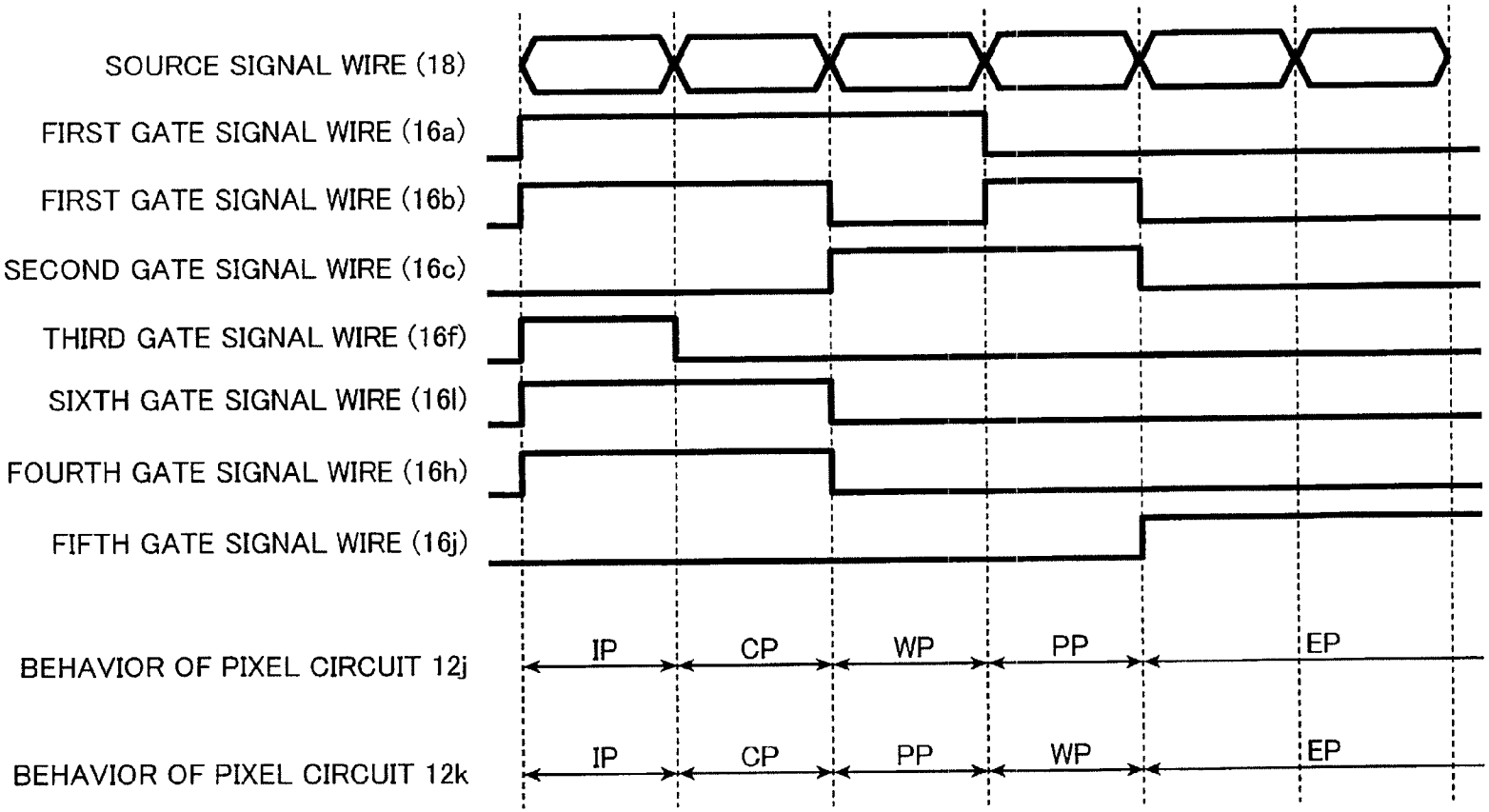
FIG. 27 is a timing diagram showing one example of the voltage waveforms of a source signal wire, first gate signal wires, a second gate signal wire, a third gate signal wire, and a fourth gate signal wire, a fifth gate signal wire, and a sixth gate signal wire shown in FIG. 26.

FIG. 27 is a timing diagram showing one example of the voltage waveforms of the source signal wire 18, the first gate signal wires 16*a* and 16*b*, the second gate signal wire 16*c*, the third gate signal wire 16*f*, the fourth gate signal wire 16*h*, the fifth gate signal wire 16*j*, and the sixth gate signal wire 16*l* shown in FIG. 26.

First, in the initialization period IP, as shown in FIG. 27, the gate driver 1 causes the switches 64*a* and 64*b* to be in a conducted state through the third gate signal wire 16*f* to apply the initialization voltage VI to the gate of the drive transistors 11*a* and 11*b* and to perform supply of the gate-source voltage of the drive transistors 11*a* and 11*b* that is initially necessary in the next threshold correction period CP. The initialization voltage VI is a voltage lower than an EL power supply VE. The potential difference between the two is set such that the drive transistors 11*a* and 11*b* can supply a sufficiently large drain current with the gate-source voltage. The gate driver 1 causes the switches 65*a* and 65*b* to be in a conducted state through the fourth gate signal wire 16*h* to set the drain voltage of the drive transistors 11*a* and 11*b* to the initialization voltage VI in advance before a threshold correction behavior.

The gate driver 1 causes the switches 67*a* and 67*b* to be in a non-conducted state through the fifth gate signal wire 16*j*, so that drain current flowing in the drive transistors 11*a* and 11*b* during the initialization period IP is not supplied to the organic EL elements 14*a* and 14*b* and a current different from a current used in a gradation display behavior does not flow in the organic EL elements 14*a* and 14*b*.

Since an electrode not connected to the drive transistors 11*a* and 11*b* out of electrodes of the capacitances 68*a* and 68*b* is in a floating state, the gate driver 1 causes the switches 17*a* and 17*b* and the switch 66 to be in a conducted state through the first gate signal wires 16*a* and 16*b* and the sixth gate signal wire 16*l* to apply the reference voltage VR to the capacitances 68*a* and 68*b* via the switches 17*a* and 17*b* and the switch 66 and stabilize the potential of the capacitances 68*a* and 68*b*.

Next, in the threshold correction period CP, the gate driver 1 causes the switches 64*a* and 64*b* to be in a non-conducted state through the third gate signal wire 16*f*, such that the application of the initialization voltage VI is stopped. At this time, the gate voltage of the drive transistors 11*a* and 11*b* increases, and the voltage changes for the storage capacitances 19*a* and 19*b* in accordance with the threshold voltage of the drive transistors 11*a* and 11*b* of the respective pixel circuits 12*a* and 12*b*.

Next, in the write period WP, a voltage in accordance with a picture signal from the source signal wire 18 is written. Unlike in previous behaviors, writing of the picture signal is performed pixel by pixel with respect to the plurality of pixel circuits 12*j* and 12*k* that commonly use the transistor 20. Therefore, it is necessary to provide a pause period PP with respect to the pixel circuit that does not perform writing to stop the behavior.

Specifically, the gate driver 1 causes all of the switches 64*a*, 64*b*, 65*a*, 65*b*, 67*a*, 67*b*, and 66 connected to the third gate signal wire 16*f*, the fourth gate signal wire 16*h*, the fifth gate signal wire 16*j*, and the sixth gate signal wire 16*l* to be in a non-conducted state, and causes the transistor 20 to be in a conducted state through the second gate signal wire 16*c* in order to capture the voltage from the source signal wire 18.

With respect to the pixel circuit 12*k* to be in the pause period PP, the gate driver 1 causes the switch 17*b* to be in a non-conducted state through the first gate signal wire 16*b*. The voltage state of the pixel circuit in the pause period PP can be held without changing the voltage of the capacitance 68*b* and the storage capacitance 19*b*.

With respect to the pixel circuit 12*j* to be in the write period WP, the gate driver 1 causes the switch 17*a* to be in conducted state through the first gate signal wire 16*a* to apply a voltage in accordance with the picture signal to the pixel circuit 12*j* in the write period WP. Specifically, when the pixel circuit 12*j* is in the write period WP, the voltage at one end of the capacitance 68*a* (voltage of a node N1) changes from the reference voltage VR to the voltage of the picture signal. As a result, the gate voltage of the drive transistor 11*a* changes due to capacitance coupling. The amount of change is the voltage of the picture signal minus the reference voltage in parenthesis multiplied by the capacitance value of the capacitance 68*a* over, open parenthesis, the capacitance value of the capacitance 68*a* plus the capacitance value of the storage capacitance 19*a*, close parenthesis.

Through the behavior in the write period WP, the storage capacitance 19*a* stores a sum voltage of a voltage in accordance with the threshold voltage of the drive transistor 11*a* stored in the threshold correction period CP and a voltage in accordance with the voltage of the picture signal stored in the write period WP. By scanning the switches 17*a* and 17*b* in a conducted state in order, writing of the picture signal is performed in all of the pixel circuits 12*j* and 12*k*.

Next, when the pixel circuits 12*j* and 12*k* connected to the same transistor 20 terminates the behavior of the write period WP, the gate driver 1 causes the switches 17*a* and 17*b* to be in a non-conducted state through the first gate signal wires 16*a* and 16*b* and causes the switch 67*a* and 67*b* to be in a conducted state through the fifth gate signal wire 16*j* in the light-emitting period EP. As a result, a desired gradation current flows in the organic EL elements 14*a* and 14*b* regardless of the variation in the voltage-current characteristic of the drive transistors 11*a* and 11*b*, and each pixel emits light with a predetermined luminance.

In this embodiment, as described above, the pixels (pixel circuits 12*j* and 12*k*) corresponding to two rows are made common, and it is possible to implement the threshold correction behavior simultaneously for two rows. As a result, the number of the gate signal wires is reduced from eleven to seven in comparison with the active matrix display device using the pixel circuits 12*h* and 12*i* shown in FIG. 24. Since the number of the transistors per one pixel does not increase, the circuit scale of the pixel circuits 12*j* and 12*k* can be made small, and it is possible to realize a display device with higher resolution.

Regarding the load capacitance of the source signal wire 18, the channel capacitances 13 caused by the transistors 20 is halved since the number of the transistors 20 is halved, and the capacitance of a stray capacitance 15 is reduced since the cross area of the source signal wire 18 and the third gate signal wire 16*f*, the fourth gate signal wire 16*h*, the fifth gate signal wire 16*j*, and the sixth gate signal wire 16*l* is halved. Thus, writing of a picture signal can be performed with higher speed. The configuration of the pixel circuit in which behaviors of a plurality of pixel circuits sharing the transistor 20 are made common to reduce the number of the gate signal wires is not particularly limited to the configuration of the pixel circuit shown in FIG. 24. The configuration shown in FIG. 26 may be applied appropriately with respect to other various pixel circuits that perform a threshold correction behavior.

Figure 28:
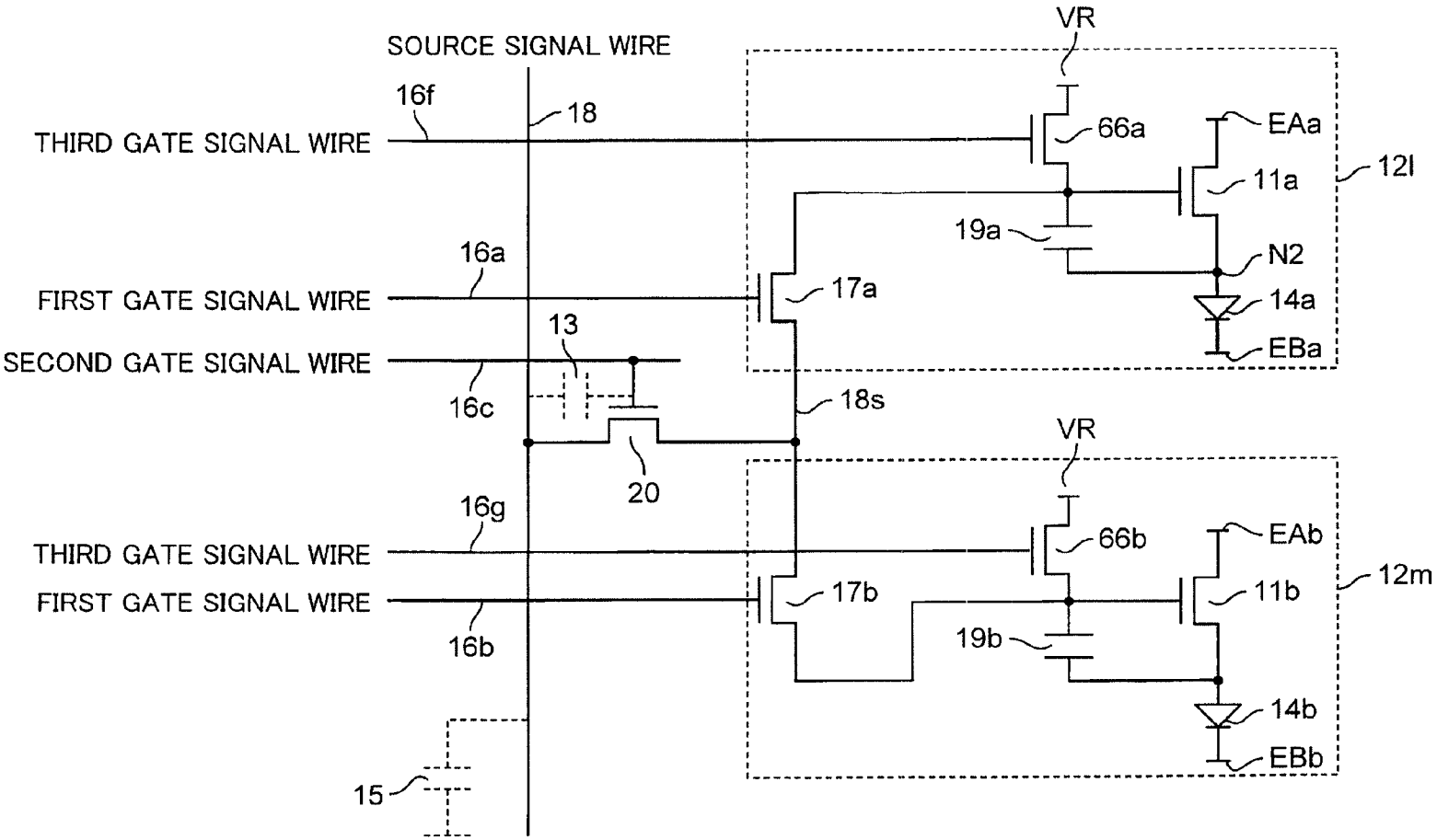
FIG. 28 is a circuit diagram showing the configuration of a pixel circuit of an active matrix display device in a ninth embodiment of the present invention.

Next, an active matrix display device in a ninth embodiment of the present invention will be described. FIG. 28 is a circuit diagram showing the configuration of a pixel circuit of the active matrix display device in the ninth embodiment of the present invention. The active matrix display device of this embodiment includes pixel circuits 12*l* and 12*m* having a function of correcting a threshold variation of the drive transistors 11*a* and 11*b*.

Specifically, as shown in FIG. 28, the first gate signal wires 16*a* and 16*b*, the second gate signal wire 16*c*, and the third gate signal wires 16*f* and 16*g* are arranged along the row direction of the organic EL panel 3. The first gate signal wires 16*a* and 16*b* are connected to pixel circuits 12*l* and 12*m* and arranged for every row of display pixels. The second gate signal wire 16*c* is provided with respect to the two pixel circuits 12*l* and 12*m* and arranged for every two rows of the display pixels. The third gate signal wires 16*f* and 16*g* are connected to the pixel circuits 12*l* and 12*m* and arranged for every row of the display pixels.

The source signal wire 18 is arranged along the column direction of the organic EL panel 3. The transistor 20 is arranged at each intersection of the second gate signal wire 16*c* and the source signal wire 18. The source signal wire 18 is connected to the secondary source signal wire 18*s* via the transistor 20. The secondary source signal wire 18*s* is connected to the pixel circuits 12*l* and 12*m* and arranged to correspond to the transistor 20 and connecting display pixels belonging to two consecutive rows in each column of the display pixels. The second gate signal wire 16*c* is connected to the gate of the transistor 20. The transistor 20 switches between conduction and non-conduction between the source signal wire 18 and the secondary source signal wire 18*s* in accordance with the voltage of the second gate signal wire 16*c*.

The pixel circuit 12*l* includes the drive transistor 11*a*, the organic EL element 14*a*, the switches 17*a* and 66*a*, and the storage capacitance 19*a*. The first gate signal wire 16*a* is connected to the gate of the switch 17*a*. The switch 17*a* switches between conduction and non-conduction between the secondary source signal wire 18*s* and the storage capacitance 19*a* in accordance with the voltage of the first gate signal wire 16*a*. The third gate signal wire 16*f* is connected to the gate of the switch 66*a*. The switch 66*a* switches between conduction and non-conduction between the reference voltage VR and a connection point for the storage capacitance 19*a* and the drive transistor 11*a* in accordance with the voltage of the third gate signal wire 16*f* to apply the reference voltage VR to the gate of the drive transistor 11*a*. One end of the drive transistor 11*a* is connected to a first EL power wire EAa. The other end of the drive transistor 11*a* is connected to one end of the organic EL element 14*a*. The other end of the organic EL element 14*a* is connected to a second EL power wire EAb. The pixel circuit 12*m* is configured in a similar manner to the pixel circuit 12*l*. Other pixel circuits (omitted in the drawing) are similar.

The pixel circuits 12*l* and 12*m* correspond to one example of display pixels and pixel circuits, the drive transistors 11*a* and 11*b* correspond to one example of drive transistors, and other configurations are similar to the first embodiment.

Figure 29:
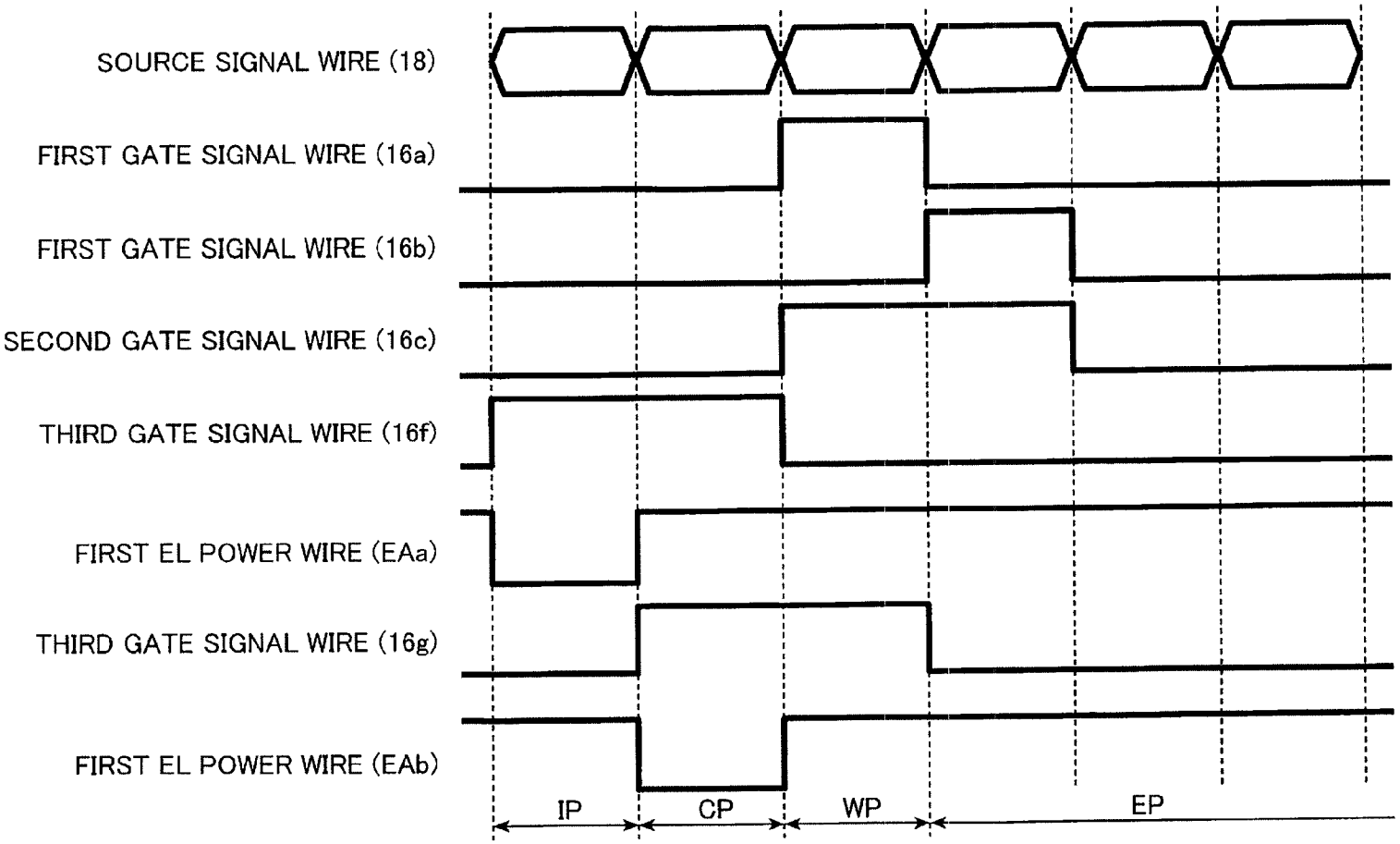
FIG. 29 is a timing diagram showing one example of the voltage waveforms of a source signal wire, first gate signal wires, a second gate signal wire, third gate signal wires, and first EL power wires shown in FIG. 28.

FIG. 29 is a timing diagram showing one example of the voltage waveforms of the source signal wire 18, the first gate signal wires 16*a* and 16*b*, the second gate signal wire 16*c*, the third gate signal wires 16*f* and 16*g*, and the first EL power wires EAa and EAb shown in FIG. 28.

First, in the initialization period IP, as shown in FIG. 29, the gate driver 1 causes the switch 66*a* to be in a conducted state through the third gate signal wire 16*f* to apply the reference voltage VR to the gate of the drive transistor 11*a* and to further change the voltage of the first EL power wire EAa to a voltage lower than the voltage of a second EL power wire EBa, in order to apply a large voltage (voltage with which drain current flows in the drive transistor 11*a*, i.e., voltage larger than the threshold voltage of the drive transistor 11*a*) between the gate and source of the drive transistor 11*a*.

That is, by applying a voltage (VDDL) lower than the voltage of the second EL power wire EBa to the organic EL element 14*a*via the drive transistor 11*a*from the first EL power wire EAa, a reverse bias voltage is applied to the organic EL element 14*a*, and the voltage of the first EL power wire EAa and the voltage the second EL power wire EBa are prepared such that the current of the drive transistor 11*a* does not flow via the organic EL element 14*a*.

Next, in the threshold correction period CP, the gate driver 1 increases the voltage of the first EL power wire EAa so that a current flows in the drive transistor 11*a*. Due to the behavior in the initialization period IP, the voltage of a node N2 is at VDDL level initially in the threshold correction period CP, and a reverse bias voltage is applied to the organic EL element 14*a*. The large voltage is applied between the gate and source of the drive transistor 11*a*, and the drain current flows. With the drain current, charging of the storage capacitance 19*a* and a capacitance component of the organic EL element 14*a* is performed, and the voltage of the node N2 is gradually increased. The voltage of the node N2 increases up to a voltage in which the drain current becomes zero, and the threshold correction behavior of the drive transistor 11*a* is completed.

At this time, it is necessary that the organic EL element 14*a* is not a path in which the drain current of the drive transistor 11*a* flows, and the power-supply voltage is set such that the voltage applied to the organic EL element 14*a* is less than or equal to the threshold voltage of the organic EL element 14*a*. That is, the power-supply voltage is set such that the reference voltage minus the voltage of the second EL power wire EBa is less than the threshold voltage of the drive transistor 11*a* plus the threshold voltage of the organic EL element 14*a*. As a result, a voltage in accordance with the threshold voltage of the drive transistor 11*a* is written in the storage capacitance 19*a*.

Next, in the write period WP, the gate driver 1 causes the transistor 20 and the switch 17*a* to be in a conducted state through the second gate signal wire 16*c* and the first gate signal wire 16*a*, so that a voltage in accordance with a picture signal is applied to the gate of the drive transistor 11*a* via the transistor 20 and the switch 17*a* from the source signal wire 18.

The gate-source voltage of the drive transistor 11*a* increases by the amount of the voltage of the picture signal minus the reference voltage in parenthesis multiplied by the capacitance value of the organic EL element 14*a* over, open parenthesis, the capacitance value of the organic EL element 14*a* plus the capacitance value of the storage capacitance 19*a*, close parenthesis, and a voltage in accordance with the voltage of the picture signal is added to the storage capacitance 19*a*. With the behavior above, an electric charge in accordance with the threshold voltage of the drive transistor 11*a* and the voltage of the picture signal is stored in the storage capacitance 19*a*.

Next, in the light-emitting period EP, the drive transistor 11*a* supplies the drain current to the organic EL element 14*a* in accordance with the potential difference stored in the storage capacitance 19*a*. At this time, the potential of the node N2 increases, a voltage sufficient for light emission is applied to the organic EL element 14*a*, and a pixel emits light with a predetermined luminance.

Although the behavior of the pixel circuit 12*l* has been described as an example in the description, it is possible for the pixel circuit 12*m* to emit light with a similar behavior. It is only necessary to implement the initialization period IP and the threshold correction period CP with a delay of one horizontal scanning period. Regarding the write period WP of the picture signal, it is only necessary that implementation be in a period in which the transistor 20 and the switch 17*b* are in a conducted state, and that the light-emitting period EP be after completion of writing. Regarding a first EL power wire EAb and a second EL power wire EBb, it is only necessary to implement a period of applying a voltage at VDDL level with a delay of one horizontal scanning period.

In this embodiment, as described above, the number of the transistors 20 is halved, and the channel capacitances 13 caused by the transistor 20 is halved. Therefore, writing of a picture signal can be performed with increased speed and accuracy while performing the threshold correction behavior.

Figure 30:
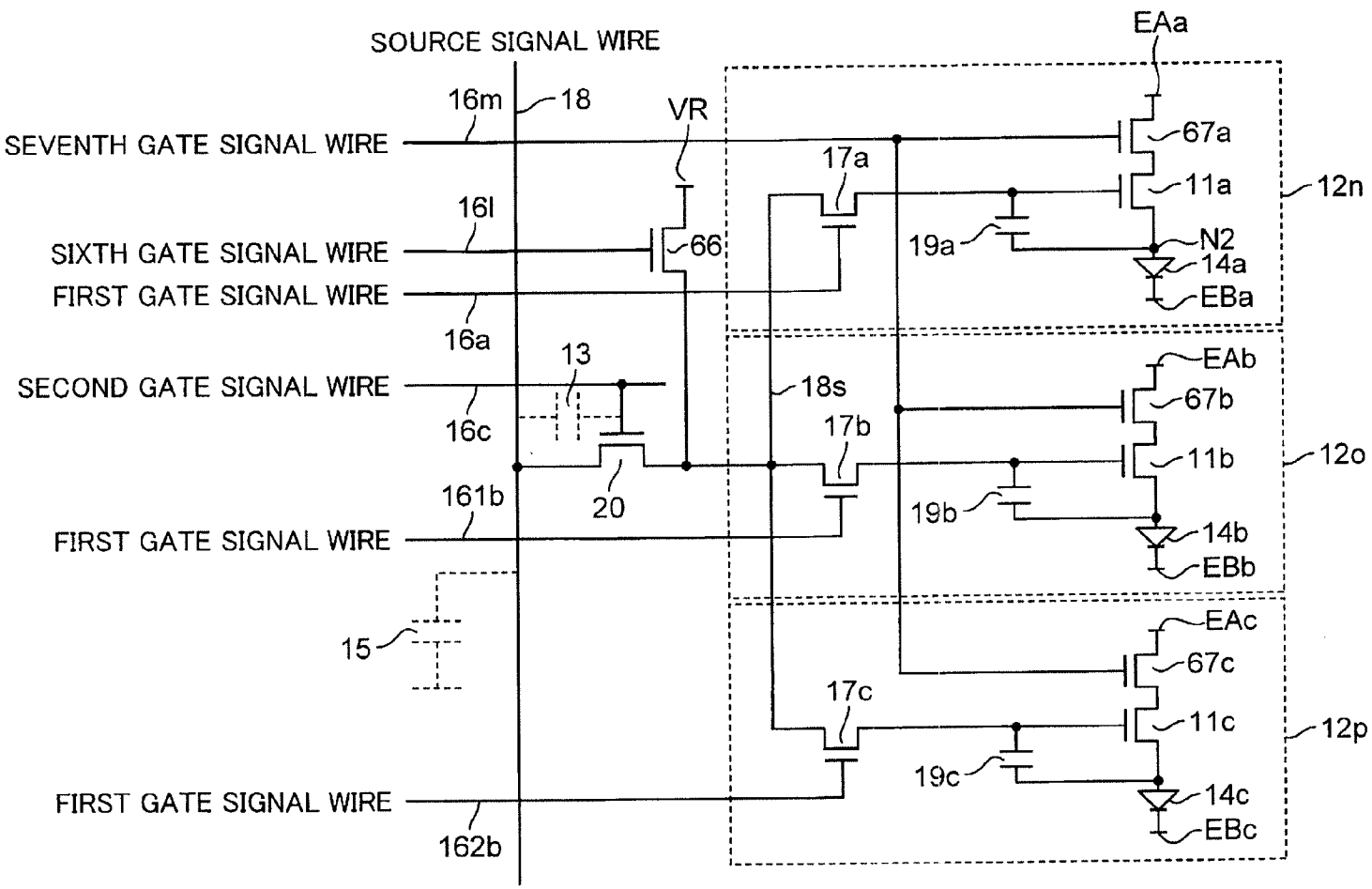
FIG. 30 is a circuit diagram showing the configuration of a pixel circuit of an active matrix display device in a tenth embodiment of the present invention.

Next, an active matrix display device in a tenth embodiment of the present invention will be described. FIG. 30 is a circuit diagram showing the configuration of a pixel circuit of the active matrix display device in the tenth embodiment of the present invention.

In this embodiment, in order for the behaviors of a plurality of pixel circuits, e.g., three pixel circuits 12*n*, 12*o*, and 12*p*, to be made common based on the configuration of the pixel circuit in the ninth embodiment, the three pixel circuits 12*n*, 12*o*, and 12*p* share the switch 66 and the reference voltage VR and share a seventh gate signal wire 16*m*. As a result, compared with the ninth embodiment, the number of the gate signal wires is reduced from seven to six, and the number of transistors as a switch is increased by one per three pixel circuits to reduce the number of switches.

Specifically, as shown in FIG. 30, first gate signal wires 16*a*, 161*b*, and 162*b*, the second gate signal wire 16*c*, the sixth gate signal wire 16*l*, and the seventh gate signal wire 16*m* are arranged along the row direction of the organic EL panel 3. The first gate signal wires 16*a*, 161*b*, and 162*b* are connected to the pixel circuits 12*n*, 12*o*, and 12*p* and arranged for every row of display pixels. The second gate signal wire 16*c*, the sixth gate signal wire 16*l*, and the seventh gate signal wire 16*m* are provided with respect to the three pixel circuits 12*n*, 12*o*, and 12*p* and arranged for every three rows of the display pixel.

The source signal wire 18 is arranged along the column direction of the organic EL panel 3. The transistor 20 is arranged at each intersection of the second gate signal wire 16*c* and the source signal wire 18. The source signal wire 18 is connected to the secondary source signal wire 18*s* via the transistor 20. The secondary source signal wire 18*s* is connected to the pixel circuits 12*n*, 12*o*, and 12*p* and arranged to correspond to the transistor 20 and connecting display pixels belonging to three consecutive rows in each column of the display pixels. The second gate signal wire 16*c* is connected to the gate of the transistor 20. The transistor 20 switches between conduction and non-conduction between the source signal wire 18 and the secondary source signal wire 18*s* in accordance with the voltage of the second gate signal wire 16*c*.

The pixel circuit 12*n* includes the drive transistor 11*a*, the organic EL element 14*a*, the switches 17*a* and 67*a*, and the storage capacitance 19*a*. The first gate signal wire 16*a* is connected to the gate of the switch 17*a*. The switch 17*a* switches between conduction and non-conduction between the secondary source signal wire 18*s* and the storage capacitance 19*a* in accordance with the voltage of the first gate signal wire 16*a*. The seventh gate signal wire 16*m* is connected to the gate of switches 67*a*, 67*b*, and 67*c*. The switches 67*a*, 67*b*, and 67*c* switch between conduction and non-conduction between first EL power wires EAa, EAb, and EAc and drive transistors 11*a*, 11*b*, and 11*c* in accordance with the voltage of the seventh gate signal wire 16*m*. The pixel circuits 12*o* and 12*p* are configured in a similar manner to the pixel circuit 12*n*. Other pixel circuits (omitted in the drawing) are similar.

The switch 66 is connected between the transistor 20 and the secondary source signal wire 18*s*, and an application point for the reference voltage VR is provided between the transistor 20 and switches 17*a*, 17*b*, and 17*c*. The configuration is such that, by applying the reference voltage VR to the secondary source signal wire 18*s*, the switch 66 can apply the reference voltage VR to either one of the three pixel circuits 12*n*, 12*o*, and 12*p*.

The pixel circuits 12*n*, 12*o*, and 12*p* correspond to one example of display pixels and pixel circuits, the drive transistors 11*a* and 11*b* correspond to one example of drive transistors, the switch 66 corresponds to one example of a third switching element, and other configurations are similar to the first embodiment.

In this embodiment, as described above, the switches provided for every pixel circuit can be made one with respect to a plurality of pixel circuits (one switch with respect to three pixel circuits in FIG. 30) to reduce the number of switches. Therefore, the necessary area for a pixel circuit layout is reduced, and this configuration can be applied easily to a display device with high resolution. Since the number of gate signal wires is reduced, the number of gate signal wires that crosses the source signal wire is reduced, the cross capacitance is reduced, and the time constant of the source signal wire can be made shorter.

Figure 31:
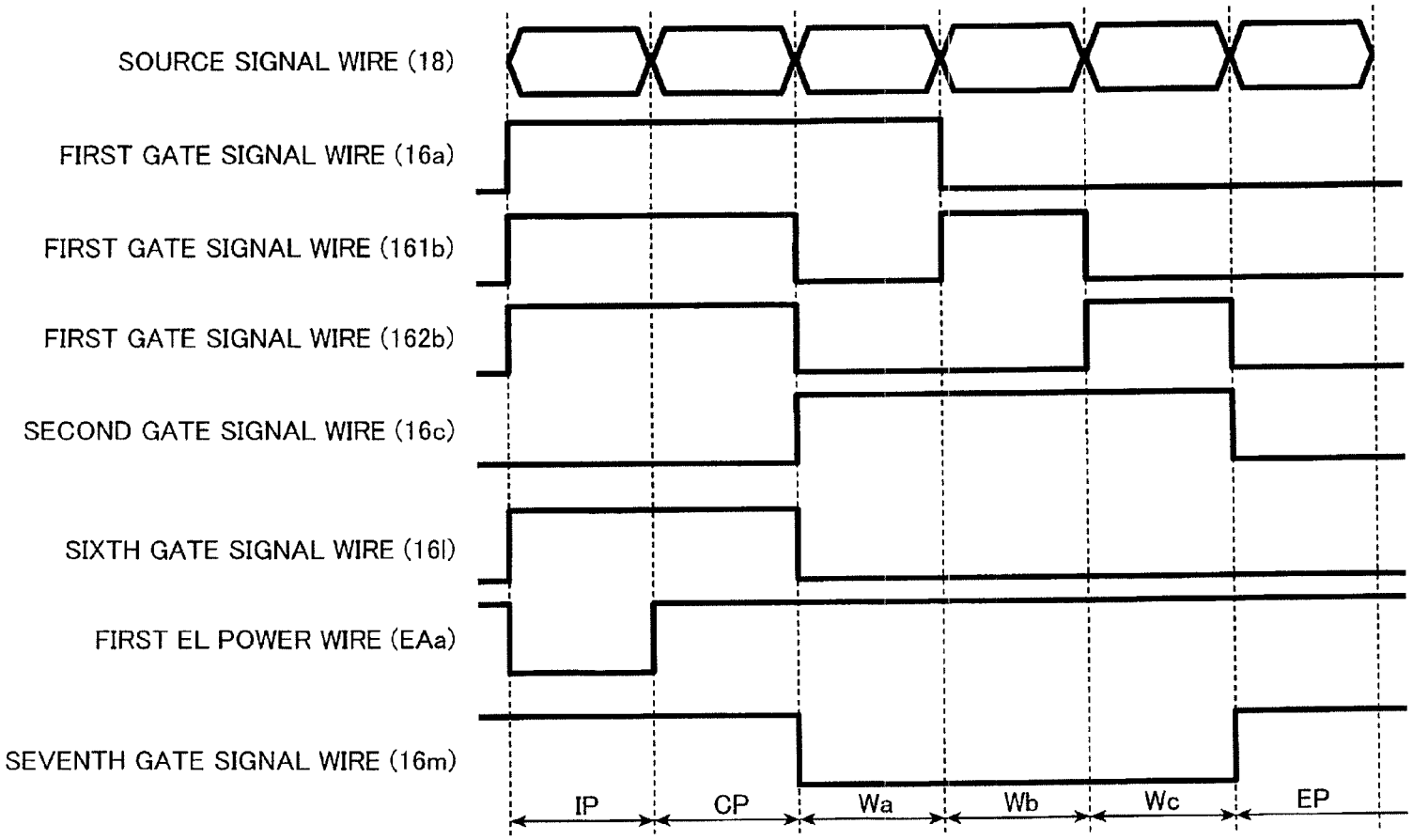
FIG. 31 is a timing diagram showing one example of the voltage waveforms of a source signal wire, first gate signal wires, a second gate signal wire, a sixth gate signal wire, a first EL power wire, and a seventh gate signal wire shown in FIG. 30.

FIG. 31 is a timing diagram showing one example of the voltage waveforms of the source signal wire 18, the first gate signal wires 16*a*, 161*b*, and 162*b*, the second gate signal wire 16*c*, the sixth gate signal wire 16*l*, the first EL power wire EAa, and the seventh gate signal wire 16*m* shown in FIG. 30.

First, in the initialization period IP, as shown in FIG. 31, the gate driver 1 applies a low voltage to the first EL power wires EAa to EAc and causes the switches 67*a* to 67*c* to be in a conducted state through the seventh gate signal wire 16*m* to apply the voltage of the first EL power wires EAa to EAc to the node N2, in order to apply a large voltage as the gate-source voltage of the drive transistors 11*a* to 11*c*. The voltage of the first EL power wires EAa to EAc needs to be a voltage lower than the voltage of second EL power wires EBa to EBc.

The gate driver 1 causes the switches 17*a* to 17*c* and the switch 66 to be in conducted state through the first gate signal wires 16*a*, 161*b*, and 162*b* and the sixth gate signal wire 16*l* to apply the reference voltage VR to the gate of the drive transistors 11*a* to 11*c*. As a first condition for the reference voltage VR, the reference voltage VR is set such that a value in which the voltage of the first EL power wires EAa to EAc is subtracted from the reference voltage VR is made sufficiently larger than the threshold voltage of the drive transistors 11*a* to 11*c* and a large drain current flows initially in a next threshold correction period CP.

Next, in the threshold correction period CP, the threshold correction behavior is performed, and the gate driver 1 increases the voltage of the first EL power wires EAa to EAc. When the source-drain voltage of the drive transistors 11*a*to 11*c* is increased, the drive transistors 11*a* to 11*c* cause the drain current based on the gate-source voltage set in the initialization period IP to flow. Due to the drain current, the capacitance of the organic EL element 14*a*is charged, and the potential of the node N2 increases.

As a second condition for the reference voltage VR, the potential difference of the reference voltage VR and the second EL power wires EBa to EBc is set to be less than or equal to the sum of the threshold voltage of the drive transistors 11*a* to 11*c* and the threshold voltage of organic EL elements 14*a* to 14*c*.

Since a voltage less than or equal to the threshold voltage is applied to the organic EL element 14*a* during the threshold correction period CP, the drain current does not flow in the organic EL element 14*a*. As a result, the potential of the node N2 increases up to a voltage value of the reference voltage minus the threshold voltage of the drive transistors 11*a* to 11*c*, and the voltage change ends. Accordingly, the threshold voltage of the drive transistors 11*a* to 11*c* is stored in storage capacitances 19*a* to 19*c*.

Next, in the write period Wa of the pixel circuit 12*n*, the write period Wb of the pixel circuit 12*o*, and a write period Wc of the pixel circuit 12*p*, the gate driver 1 controls the conduction state of the transistor 20 and the switches 17*a* to 17*c* through the second gate signal wire 16*c* and the first gate signal wires 16*a*, 161*b*, and 162*b*, so that a picture signal is input pixel by pixel in order from the source signal wire 18 for every horizontal scanning period and writing is performed pixel by pixel in order.

For example, in the case of the pixel circuit 12*n*, a picture signal is input to the gate of the drive transistor 11*a* via the transistor 20 and the switch 17*a*. Regarding the voltage of the storage capacitance 19*a* at this time, capacitance coupling with the capacitance of the organic EL element 14*a* causes the amount of change in the gate voltage of the drive transistor 11*a* to change in accordance with the capacitance ratio, and a voltage in accordance with the voltage of the picture signal and the threshold voltage is stored in the storage capacitance 19*a*. The other pixel circuits 12*o* and 12*p* are similar to the pixel circuit 12*n*.

In the write periods Wa, Wb, and Wc, it is necessary to cause the switches 67*a* to 67*c* to be in a non-conducted state. This is to prevent the occurrence of a problem that, due to the drain current being caused to flow in the drive transistors 11*a* to 11*c* by an increase in the gate voltage, the potential of the node N2 increases, the electric charge of the storage capacitances 19*a* to 19*c* changes (decreases), and the luminance decreases in the light-emitting period EP described later.

Thus, in order to hold the voltage of the storage capacitances 19*a* to 19*c* written in the write periods Wa, Wb, and Wc, the gate driver 1 causes the switches 67*a* to 67*c* to be in a non-conducted state through the seventh gate signal wire 16*m* to block the path through which the drain current is supplied to the drive transistors 11*a* to 11*c*. Accordingly, the potential fluctuation in the node N2 is prevented. In a pause period while writing in another circuit is performed, the fluctuation in the voltage stored in the storage capacitance is eliminated by causing all of the switches within the pixel circuit to be in a non-conducted state.

Next, in the light-emitting period EP, the gate driver 1 causes only the switches 67*a* to 67*c* to be in a conducted state through the seventh gate signal wire 16*m*, so that the drain current is supplied to the drive transistors 11*a* to 11*c* and the voltage of the node N2 increases. At this time, the gate voltage of the drive transistors 11*a* to 11*c* increases simultaneously, and the drain current is supplied continuously via the storage capacitances 19*a* to 19*c*.

Thus, in accordance with the current-voltage characteristic of the organic EL elements 14*a* to 14*c*, the voltage of the node N2 increases until a voltage necessary for the organic EL elements 14*a* to 14*c* with respect to the drain current is applied to both ends thereof. As a result, a current corresponding to a predetermined gradation flows in the organic EL elements 14*a* to 14*c* via the drive transistors 11*a* to 11*c*, and a pixel emits light with a predetermined luminance.

In this embodiment, as described above, the pixels (pixel circuits 12*n*, 12*o*, and 12*p*) corresponding to three rows are made common, and it is possible to implement the threshold correction behavior simultaneously for three rows. As a result, compared to the configuration in which the transistor 20 as a switch with which a picture signal from the source signal wire 18 is captured is not made common, the number of the gate signal wires is reduced, and the number of the transistors per pixel does not increase. Therefore, the circuit scale of the pixel circuits 12*n*, 12*o*, and 12*p* can be made small, and it is possible to realize a display device with higher resolution.

Regarding the load capacitance of the source signal wire 18, the number of the transistors 20 becomes one third, the channel capacitances 13 caused by the transistor 20 becomes one third, and the cross area of the source signal wire 18 and the sixth gate signal wire 16*l* as well as the seventh gate signal wire 16*m* becomes one third. Therefore, the capacitance of the stray capacitance 15 is reduced, writing of a picture signal can be performed with higher speed, and it is possible to realize a display device in which a picture signal is written easily.

A method in which gate signal wires of a plurality of pixel circuits are made common as described above is not particularly limited to the configuration shown in FIG. 30. Implementation is possible in a similar manner in the case where there is a switch in a pixel circuit other than the transistor 20 as a switch with which the voltage of a source signal wire is captured, and application is possible in a similar manner to a pixel circuit other than those shown in the drawing. The configuration can be applied in a similar manner for a configuration of a current-driven pixel circuit. For example, by making the fifth gate signal wires 16*j* and 16*k* connected to switches 54*ab* and 54*b* common in the configuration of the pixel circuit shown in FIG. 23, the configuration can be applied in a similar manner.

Figure 32:
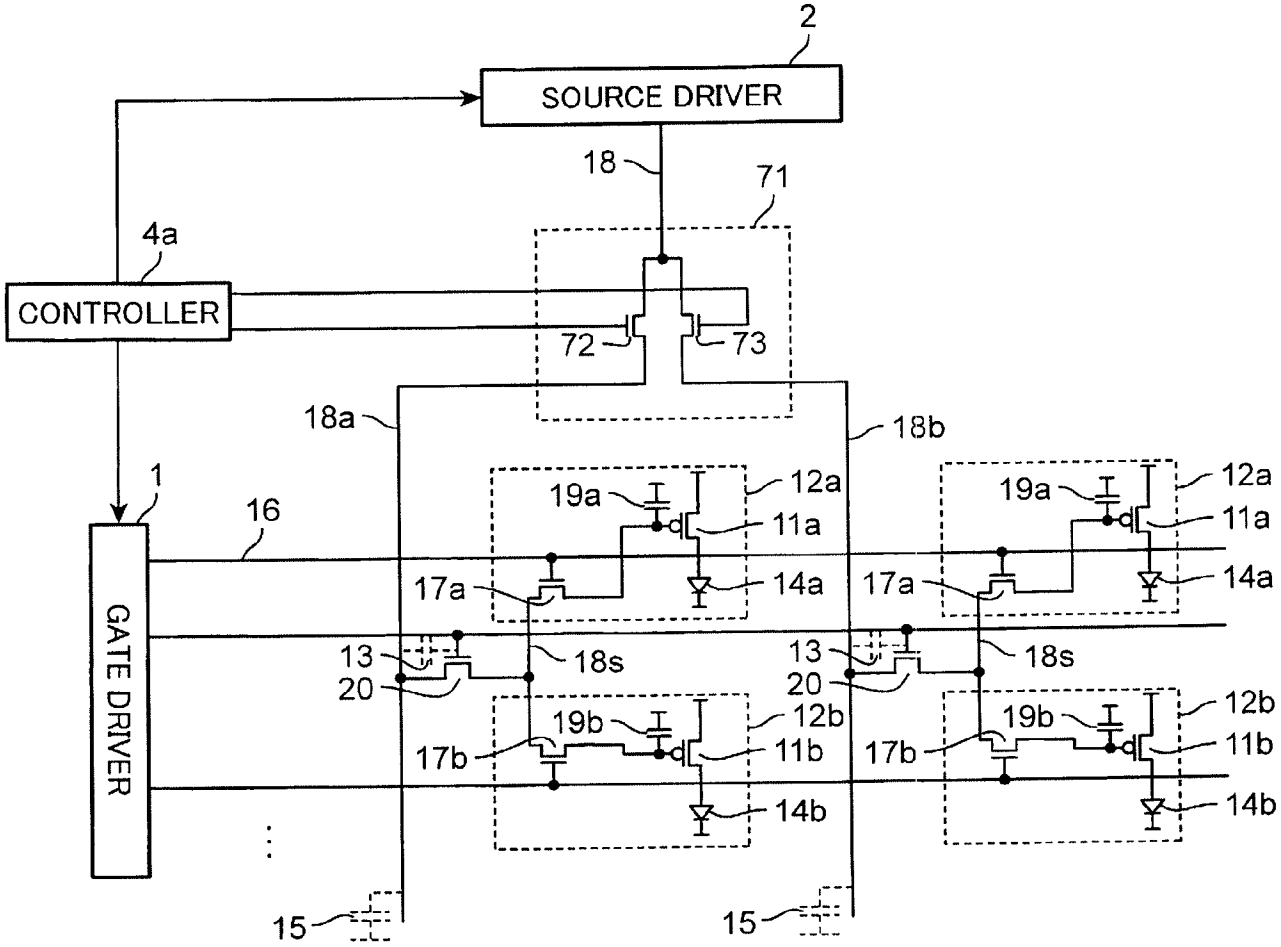
FIG. 32 is a circuit diagram showing the configuration of an active matrix display device in an eleventh embodiment of the present invention.

Next, an active matrix display device in an eleventh embodiment of the present invention will be described. FIG. 32 is a circuit diagram showing the configuration of the active matrix display device in the eleventh embodiment of the present invention. In order to reduce the output number of a source driver, there is a method of supplying the gradation voltage to a plurality of source signal wires from one output of the source driver. In this embodiment, the gradation voltage is supplied to two source signal wires from one output of a source driver.

The active matrix display device shown in FIG. 32 is an organic EL display device and includes the gate driver 1, the source driver 2, the organic EL panel 3, a controller 4*a*, the plurality of pixel circuits 12*a* and 12*b*, the plurality of gate signal wires 16, a plurality of source signal wires 18, 18*a*, and 18*b*, the plurality of transistors 20, and a signal wire selection circuit 71.

The gate driver 1, the source driver 2, the plurality of pixel circuits 12*a* and 12*b*, the plurality of gate signal wires 16, and the plurality of source signal wires 18*a* and 18*b* are configured in a similar manner to the gate driver 1, the source driver 2, the plurality of pixel circuits 12*a* and 12*b*, the plurality of gate signal wires 16 (the first gate signal wires 16*a* and 16*b* and the second gate signal wire 16*c*), and the plurality of secondary source signal wires 18 shown in FIG. 1 and FIG. 2, and behave in a similar through control of the gate driver 1 and the source driver 2 by the controller 4*a*.

The signal wire selection circuit 71 includes two switches 72 and 73. The gate of the switches 72 and 73 is input with a signal wire selection signal output from the controller 4*a*. The switches 72 and 73 are controlled by the controller 4*a*. The switches 72 and 73 connect the one source signal wire 18 extending from the source driver 2 to the selected one of the two source signal wires 18*a* and 18*b* in accordance with the signal wire selection signal. The behavior of each circuit thereafter is similar to the first embodiment.

When selection driving of the source signal wire is implemented, the write period of the voltage of a picture signal per pixel becomes one over the number of selected signal wires, compared to a case where selection driving is not performed. For example, in this embodiment, the write period becomes one half, and it becomes more difficult to write a picture signal in the pixel circuits 12*a* and 12*b* within a predetermined write period.

Therefore, after one of the source signal wires 18*a* and 18*b* is selected in this embodiment, a picture signal is written in the pixel circuits 12*a* and 12*b* while reducing the load capacitance of the source signal wires 18*a* and 18*b* in a similar manner to the first embodiment. Thus, in this embodiment, writing of a picture signal can be performed at high speed even in the case where selection driving of the source signal wires 18*a* and 18*b* is performed. Since more source signal wires can be selected as a result, writing of a picture signal can be performed at high speed even in a display device with more numbers of vertical pixels or a display device with a larger screen. Accordingly, the output number (number of the source signal wires 18) necessary for the source driver 2 is reduced, and it is possible to provide a display device that is more inexpensive.

In the respective embodiments, an analog drive scheme in which an analog gradation voltage is output to a source signal wire to perform gradation display has been described as an example. However, the present invention is not limited to this example. It is possible to apply the present invention in a similar manner to a digital drive scheme in which a signal indicating lighting or non-lighting is sent from a source signal wire to perform gradation display depending on a lighting period. In the case of the digital drive scheme, the signal transfer rate increases, and a signal wire with a smaller parasitic capacitance is required. Therefore, the reduction effect for channel capacitances in the present invention becomes more significant.

As the transistor (switch) used in the present invention, various transistors such as an amorphous silicon thin film transistor (TFT), a polysilicon TFT, an oxide TFT may be used. Configuration in a similar manner to the above is possible regardless of a channel layer of a TFT, and the effect of the present invention is greater in those with a greater off capacitance in the TFT.

Application is possible in a similar manner to the above with either a metal oxide semiconductor (MOS) transistor or a metal insulator semiconductor (MIS) transistor. For the material, amorphous silicon, polysilicon, microcrystalline silicon, crystalline silicon, polycrystalline silicon, oxide semiconductor, organic semiconductor, or the like may be used.

Although the transistor (switch) has been described with an example of an n-type semiconductor, the present invention can be applied in a similar manner to the above to a p-type semiconductor. For example, in the case of a drive transistor, the present invention can be applied in a similar manner to the above to either an n-type semiconductor or a p-type semiconductor through a design in which the direction of current is reversed so that the connection of a storage capacitance is between a source and a gate.

The source driver, the controller, and the gate driver may be formed by separate chips, and on top of this, a plurality of blocks may be formed by one chip. In addition, the gate driver may be formed on an array substrate.

Overdrive driving for a source signal wire and a gate signal wire or a driving method in which a data change point of a source signal wire is changed for every output of a source driver to lengthen a write period may be implemented in combination with the present invention.

Upon performing driving based on a setting value different for every pixel such as advanced-pre-charge driving (APD), the number of necessary setting values can be reduced for pixels sharing the transistor 20 through driving with the same setting value to obtain an effect of reducing the circuit scale.

Although description has been made with an example in which sharing of the transistor 20 is for two pixels or the like as an application example for a pixel circuit, application is possible in a similar manner to an arbitrary number of pixels. Further, the present invention can be applied in a similar manner to the above to either a stripe arrangement or a delta arrangement regarding the pixel arrangement by connecting, with each other and via the transistor 20, a plurality of pixels connected to the same source signal wire and that do not capture data from the source signal wire simultaneously.

The respective embodiments may be carried out in an arbitrary combination. An effect similar to the above can be obtained in this case.

The present invention is summarized as follows from the embodiments. That is, a display device according to the present invention includes: a plurality of display pixels arranged in a matrix, a scanning wire arranged for every N rows (N is an integer greater than or equal to 2) of the display pixels; a selection control wire arranged for every row of the display pixels; a main data wire arranged for every column of the display pixels; a first switching element arranged at each intersection of the scanning wire and the main data wire; and a secondary data wire arranged to correspond to each of first switching elements and connecting the display pixels belonging to the N rows in each column of the display pixels, each of the display pixels including a second switching element and a capacitance element for maintaining a voltage corresponding to display data, the first switching element switching between conduction and non-conduction between the main data wire and the secondary data wire in accordance with a voltage of the scanning wire, and the second switching element switching between conduction and non-conduction between the secondary data wire and the capacitance element in accordance with a voltage of the selection control wire.

A method for driving a display device according to the present invention is a method for driving a display device including a plurality of display pixels arranged in a matrix, a scanning wire arranged for every N rows (N is an integer greater than or equal to 2) of the display pixels, a selection control wire arranged for every row of the display pixels, a main data wire arranged for every column of the display pixels, a first switching element arranged at each intersection of the scanning wire and the main data wire, and a secondary data wire arranged to correspond to each of first switching elements and connecting the display pixels belonging to the N rows in each column of the display pixels, each of the display pixels including a second switching element and a capacitance element for maintaining a voltage corresponding to display data, the method including: operating the capacitance element to maintain a voltage corresponding to display data by causing the first switching element to electrically connect the main data wire and the secondary data wire to each other in accordance with a voltage of the scanning wire and causing the second switching element to electrically connect the secondary data wire and the capacitance element to each other in accordance with a voltage of the selection control wire.

In the display device, the first switching element connected to the main data wire is provided not for every row but for every N rows to reduce the number of the first switching elements, so that a parasitic capacitance of the main data wire can be reduced to shorten the time necessary for writing. Thus, a picture signal can be written accurately even if the number of pixel rows increases due to an increase in resolution of a display screen and a write period is shortened. Since the main data wire and the capacitance element within each display pixel are connected via the two first and second switching elements connected in series, leak current can be reduced to reduce a vertical crosstalk. As a result, a picture signal can be written accurately and a vertical crosstalk can be reduced even if the number of pixel rows and the number of pixel columns increase due to an increase in resolution of a display screen and a write period is shortened.

Desirably, the scanning wire and one selection control wire out of N selection control wires corresponding to the scanning wire are formed by a common scanning wire.

In this case, one scanning wire and one selection control wire can be formed by one common scanning wire. Therefore, it is possible to reduce the number of parasitic capacitances with respect to one main data wire without increasing the total number of the scanning wire and the selection control wire, and a favorable display without color mixture can be achieved.

Desirably, one display pixel out of display pixels belonging to the N rows is not provided with the second switching element, and another display pixel is provided with the second switching element.

In this case, a voltage stored in the capacitance element can be isolated between display pixels using the first switching element and the second switching element of another display pixel. Therefore, a parasitic capacitance of the main data wire can be reduced without increasing the number of switching elements.

Desirably, the N is 2.

In this case, the first switching element connected to the main data wire is provided not for every row but for every two rows to reduce the number of the first switching elements by half. Accordingly, the parasitic capacitance of the main data wire can be reduced sufficiently to shorten the time necessary for writing, and a picture signal can be written accurately even if the number of pixel rows increases due to an increase in resolution of a display screen and a write period is shortened.

Desirably, the display pixel includes an organic electro-luminescence element.

In this case, a picture signal can be written accurately and a vertical crosstalk can be shortened, even if the number of pixel rows and the number of pixel columns of an organic electro-luminescence panel increase due to an increase in resolution of a display screen and a write period is shortened. Therefore, a clear image can be displayed while achieving light weight, thinness, and low power consumption.

Desirably, the display pixel includes a drive transistor and includes a pixel circuit that compensates a threshold of the drive transistor.

In this case, a threshold correction behavior of the drive transistor within the pixel circuit can be performed. Therefore, writing of a picture signal at high speed can be performed more accurately.

Desirably, the display pixel further comprises a third switching element that is connected between the first switching element and the secondary data wire and that applies a predetermined reference voltage to the secondary data wire.

In this case, the third switching element can apply the reference voltage to a plurality of the pixel circuits connected to the secondary data wire. Therefore, it is not necessary to provide the third switching element for every pixel circuit, and the number of the third switching elements and the number of control wires that control the third switching element can be reduced. As a result, the area necessary for layout of the pixel circuit can be reduced, and the number of control wires that cross the main data wire can be reduced. Therefore, the cross capacitance is reduced, and the time constant of the main data wire can be made shorter.

Desirably, the display pixel includes a liquid crystal element.

In this case, the amplitude of a writing voltage can be reduced by short-circuiting the capacitance element within two display pixels in which the first switching element is made common to discharge the internal electric charge in advance. Therefore, a desired gradation voltage can be written in a short time in a liquid crystal display device with a large screen and high resolution.

INDUSTRIAL APPLICABILITY

The present invention can be applied suitably to a display device that displays an image using an organic electro-luminescence element or a liquid crystal element, since a picture signal can be written accurately and a vertical crosstalk can be reduced, even if the number of pixel rows and the number of pixel columns increase due to an increase in resolution of display pixels and a write period is shortened.

The invention claimed is:

1. A display device, comprising:

a plurality of display pixels arranged in a matrix;

a scanning wire arranged for every N rows (N is an integer greater than or equal to 2) of the display pixels;

a selection control wire arranged for every row of the display pixels;

a main data wire arranged for every column of the display pixels;

a first switching element arranged at each intersection of the scanning wire and the main data wire; and a secondary data wire arranged to correspond to each of first switching elements and connecting the display pixels belonging to the N rows in each column of the display pixels, each of the display pixels including an organic electro-luminescence element, a drive transistor, and a capacitance element for maintaining a voltage corresponding to display data, all display pixels that belong to the N rows including a second switching element, except one display pixel that does not include the second switching element, the first switching element switching between conduction and non-conduction between the main data wire and the secondary data wire in accordance with a voltage of the scanning wire, the second switching element switching between conduction and non-conduction between the secondary data wire and the capacitance element in accordance with a voltage of the selection control wire, the display pixels being driven with a voltage drive scheme in which light is emitted with a luminance corresponding to a voltage applied to the main data wire, and the first switching element switching between conduction and non-conduction between the main data wire and the capacitance element of the one display pixel in accordance with the voltage of the scanning wire.

2. The display device according to claim 1, wherein the scanning wire and one selection control wire out of N selection control wires corresponding to the scanning wire are formed by a common scanning wire.

3. The display device according to claim 1, wherein the N is 2.

4. The display device according to claim 1, wherein each of the display pixels further has a fourth switching element connected to the organic electro-luminescence element, and the organic electro-luminescence element is controlled not to emit light by subjecting the fourth switching element to a non-conductive state during writing period of writing in the capacitance element a voltage corresponding to display data.

5. The display device according to claim 1, wherein each of the display pixels further has a fifth switching element switching between conduction and non-conduction between the capacitance element and the organic electro-luminescence element, and the organic electro-luminescence element is controlled not to emit light by subjecting the fifth switching element to a non-conductive state during writing period of writing in the capacitance element a voltage corresponding to display data.

6. The display device according to claim 1, wherein the display pixel includes a pixel circuit that compensates a threshold of the drive transistor.

7. The display device according to claim 6, further comprising:

a third switching element that is connected between the first switching element and the secondary data wire and that applies a predetermined reference voltage to the secondary data wire.

8. The display device according to claim 7, wherein the third switching element is arranged between the main data wire and the secondary data wire.

9. The display device according to claim 6, wherein a threshold correction behavior of the drive transistor is implemented simultaneously in the display pixels belonging to the N rows.

10. The display device according to claim 9, wherein each of the display pixels includes a third switching element that is connected between the first switching element and the secondary data wire and that applies a reference voltage to the secondary data wire.

11. A method for driving a display device, including a plurality of display pixels arranged in a matrix; a scanning wire arranged for every N rows (N is an integer greater than or equal to 2) of the display pixels; a selection control wire arranged for every row of the display pixels; a main data wire arranged for every column of the display pixels; a first switching element arranged at each intersection of the scanning wire and the main data wire; and a secondary data wire arranged to correspond to each of first switching elements and connecting the display pixels belonging to the N rows in each column of the display pixels, each of the display pixels including an organic electro-luminescence element, a drive transistor, and a capacitance element for maintaining a voltage corresponding to display data, all display pixels that belong to the N rows including a second switching element, except one display pixel that does not include the second switching element, the method comprising:

operating the capacitance element to maintain a voltage corresponding to display data by causing the first switching element to electrically connect the main data wire and the secondary data wire to each other in accordance with a voltage of the scanning wire and causing the second switching element to electrically connect the secondary data wire and the capacitance element to each other in accordance with a voltage of the selection control wire; and driving the display pixels with a voltage drive scheme in which light is emitted with a luminance corresponding to a voltage applied to the main data wire, wherein the first switching element switches between conduction and non-conduction between the main data wire and the capacitance element of the one display pixel in accordance with the voltage of the scanning wire.

* * * * *